US012000237B2

(12) United States Patent
Eden et al.

(10) Patent No.: US 12,000,237 B2
(45) Date of Patent: Jun. 4, 2024

(54) WELL SEALING MATERIAL AND METHOD OF PRODUCING A PLUG

(71) Applicant: Rawwater Engineering Limited, Cheshire (GB)

(72) Inventors: Robert Eden, Cheshire (GB); Joseph Oluleke, Cheshire (GB)

(73) Assignee: RAWWATER ENGINEERING LIMITED, Cheshire (GB)

( * ) Notice: Subject to any disclaimer, the term of this patent is extended or adjusted under 35 U.S.C. 154(b) by 75 days.

(21) Appl. No.: 17/254,091

(22) PCT Filed: Jun. 21, 2019

(86) PCT No.: PCT/GB2019/051755
§ 371 (c)(1),
(2) Date: Dec. 18, 2020

(87) PCT Pub. No.: WO2020/002887
PCT Pub. Date: Jan. 2, 2020

(65) Prior Publication Data

US 2021/0262313 A1 Aug. 26, 2021

(30) Foreign Application Priority Data

Jun. 25, 2018 (GB) ..... 1810418

(51) Int. Cl.
*E21B 33/134* (2006.01)
*C22C 12/00* (2006.01)

(52) U.S. Cl.
CPC ..... *E21B 33/134* (2013.01); *C22C 12/00* (2013.01)

(58) Field of Classification Search
None
See application file for complete search history.

(56) References Cited

U.S. PATENT DOCUMENTS 4,236,922 A * 12/1980 Michl ..... C22C 13/02 420/561
5,833,921 A 11/1998 Paruchuri et al.
(Continued)

FOREIGN PATENT DOCUMENTS

EP 1381066 A2 1/2004
EP 3047937 A1 7/2016
(Continued)

OTHER PUBLICATIONS

Intellectual Property Office; Great Britain Examination Report; Application No. GB2114108.0; dated Dec. 14, 2021; 2 pages.
(Continued)

*Primary Examiner* — Anuradha Ahuja
(74) *Attorney, Agent, or Firm* — Faegre Drinker Biddle & Reath LLP

(57) ABSTRACT

Bismuth-based alloys comprising at least about 50% by weight bismuth, about 30 to about 35% by weight tin, and about 1.8 to about 2.8% by weight antimony; and an alloy of bismuth and silver comprising about 90 to about 97% by weight bismuth and about 3 to about 9% by weight silver. A plug comprising an alloy of bismuth, tin, and antimony; and a plug comprising an alloy of bismuth and silver. A method of using a plug made from a bismuth-based alloy to seal a well, wherein a length of a well is filled with the molten alloy and the molten alloy is allowed to solidify.

6 Claims, 33 Drawing Sheets

(56) References Cited

U.S. PATENT DOCUMENTS

| | | | | |
|---|---|---|---|---|
| 6,523,610 | B1 | 2/2003 | Griffith et al. | |
| 2007/0137826 | A1* | 6/2007 | Bosma | E21B 43/103 166/380 |
| 2012/0055586 | A1* | 3/2012 | McIsaac | B23K 1/0008 228/56.3 |
| 2014/0363692 | A1 | 12/2014 | Marya et al. | |
| 2019/0144975 | A1* | 5/2019 | Marya | C22C 12/00 420/577 |

FOREIGN PATENT DOCUMENTS

| | | | |
|---|---|---|---|
| EP | 3078446 | A1 | 10/2016 |
| GB | 2562620 | A | 11/2018 |
| JP | 2004296422 | A | 10/2004 |
| WO | 0166990 | A1 | 9/2001 |
| WO | 0227137 | A1 | 4/2002 |
| WO | 2015122913 | A1 | 8/2015 |

OTHER PUBLICATIONS

Kleppa, O.J.; Journal of Physical Chemistry, vol. 60, 1956, "The Thermodynamics Properties of the Moderately Dilute Liquid Solutions of Copper, Silver and Gold in Thallium Lead, and Bismuth", p. 446-452.

Nathans, Marcel W. et al.; Journal of Physical Chemistry, vol. 66, 1962, "Studies on Bismuth Alloys. Liquidus Curves of the Bismuth-Copper, Bismuth-Silver, and Bismuth-Gold systems" p. 2012-2015.

Intellectual Property Office; Great Britain Search Report; Application No. GB1810418.2; dated Nov. 12, 2021; 1 page.

UK International Property Office Search Report, Application No. GB1810418.2, dated Nov. 13, 2018, 5 pages.

UK International Property Office Search Report, Application No. GB1810418.2, dated Jun. 17, 2019, 3 pages.

PCT International Search Report and Written Opinion, International Application No. PCT/GB2019/051755, dated Oct. 7, 2019, 11 pages.

Dusko Minic et al., "Characterization of Alloys and Liquidus Projections of Ternary Bi—Sb—Sn System", High Temperature Materials and Processes, vol. 31, 2012, pp. 19-26.

Phase Diagram Evaluations: Section II, Karakaya et al, "The Ag—Bi (Silver-Bismuth) System", pp. 525-530, see especially figure 2.

H. Ohtani et al., "A Thermodynamic Study of Phase Equilibria in the Bi—Sn—Sb System", Journal of Electronic Materials, Springer US, Boston, vol. 23, No. 8, Aug. 1, 1994, pp. 747-755, XP035178622.

* cited by examiner

Figure 28a-f

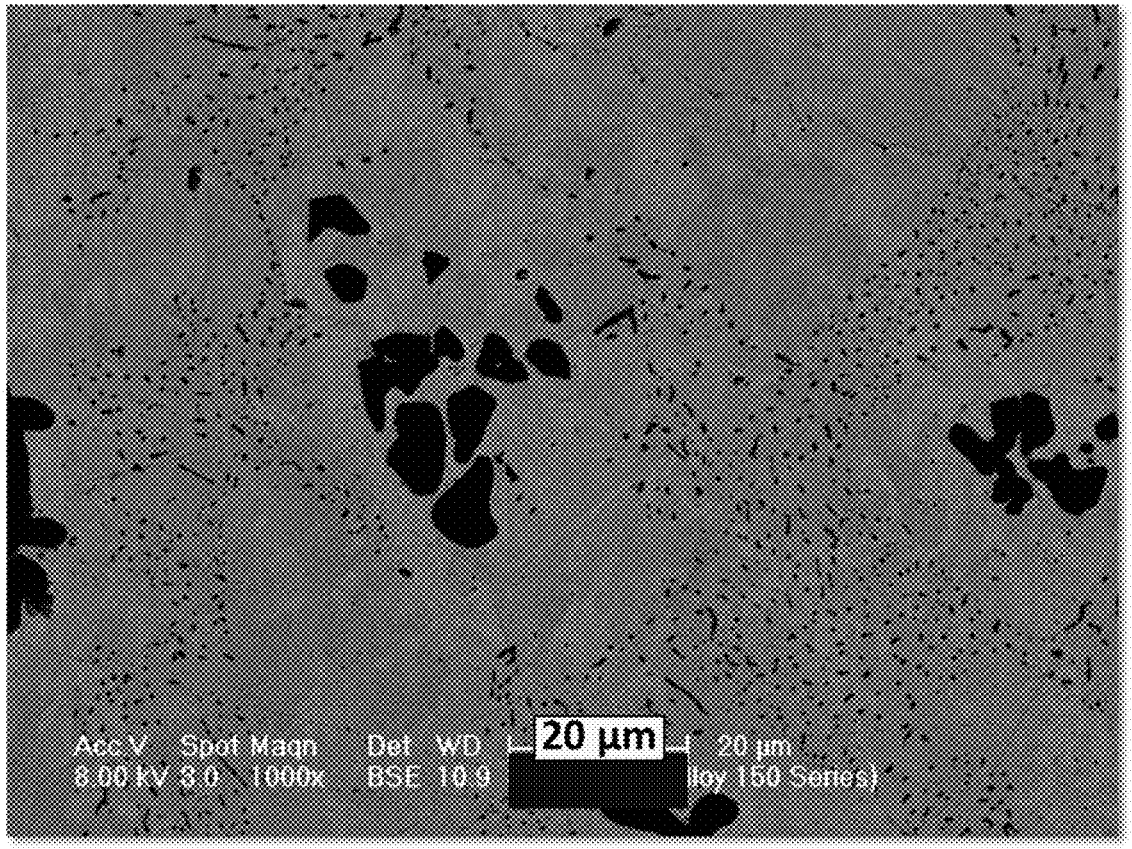
Figure 29
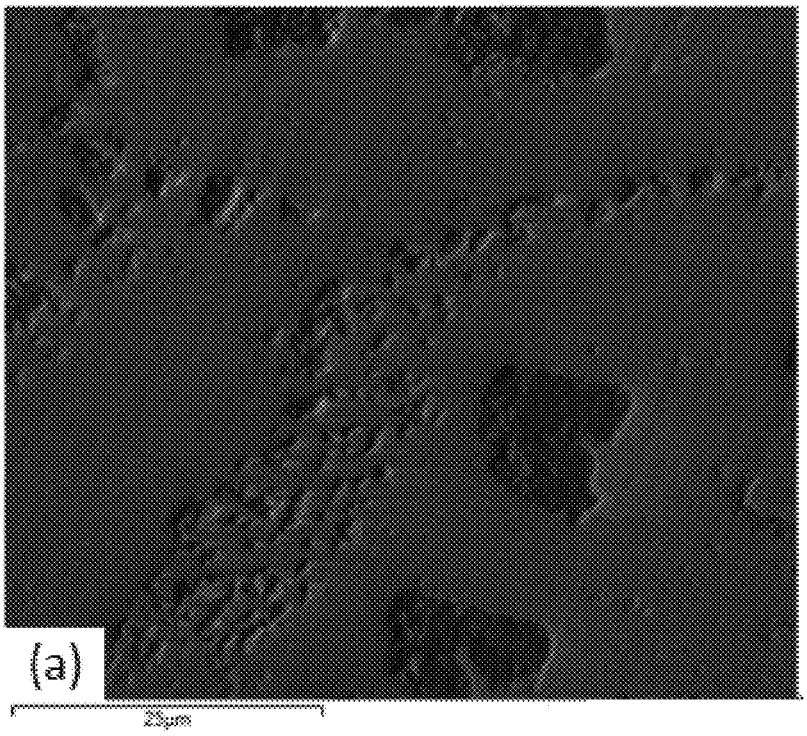
Figure 30a-e

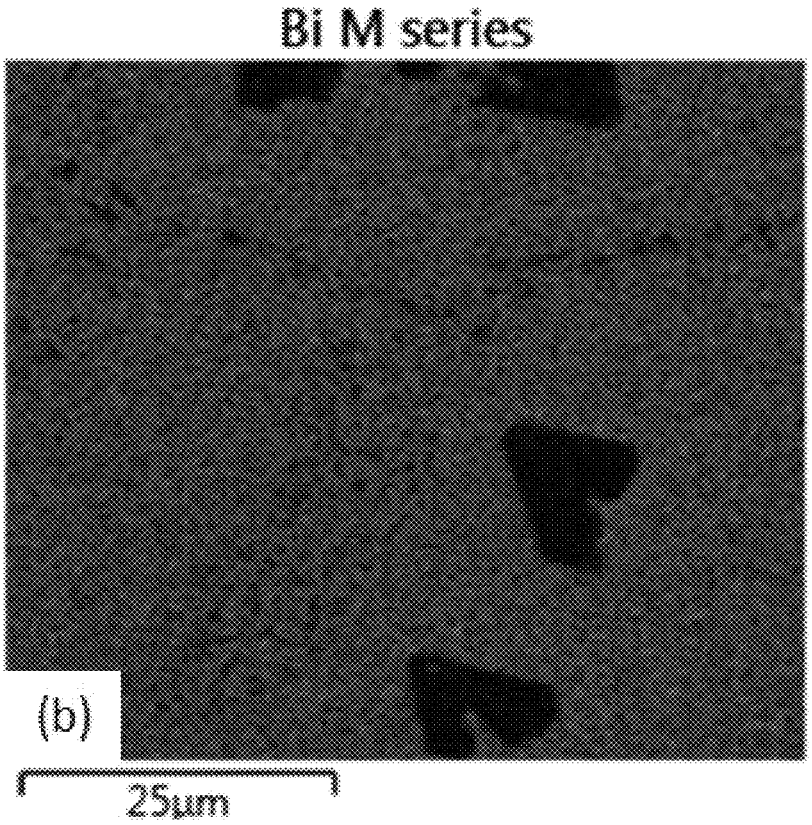
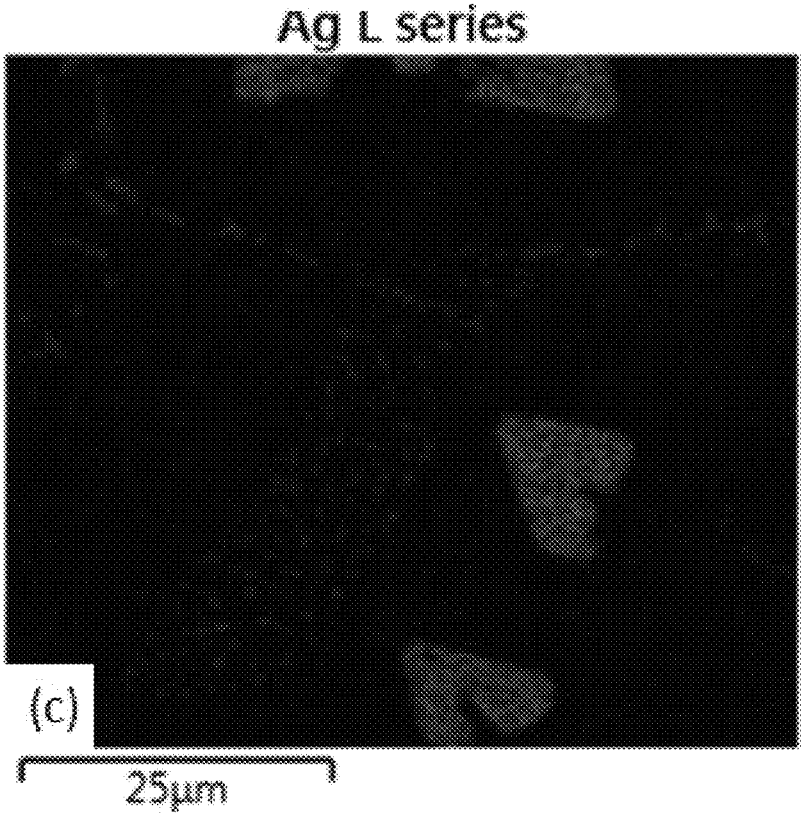
Figure 30a-e
(continued)

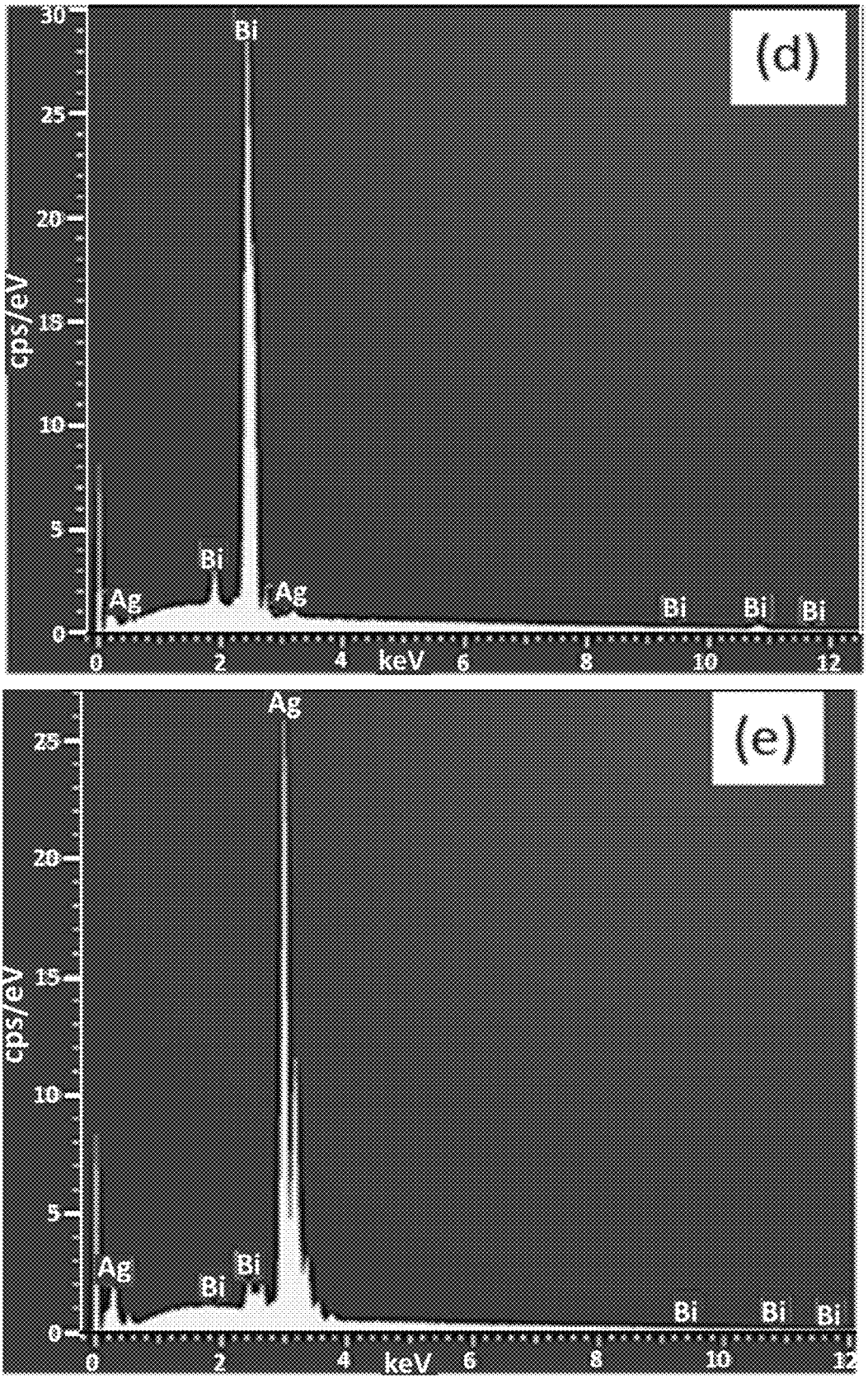
Figure 30a-e
(continued)

WELL SEALING MATERIAL AND METHOD OF PRODUCING A PLUG

CROSS-REFERENCE TO RELATED APPLICATIONS

The present application is a national stage entry of International (PCT) Patent Application Number PCT/GB2019/051755, filed Jun. 21, 2019, which in turn claims priority to Patent Application No. GB 1810418.2, filed Jun. 25, 2018, the subject matter of which are expressly incorporated herein by reference.

The present invention relates to a well sealing material, a plug made from the material and a method of producing a plug. More particularly, the present invention relates to bismuth-based alloys and the use of plugs made from such alloys to seal wells as well as the plugs themselves.

In the oil and gas extraction industries, abandoned wells have to be plugged to keep the contents of deep high pressure environments which communicate with those wells from invading levels at or adjacent the surface. Plugs can be inserted at any point in a well, for example adjacent the surface or at a substantial depth. Typically, plugs are formed by injecting cement or resin into the well so as to fill for example a fifty metre length of the well. Experience has proven, however, that such plugs are not particularly reliable and often leak.

The known plugs tend to leak for a variety of reason. Firstly, as the well wall is typically not particularly clean and is covered with a hydrocarbon film, it is difficult to produce a contiguous seal. Often a contiguous seal of only a metre or so in length is formed with a plug fifty times that length. Furthermore, as cement and resin based plugs solidify, they contract which tends to open up a gap between the plug and a well wall. Although when a plug is initially inserted there may be little dynamic pressure in the well, after the plug is in situ substantial pressures can build up and as a result a plug which appears initially to be working satisfactorily may subsequently be found to leak. If hydrocarbons leak past the plug, contamination of the surface environment or, for example, a sub-surface aquifer can result. It is well known in the industry that a significant proportion of abandoned wells leak. As a result, leaking abandoned wells often have to be re-plugged which is an expensive and time consuming operation. It is therefore an object of the present invention to provide an alloy suitable for using as a plug in a well which can withstand the substantial pressures of a well.

It is also known to form a plug in a well by delivering a metal alloy, for example a low-melting point bismuth-containing alloy such as Rose's metal, Kraft's alloy, or Homberg's alloy. These alloys expand upon solidification and thus once deposited in a well they lose heat into the surrounding environment, solidify, and in solidifying expand to form a secure plug within the well. These alloys are comprised of varying amounts of bismuth, tin, and lead. WO02/27137, the contents of which are hereby incorporated by reference, discloses a well sealing method and apparatus in which a length of the well which is being plugged is filled with a molten material which has a melting point higher than the well temperature and which expands as it solidifies. The molten material is delivered to the well in a molten state where it cools, solidifies, and expands.

It is known that in certain circumstances, metals can be weakened by contact with liquid metals. This is known as liquid metal embrittlement (LME), which is also referred to as liquid metal induced embrittlement. In LME, certain ductile metals experience drastic loss in tensile ductility or undergo brittle fracture when in the presence of certain liquid metals. LME is a form of cracking which results when certain molten metals come into contact with specific alloys. It is important to avoid the embrittlement of the well casing during deployment of the liquid alloy. It is an object of the present invention to provide a well sealing material, such as an alloy, which has improved LME characteristics compared with prior art alloys used to plug abandoned wells.

Due to the environmental problems associated with leaking wells, solutions for permanently sealing wells for a minimum life of 3000 years are sought. Current metallic plug seals are designed to function effectively at operating temperatures of around 70 to 160° C. and at pressures in excess of 34 MPa. As a result of the extreme operating conditions and the length of time the plugs are in place, the issue of metal creep needs to be considered. Creep is the tendency of solid materials to move or deform permanently under the influence of mechanical stresses. Creep can occur as a result of long-term levels of stress, even where the stress levels are below the yield strength of the material. Creep is increased near the melting point of materials so the temperature of the environment in which the alloy is used will affect the choice of alloy.

It is therefore another object of the present invention to provide a well sealing material, such as an alloy, which obviates or mitigates the problem of creep outlined above. It is also an object of the present invention to provide a well sealing material, such as an alloy, which can provide a seal under the conditions within a well and which can last for a minimum lifetime of 3000 years.

The temperatures of abandoned oil wells can vary depending on a range of factors and it is therefore desirable to provide a well sealing material for use to form a plug which maintains its desirable properties at the temperature of the well.

Known alloys which are used to seal abandoned oil wells comprise alloys of bismuth and tin, or alloys of bismuth and zinc. The alloys of bismuth and tin are used in low temperature wells, which are wells which require plugs which can operate at temperatures up to around 80° C., and the alloys of bismuth and zinc are used in high temperature wells, which are wells which require plugs which can operate at temperatures up to around 150° C. If the temperature of a well is higher than around 40° C., the alloys of the prior art would be susceptible to creep and this would make them unsuitable for sealing the well. At even higher temperatures, the coefficients of expansion of the casing of the wells and the alloy used to form a plug need to be considered more closely. In addition, the melting point of the alloy needs to be high enough for the alloy to be able to form a stable plug at temperatures up to around 150° C., but it needs to be low enough so that it can be melted using the limited energy available for melting. Since the plugs are formed at locations remote from sources of power and in relatively confined spaces, the alloys are generally melted in situ using the heat generated by exothermic reactions or resistive heating. The amount of chemicals used in the exothermic reactions is limited by the space in which the plug is to be formed and this consequently limits the amount of energy available for melting the alloy. Equally the amount of energy available for melting the alloy via resistive heating is limited by the electric current that can be supplied downhole from conventional power generators.

Known bismuth-tin alloys are eutectic and have one definite melting temperature. When the plug is formed, if there are any gaps, the molten alloy will move away from the desired location before it can cool and solidify. The molten alloy could then solidify in an undesirable location and block further access to the plug. It is thus a further object of the present invention to provide a well sealing material, such as an alloy, which has an increased solidification rate when compared to conventional alloys.

Further disadvantages of the bismuth-tin alloys of the prior art is that the tin can leach out of the alloy and this can weaken the plug and allow gas to percolate through the plug. In addition, on cooling, the alloys of the prior art can crack which will weaken the plug and increase the likelihood of the plug failing at some point during its 3000 year life.

Whilst the alloys are presently used to form plugs to seal abandoned oil wells, it has been found that these alloys are susceptible to creep and it would not be possible to guarantee that they would have an effective working life of at least 3000 years. It is therefore an object of the present invention to provide a well sealing material, such as an alloy, which is capable of performing satisfactorily at temperatures around those typically found in wells and/or which demonstrate improved creep characteristics.

It has surprisingly been found that an alloy comprising bismuth, tin, and antimony has the necessary physical characteristics for use in sealing abandoned wells.

According to a first aspect of the present invention, there is provided an alloy of bismuth, tin, and antimony comprising at least about 50% by weight bismuth, about 30 to about 35% by weight tin, and about 1.8 to about 2.8% by weight antimony.

The alloy may comprise at least about 60% by weight bismuth.

The alloy may comprise about 65% by weight bismuth.

The alloy may comprise about 31 to about 33% by weight tin.

The alloy may comprise about 32% by weight tin.

The alloy may comprise about 2.0 to about 2.6% by weight antimony.

The alloy may comprise about 2.1 to about 2.4% by weight antimony.

The alloy may comprise about 2.28% by weight antimony.

Preferably, the amount of bismuth is varied such that the total amount of bismuth, tin, and antimony totals around 100% by weight of the alloy.

According to a second aspect of the present invention, there is provided a plug comprising an alloy of bismuth, tin, and antimony in accordance with the first aspect of the present invention. The plug may be used to seal a well. As such, there is provided the use of a bismuth alloy to seal a well, wherein the alloy comprises bismuth, tin, and antimony. The alloy may comprise an alloy according to the first aspect of the present invention.

According to a third aspect of the present invention, there is provided a method for producing a plug comprising an alloy of bismuth, tin, and antimony, wherein a length of a well is filled with the molten alloy and the molten alloy is allowed to solidify. In particular, the method may comprise introducing an alloy of bismuth, tin, and antimony into a well, wherein the alloy comprises an alloy according to the first aspect of the present invention. The alloy may comprise at least about 50% by weight bismuth, about 30 to about 35% by weight tin, and about 1.8 to about 2.8% by weight antimony.

The alloy according to the first aspect of the present invention exhibits improved creep and LME characteristics when compared with the known materials used for sealing abandoned oil wells. Due to its improved physical characteristics over conventional materials used to form plugs, it is possible to use the alloy of the present invention and the plugs made therefrom at a greater depth where the pressures are higher. If used at the same depth as a plug made from known alloys, the plug made from the alloy of the present invention will last longer and perform better. It is advantageous to plug wells at greater depths, so a plug which can operate at higher pressures is desirable.

It has also surprisingly been found that an alloy comprising bismuth and silver has the necessary physical characteristics for use in sealing abandoned wells.

According to a fourth aspect of the present invention, there is provided an alloy of bismuth and silver comprising about 91 to about 97% by weight bismuth and about 3 to about 9% by weight silver.

The alloy of silver and bismuth may comprise about 5.7 to about 7.5% by weight silver.

The alloy of silver and bismuth may comprise about 5.9 to about 6.5% by weight silver.

The alloy of silver and bismuth may comprise about 6.2% by weight silver.

Preferably, the amount of bismuth is varied such that the total amount of bismuth and silver totals around 100% by weight of the alloy.

According to a fifth aspect of the present invention, there is provided a plug comprising an alloy of bismuth and silver. The plug may be used to seal a well. As such, there is provided the use of a bismuth alloy to seal a well, wherein the alloy comprises bismuth and silver. The alloy may comprise an alloy according to the fourth aspect of the present invention.

According to a sixth aspect of the present invention, there is provided a method of forming a plug in a well comprising an alloy of bismuth and silver, wherein a length of the well is filled with the molten alloy and then allowed to solidify.

The alloy according to the fourth aspect of the present invention exhibits improved creep and LME characteristics when compared with the known materials used for sealing abandoned oil wells. The bismuth-silver alloy of the fourth aspect of the present invention is able to perform satisfactorily at increased temperatures where the alloys of the prior art would melt and would therefore be unsuitable.

In all of the aforementioned aspects and embodiments, the impurity content is preferably as close to zero as practically achievable, but it will be appreciated that there may be one or more additional metals as incidental impurities in the alloy at low, functionally insignificant concentrations. The impurities may be one or more of lead, gold, chromium, copper, vanadium, silver, aluminium, arsenic, cadmium, iron, tellurium, selenium, and zinc. It will also be appreciated that other impurities may be present and that these may be metallic, semi-metallic, or non-metallic in nature.

Although the description refers to the sealing of abandoned oil or petrochemical wells, it will be appreciated that the materials and methods according to the present inventions described herein are not limited to abandoned oil or petrochemical wells and may be used to create seals in other structures which may require sealing, including but not limited to, vents, aquifers, pipes, and the like.

Bismuth-Tin-Antimony Alloy (Alloy-80)

The alloy composition according to the first aspect of present invention has been optimised to provide enhanced creep resistance, a better blend of mechanical properties, including ultimate tensile stress and yield stress necessary for effective plug sealing performance, corrosion characteristics as well as enhanced liquid metal embrittlement properties compared with known alloys used for sealing wells. Moreover, it will be appreciated by the skilled person that the alloy composition of the first aspect of the present invention is eminently suitable for use as a plug for sealing wells. In particular, the alloy according to the first aspect of the present invention possesses a stable and balanced composition which provides a high degree of creep resistance, corrosion and mechanical characteristics which make it suitable for sealing wells for extended periods of time, and improved liquid metal embrittlement properties.

As mentioned above, presently an alloy of bismuth and tin is used to form plugs in abandoned oil wells. Upon cooling and solidifying, bismuth expands, which is unlike most other materials which shrink on solidification.

The skilled person will appreciate that bismuth is incorporated into the alloy of the first aspect of the present invention is due to its property of expanding upon solidification. This property is utilised when sealing wells as the alloy expands upon solidification and exerts a radial force on the sides of the well. Since most other metals contract upon solidification, it is important to have a high percentage of bismuth in the alloy so that it has the property of expanding upon solidification. Since the other metals in the alloy contract upon solidification, the bismuth needs to be present in an amount which is sufficient to overcome the shrinkage of the other metals present in the alloy so that overall the alloy expands upon solidification.

Tin is included in the alloy of the first aspect of the present invention to increase the ductility of the alloy. The addition of tin to the alloy increases the ductility and the strength of the alloy and also reduces its melting temperature. Thus, the alloy of the first aspect of the present invention is better able to cope with the pressure it is exposed to when used as a plug. The skilled person will appreciate that lower amounts of tin will have a reduced effect on the changes to the ductility, strength, and melting point of the alloy. On the other hand, if too great an amount of tin is incorporated into the alloy, this may alter the ductility, strength, and melting point of the alloy, such that it no longer has the desired properties for use in the production of a plug for an oil well.

Furthermore, adding more tin at the expense of bismuth reduces the propensity for the alloy to expand upon solidification, which is undesirable for the reasons discussed above. It is preferred that the alloy comprises about 30 to about 35% by weight tin, preferably about 31 to about 33% by weight tin. Most preferably, the tin content of the alloy of the first aspect of the present invention is about 32% by weight. The aforementioned ranges for the tin content of the alloy are important in ensuring the correct balance of the characteristics described above, in particular the ductility, strength, and melting point of the alloy.

Antimony is added to the alloy of the first aspect of the present invention in order to improve the creep resistance. It will be appreciated that since the alloy is intended to be used to form plugs which are required to last for extended periods of time and since during that time the plug will be under pressure from the walls of the well or any pressure differences which exist between the top and bottom of the plug, it is important that the alloy is resistant to creep. In addition, it has been found that the addition of antimony increases the solidification rate of the alloy and therefore, if there is any space between the mandrel in which the alloy is held whilst the plug is being formed and the well casing, the increased solidification rate will mean that less of the alloy is lost. It is preferred that the alloy comprises about 1.8 to about 2.8% by weight antimony, preferably about 2.0 to about 2.6% by weight antimony, more preferably about 2.1 to about 2.4% by weight antimony. Most preferably, the antimony content of the alloy of the first aspect of the present invention is about 2.28% by weight antimony. The aforementioned amounts for the antimony content of the alloy are important in ensuring the creep resistance of the alloy. It has also surprisingly been found that the aforementioned amounts for the antimony content of the alloy are also important in improving the liquid metal embrittlement properties of the alloy, which will be described in more detail below. Furthermore, the addition of antimony in the amounts of the first aspect of the present invention prevents the selective leaching of tin from the alloy. Leaching of tin from the alloy would increase the concentration of bismuth, which would make the alloy more brittle. With increasing bismuth content, the alloy becomes more enriched in bismuth phase making its overall mechanical properties tend towards that of pure bismuth. With decreasing tin content, the increased ductility conferred on the alloy diminishes with similar consequences. In addition, the antimony content of the alloy at these levels increases the corrosion resistance of the alloy.

It is preferred that the alloy of the first aspect of the present invention expands upon solidification. Preferably, the alloy expands by about 0.5% to about 1.0%, more preferably about 0.6% to about 0.9%, and most preferably by about 0.7% upon solidification, all measured by volume.

With regards to the hardness of the alloy of the first aspect of the present invention, it is preferred that the Vickers hardness, measured at room temperature in accordance with the ASTM-E384-11 standard using a 5 kg load cell and a test dwell time of 10 seconds, is from about 21 to about 27 $H_v$.

With regards to the tensile strength of the alloy of the first aspect of the present invention, it is preferred that the ultimate tensile strength, measured at room temperature in accordance with the ASTM E8/E8M standard at a constant strain rate of $10^4$ $s^{-1}$, is from about 40 to about 70 MPa. Under the same conditions, the yield strength is preferably from about 30 to about 45 MPa.

With regards to the operating temperature of the alloy of the first aspect of the present invention, it is preferred that the alloy is stable and does not creep at temperatures of from about 60 to about 100° C., more preferably at temperatures of from about 70 to about 90° C., and most preferably at temperatures of around 80° C. In this context, the alloy is considered to be stable and not to creep if it is able to seal a well for a minimum of 3000 years.

Bismuth-Silver Alloy (Alloy 150)

The alloy composition according to the fourth aspect of present invention has been optimised to provide enhanced creep resistance, a better blend of mechanical properties, including ultimate tensile stress and yield stress necessary for effective plug sealing performance, corrosion characteristics as well as enhanced liquid metal embrittlement properties compared with known alloys used for sealing wells. Moreover, it will be appreciated by the skilled person that the alloy composition of the fourth aspect of the present invention is eminently suitable for use as a plug for sealing wells. In particular, the alloy according to the fourth aspect of the present invention possesses a stable and balanced composition which provides a high degree of creep resistance, corrosion and mechanical characteristics which make it suitable for sealing wells for extended periods of time, and improved liquid metal embrittlement properties.

As mentioned above, presently an alloy of bismuth and tin is used to form plugs in abandoned oil wells. Upon cooling and solidifying, bismuth expands, which is unlike most other materials which shrink on solidification.

The skilled person will appreciate that bismuth is incorporated into the alloy of the fourth aspect of the present invention is due to its property of expanding upon solidification. This property is utilised when sealing wells as the alloy expands upon solidification and exerts a radial force on the sides of the well. Since most other metals contract upon solidification, it is important to have a high percentage of bismuth in the alloy so that it has the property of expanding upon solidification. Since the other metal in the alloy contract upon solidification, the bismuth needs to be present in an amount which is sufficient to overcome the shrinkage of the other metal present in the alloy so that overall the alloy expands upon solidification.

The addition of silver to the alloy increases the ductility and the strength of the alloy and also reduces its solidus temperature below that of pure bismuth. Increasing the silver content of the alloy widens the range when the alloy is partly solid and partly liquid/molten, and also raises the liquidus temperature of the alloy. Thus, the alloy of the fourth aspect of the present invention is better able to cope with the pressure it is exposed to when used as a plug. The skilled person will appreciate that lower amounts of silver will have a reduced effect on the changes to the ductility, strength, and melting point of the alloy as the chemistry of the resultant alloy approaches that of pure bismuth. On the other hand, if too great an amount of silver is incorporated into the alloy, this may alter the ductility, strength, and melting point of the alloy, such that it no longer has the desired properties for use in the production of a plug for an oil well. Furthermore, adding more silver at the expense of bismuth reduces the propensity for the alloy to expand upon solidification, which is undesirable for the reasons discussed above. It is preferred that the alloy comprises about 3 to about 9% by weight silver, preferably about 5.7 to about 7.5% by weight silver. More preferably, the silver content of the alloy of the fourth aspect of the present invention is about 5.9 to about 6.5% by weight, and most preferably the alloy of the fourth aspect of the present invention comprises about 6.2% silver by weight. The aforementioned ranges for the silver content of the alloy are important in ensuring the correct balance of the characteristics described above, in particular the ductility, strength, and melting point of the alloy.

It is preferred that the alloy of the fourth aspect of the present invention expands upon solidification. Preferably, the alloy expands by about 1.0% to about 3.2%, more preferably about 2.0% to about 3.0%, and most preferably by about 2.82% upon solidification, all measured by volume.

With regards to the hardness of the alloy of the fourth aspect of the present invention, it is preferred that the Vickers hardness, measured at room temperature in accordance with the ASTM-E384-11 standard using a 5 kg load cell and a test dwell time of 10 seconds, is from about 10 to about 20 $H_v$.

With regards to the tensile strength of the alloy of the fourth aspect of the present invention, it is preferred that the ultimate tensile strength, measured at room temperature in accordance with the ASTM E8/E8M standard at a constant strain rate of $10^4$ $s^{-1}$, is from about 35 to about 40 MPa. Under the same conditions, the yield strength is preferably from about 25 to about 30 MPa.

With regards to the operating temperature of the alloy of the fourth aspect of the present invention, it is preferred that the alloy is stable and does not creep at temperatures of from about 100° C. to about 200° C., more preferably at temperatures of from about 125° C. to about 175° C., and most preferably at temperatures of around 150° C. In this context, the alloy is considered to be stable and not to creep if it is able to seal a well for a minimum of 3000 years.

The invention of the first and fourth aspects of the present invention will now be further described with reference to the following non-limiting examples and figures in which.

Figure 12A:
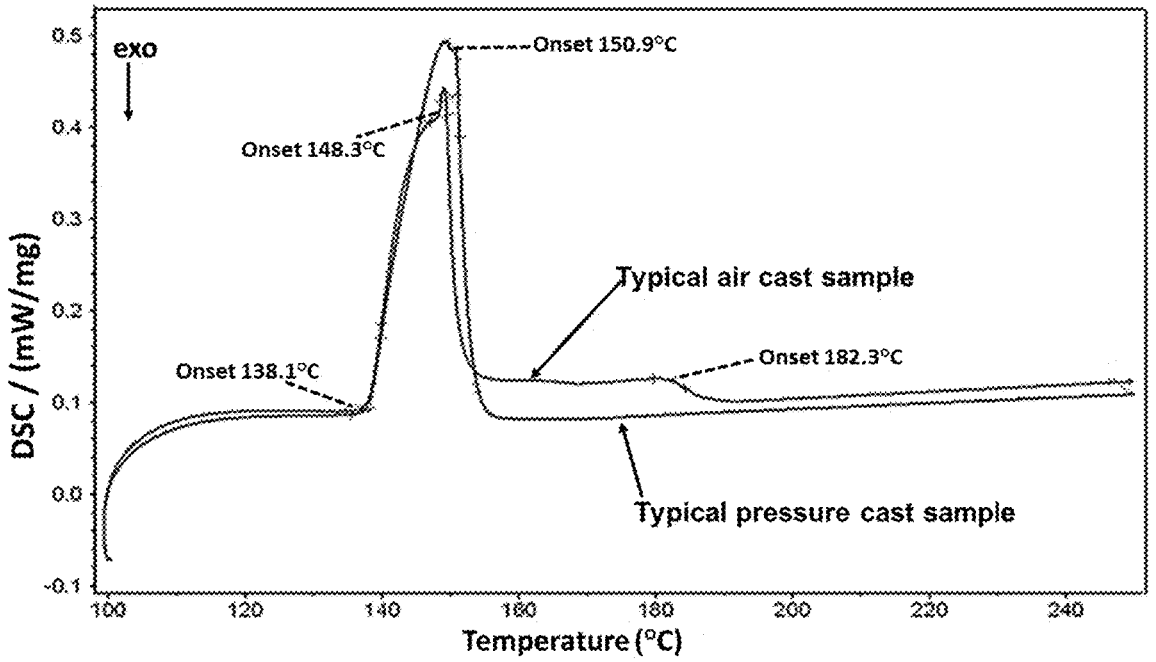
Figure 12B:
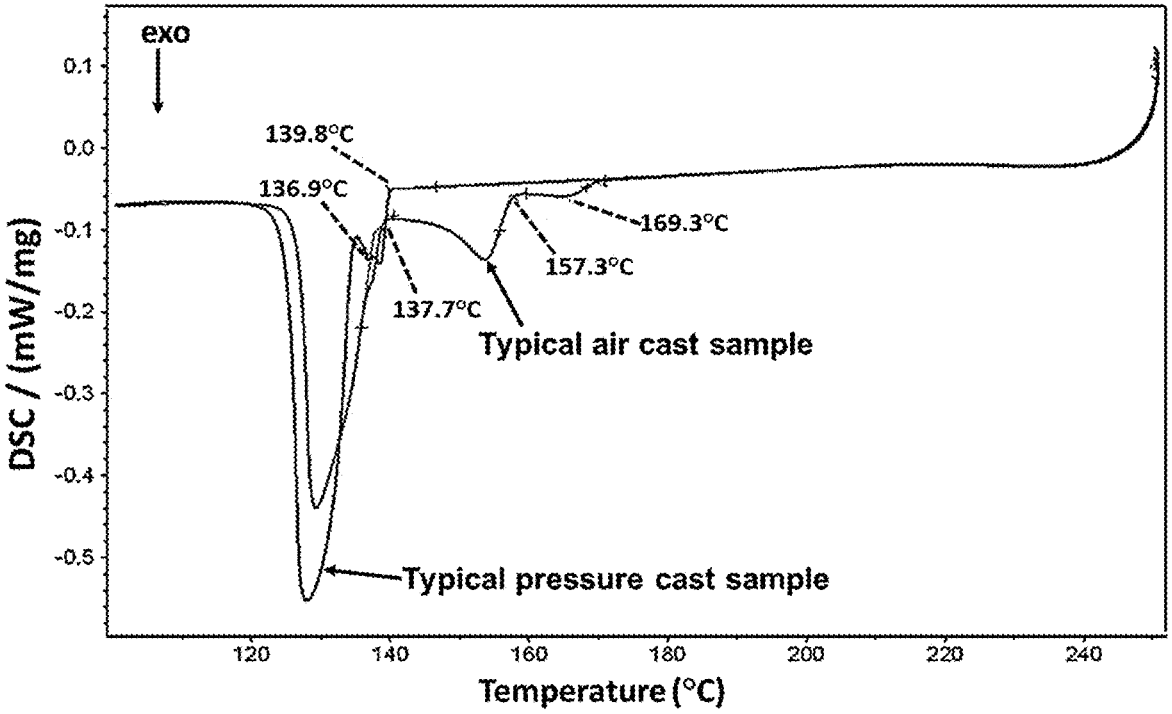
Figure 13A:
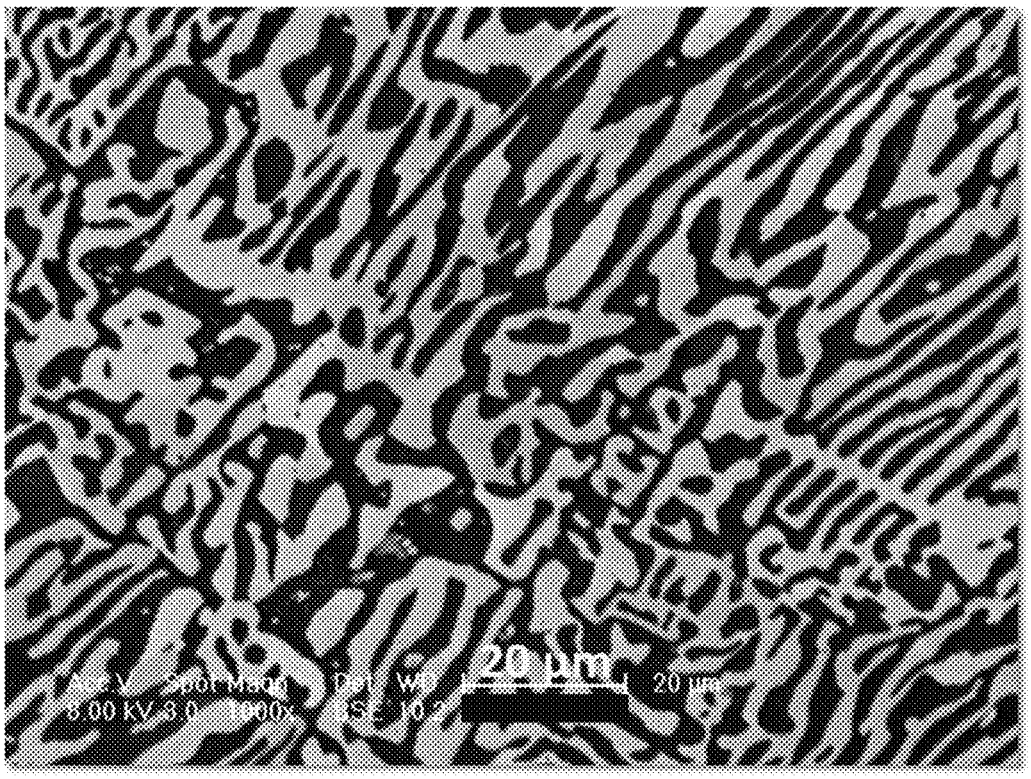
Figure 13B:
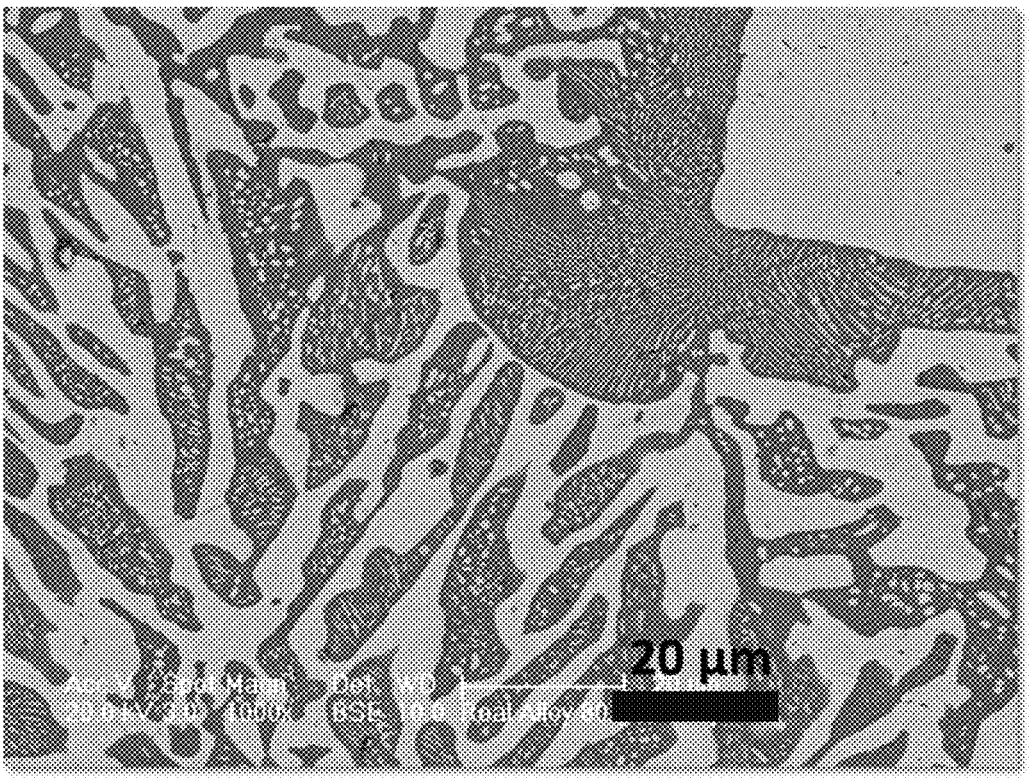
Figure 14A:
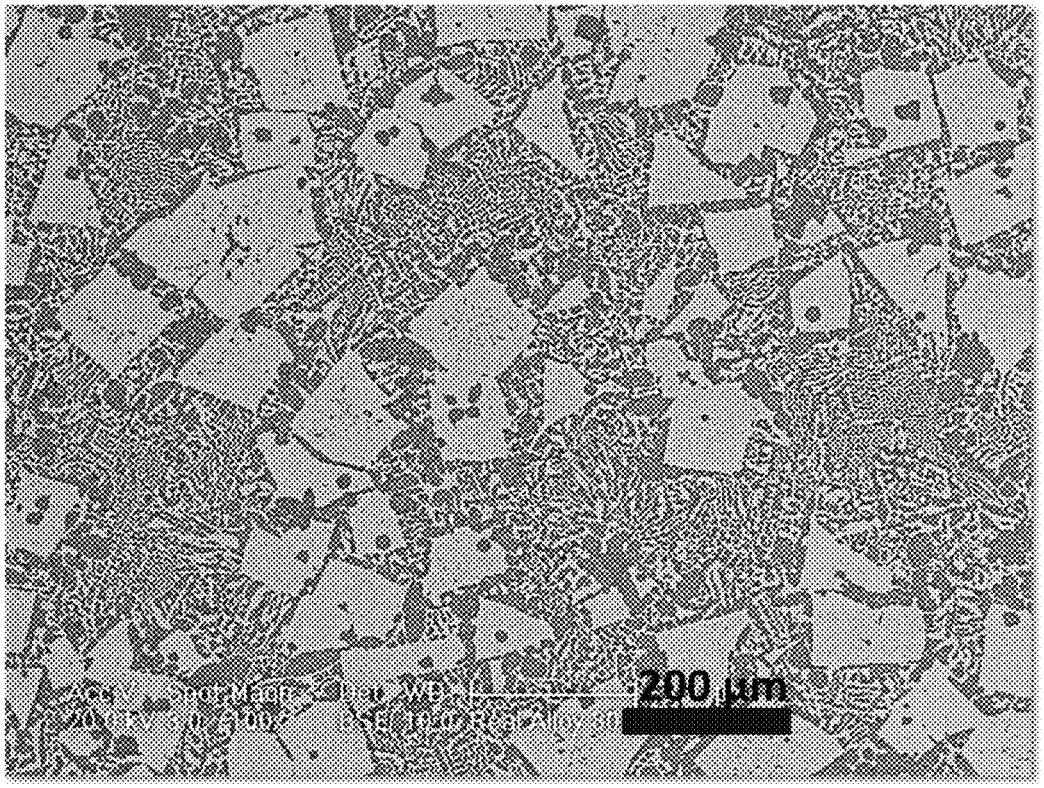
Figure 14B:
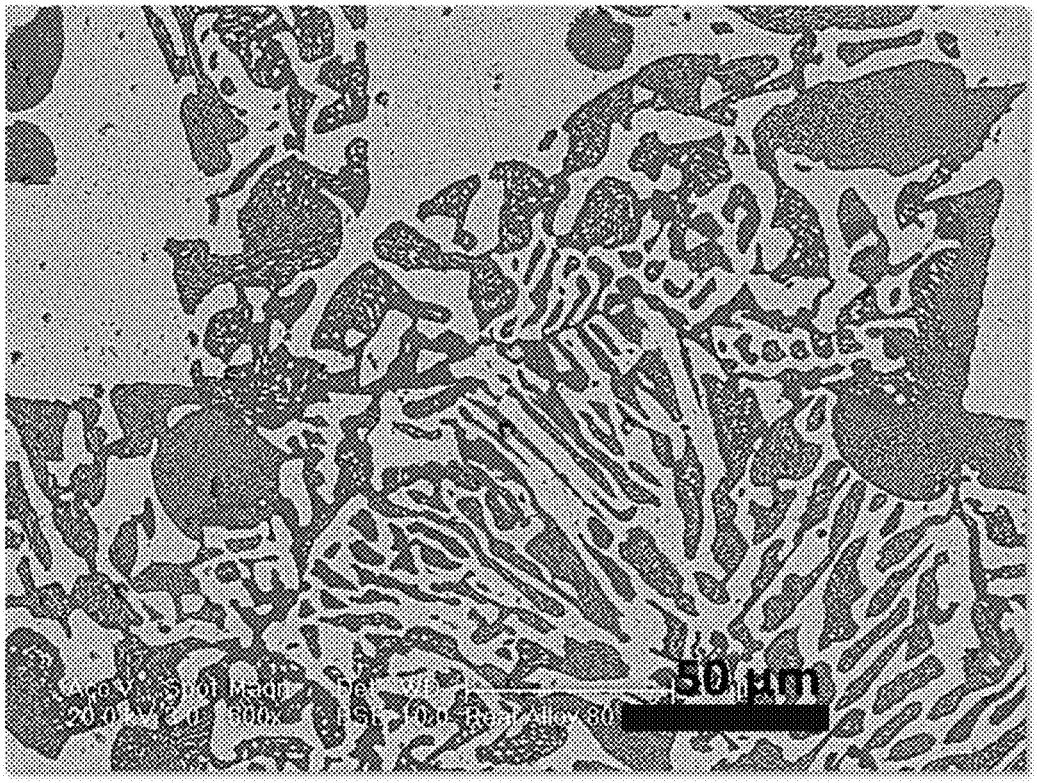
Figure 15A:
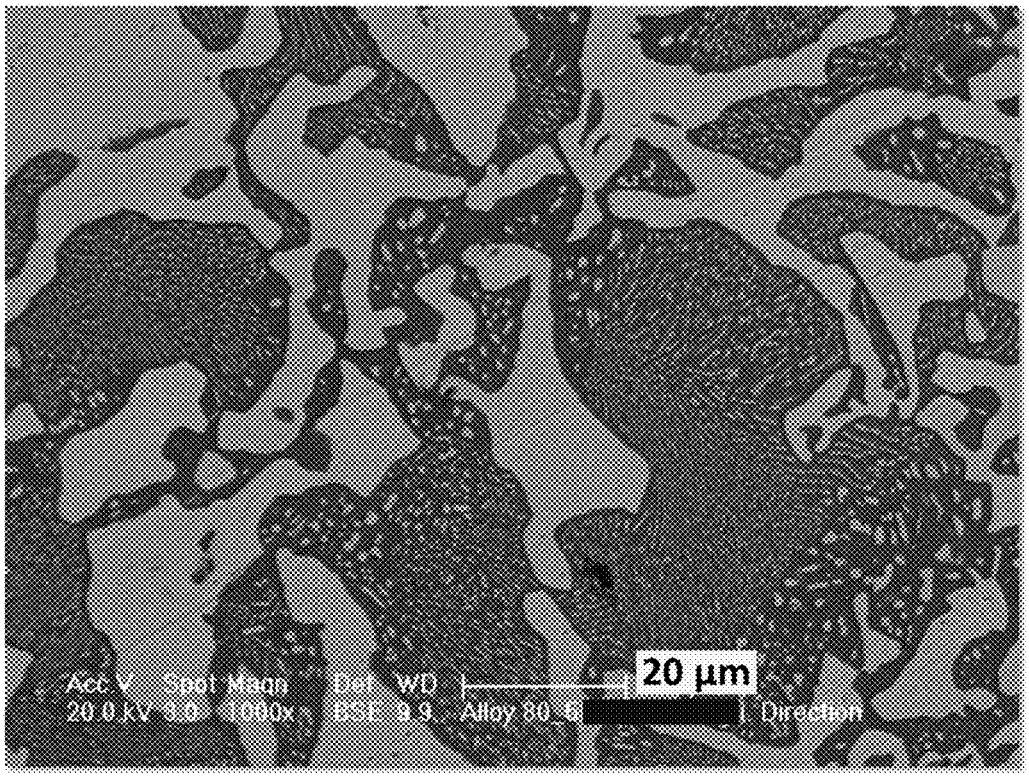
Figure 15B:
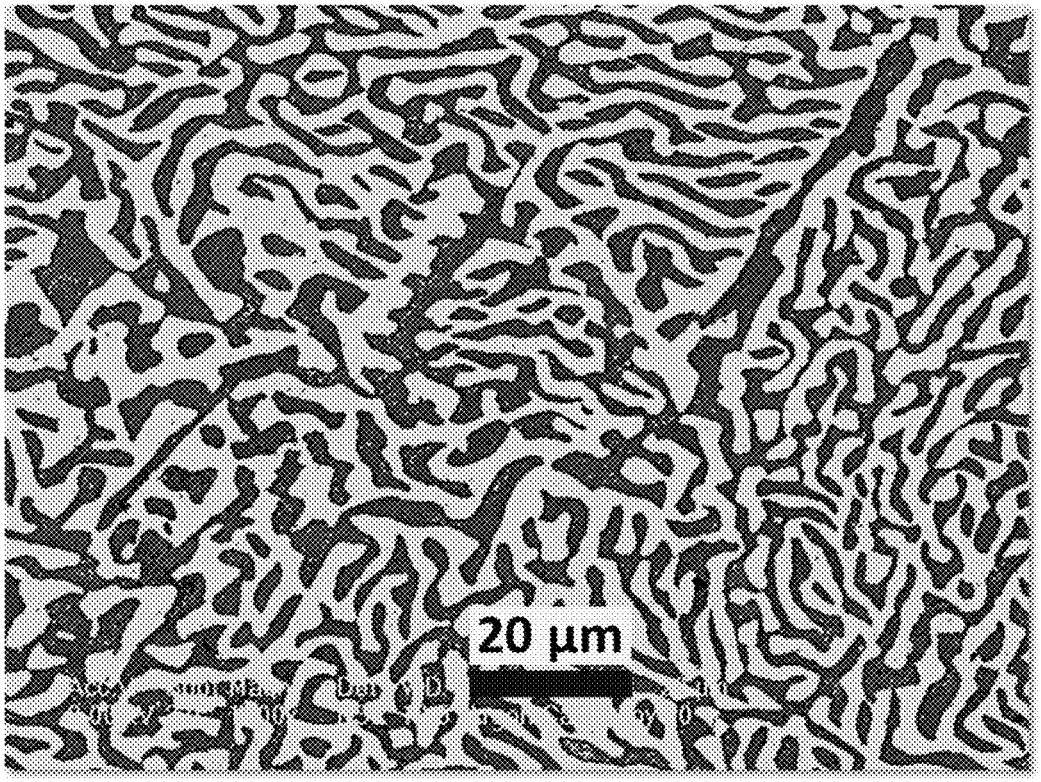
Figure 15C:
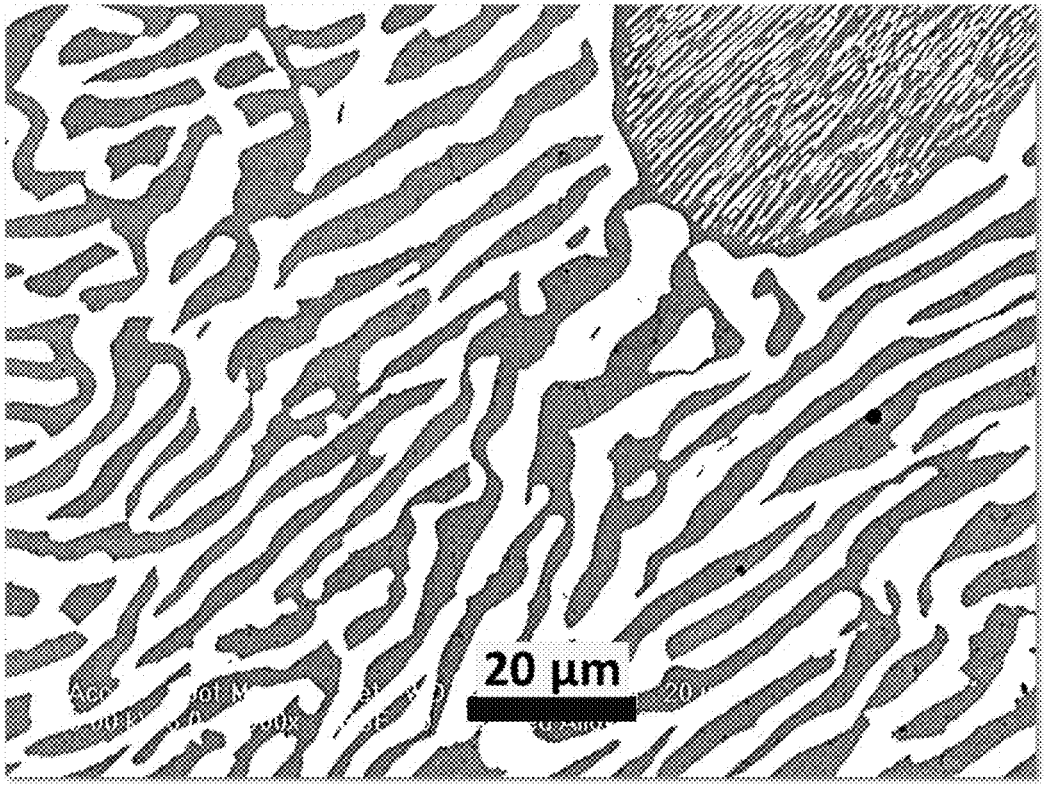
Figure 15D:
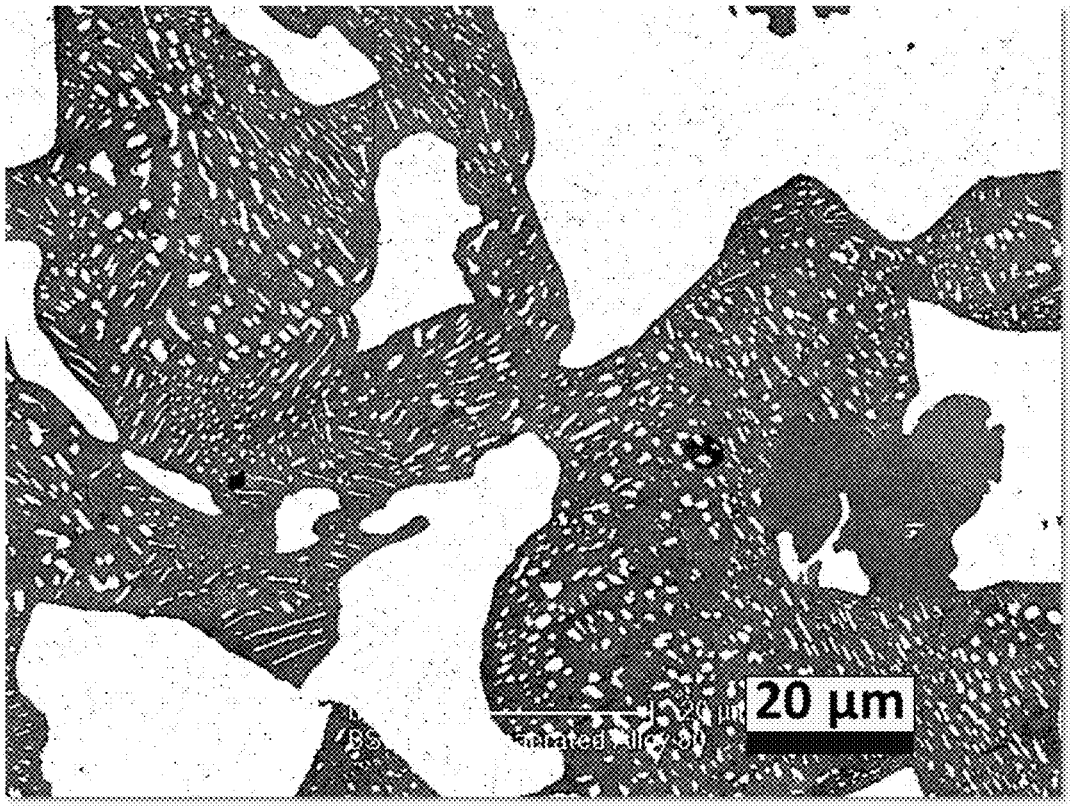
Figure 16:
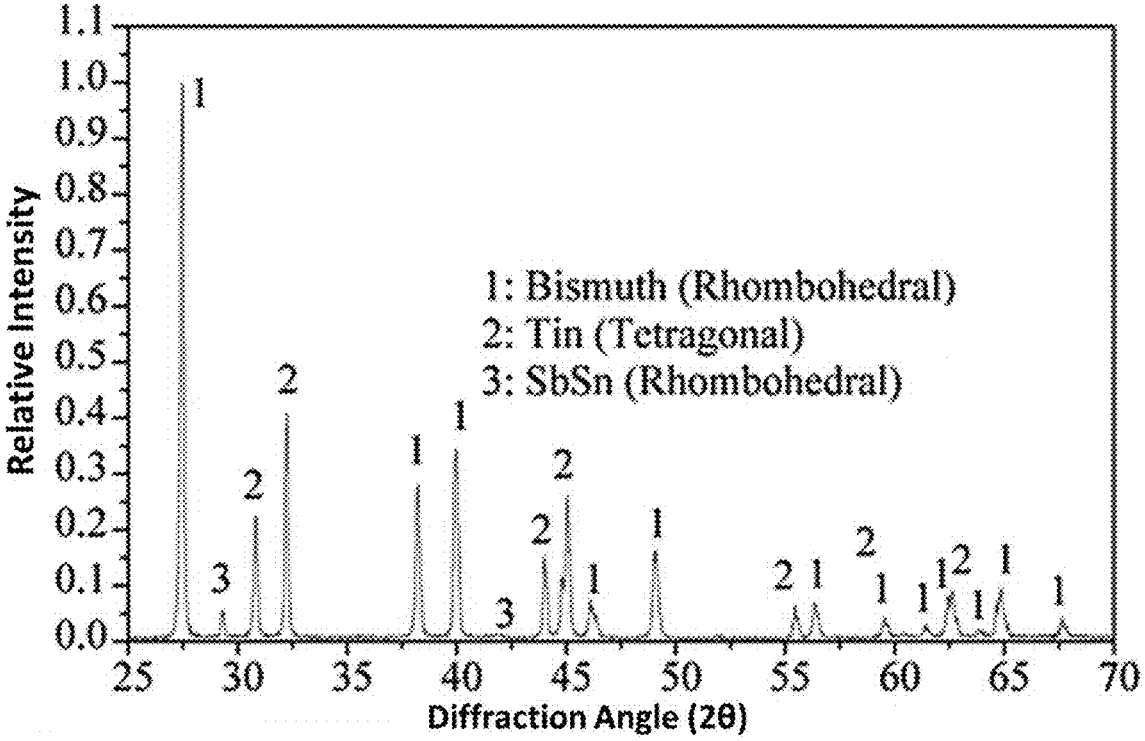
Figure 17:
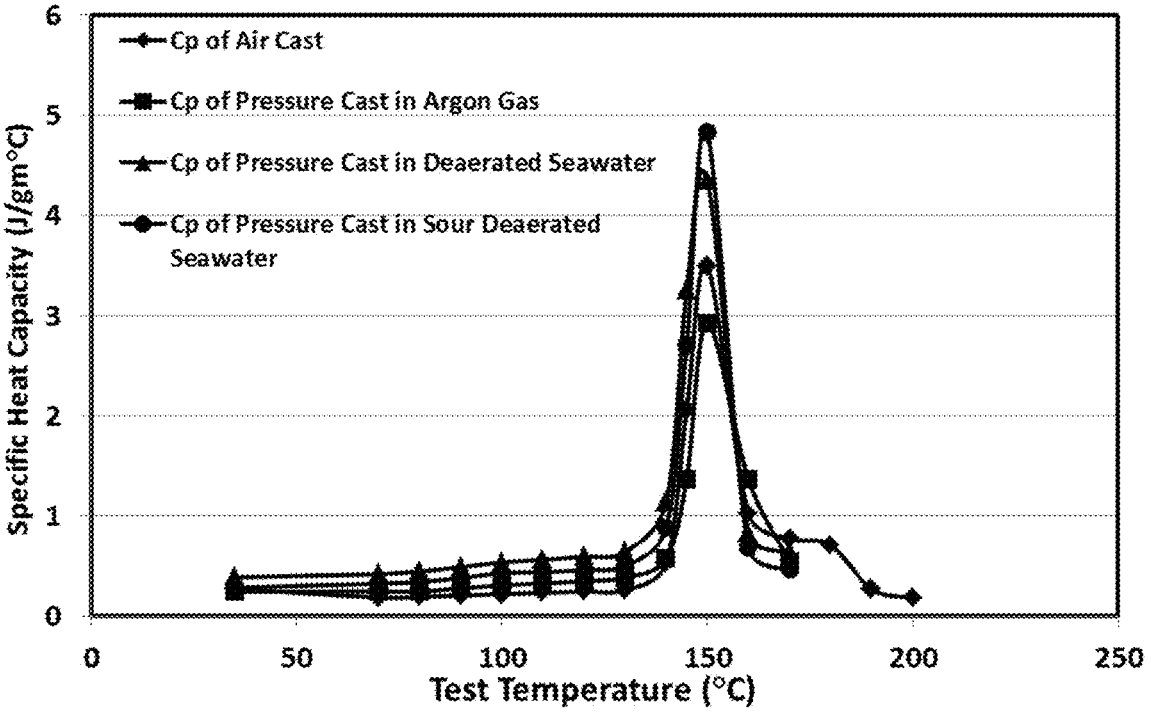
Figure 18:
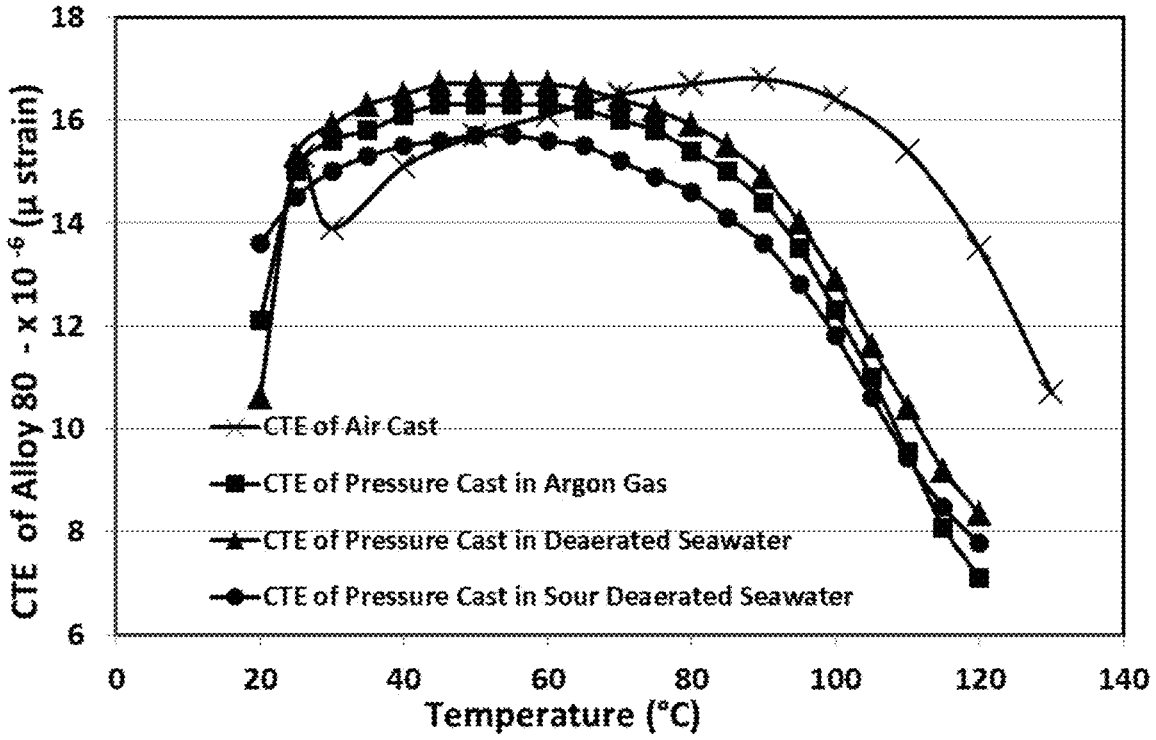
Figure 19:
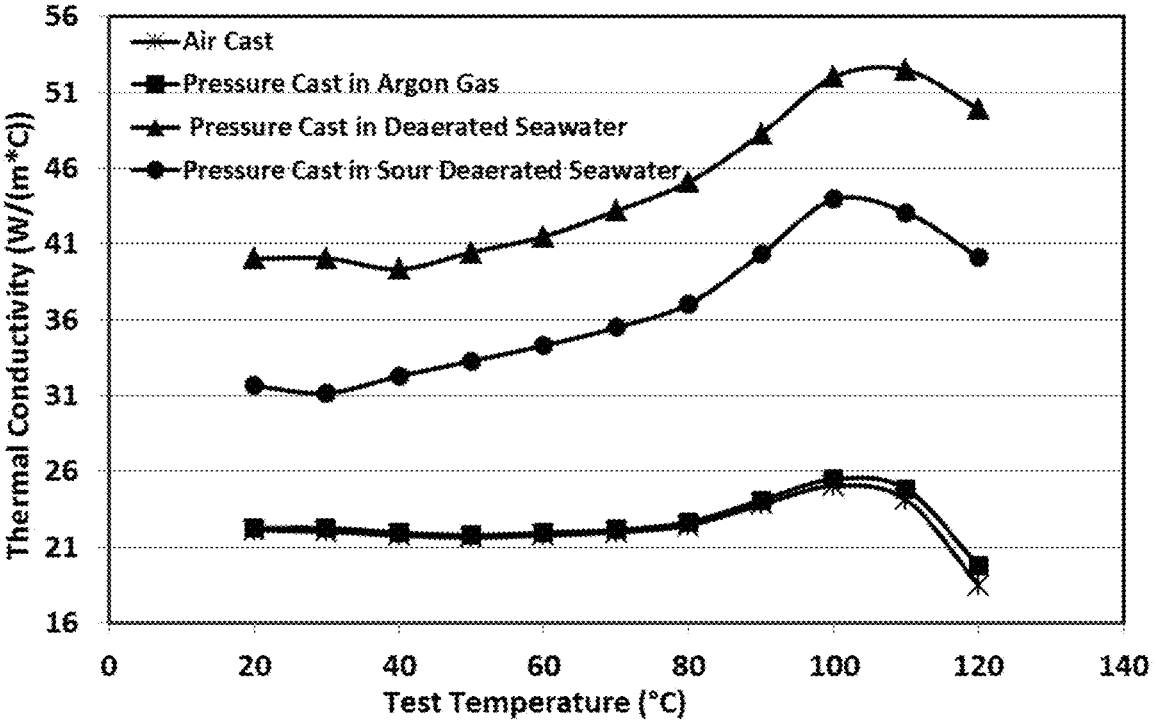
Figure 20:
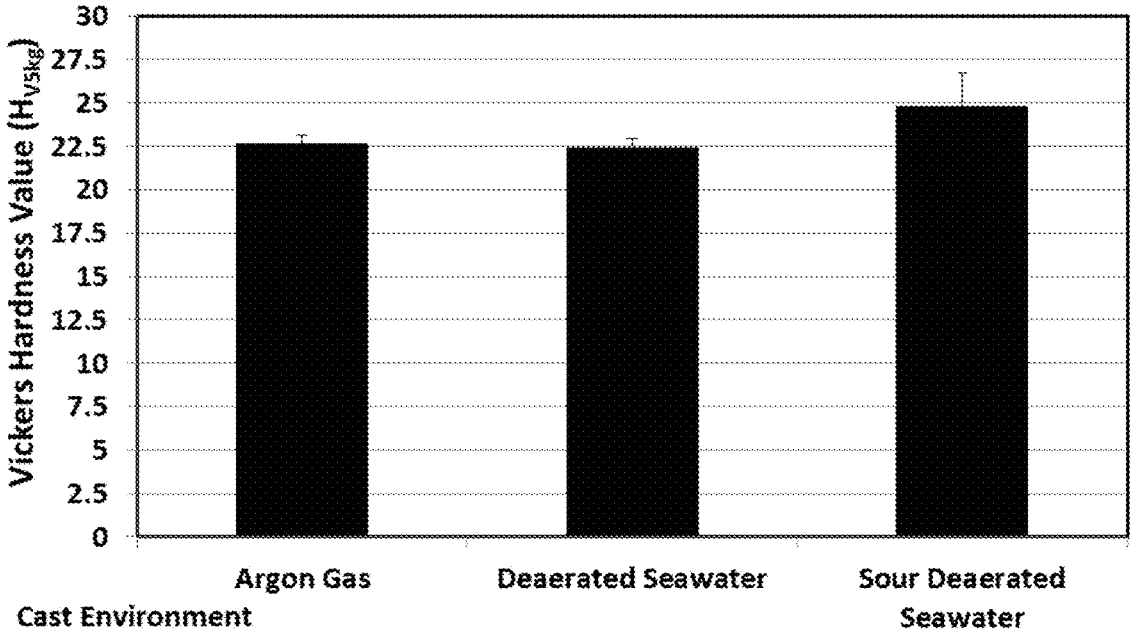
Figure 21:
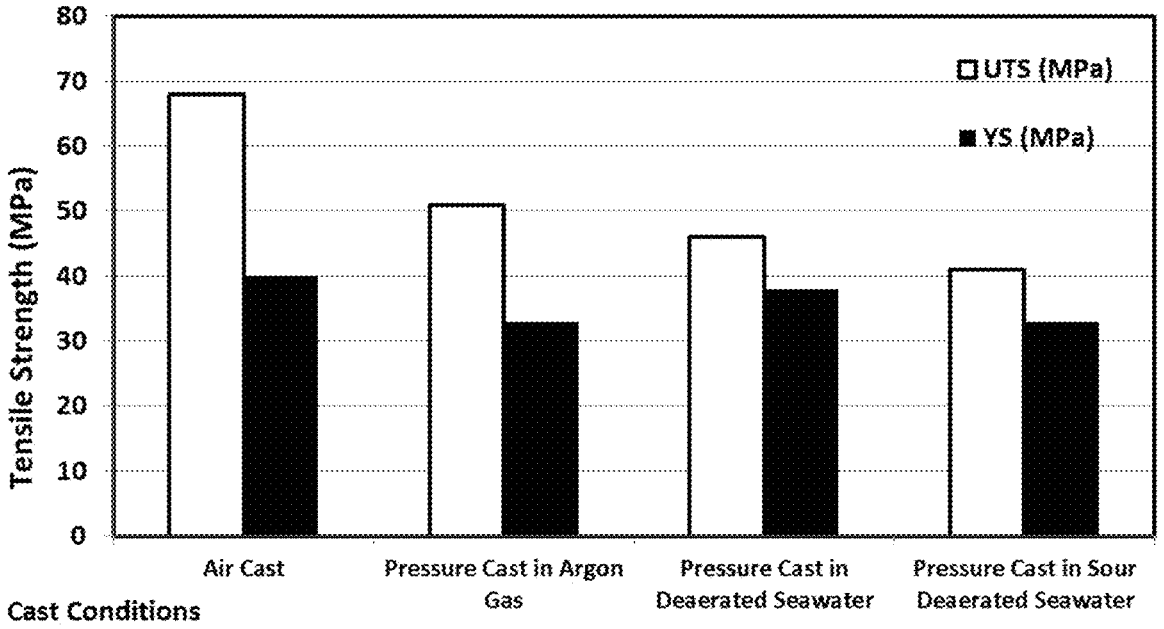
Figure 22A:
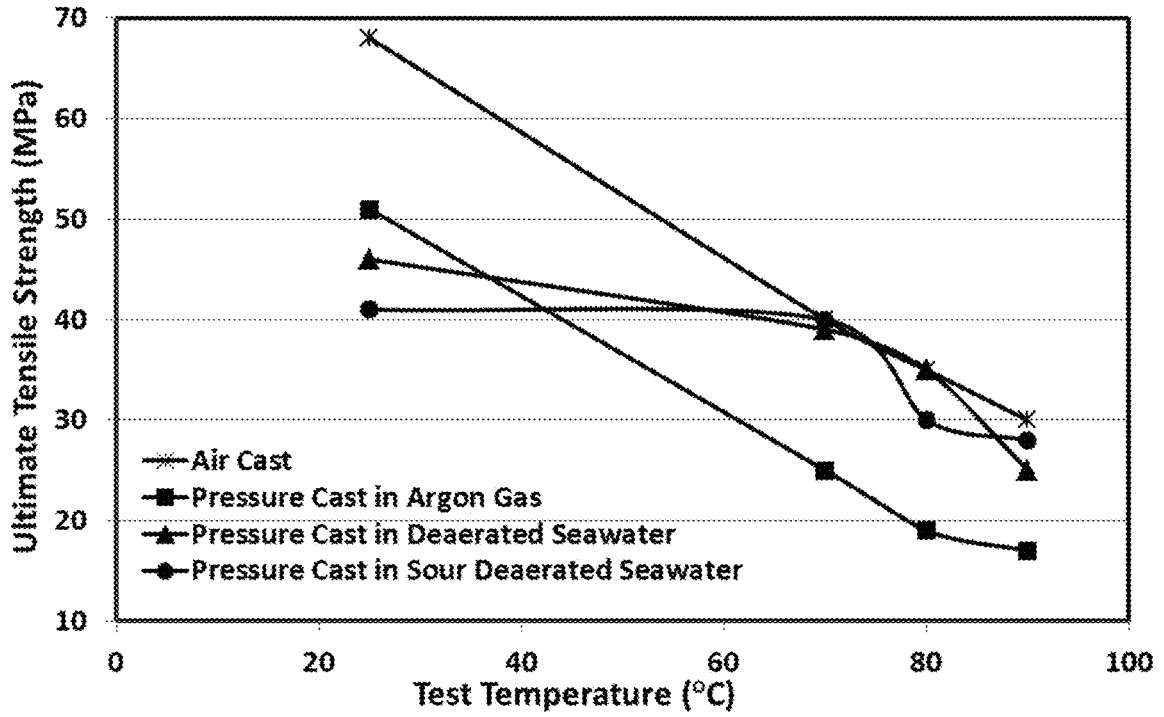
Figure 22B:
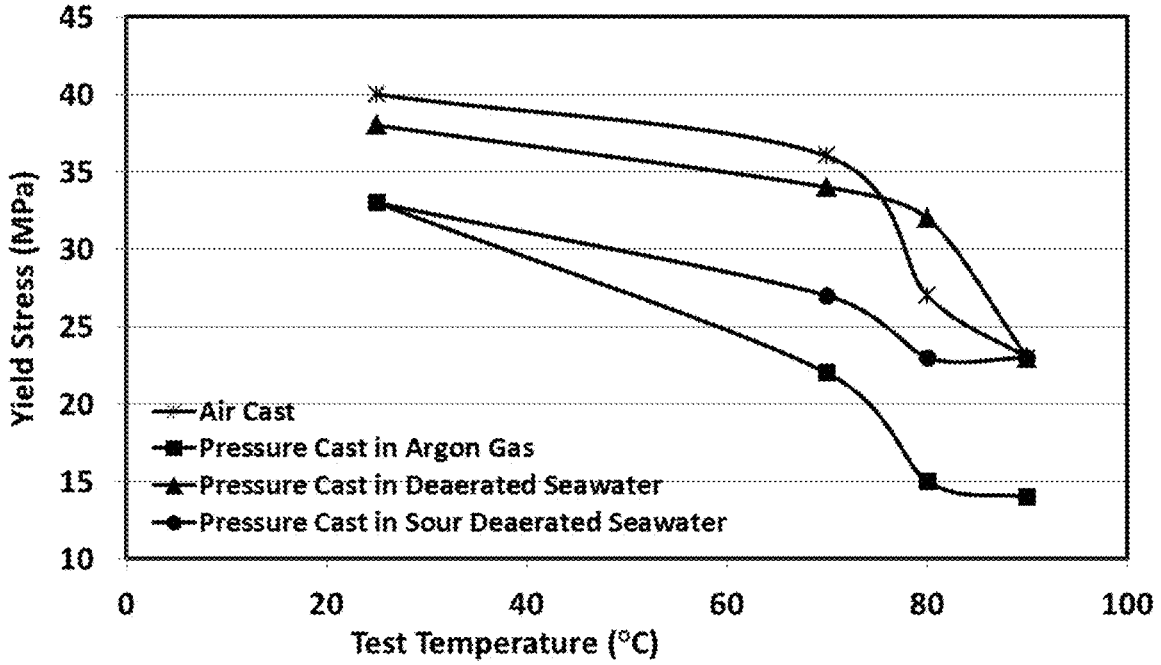
Figure 23:
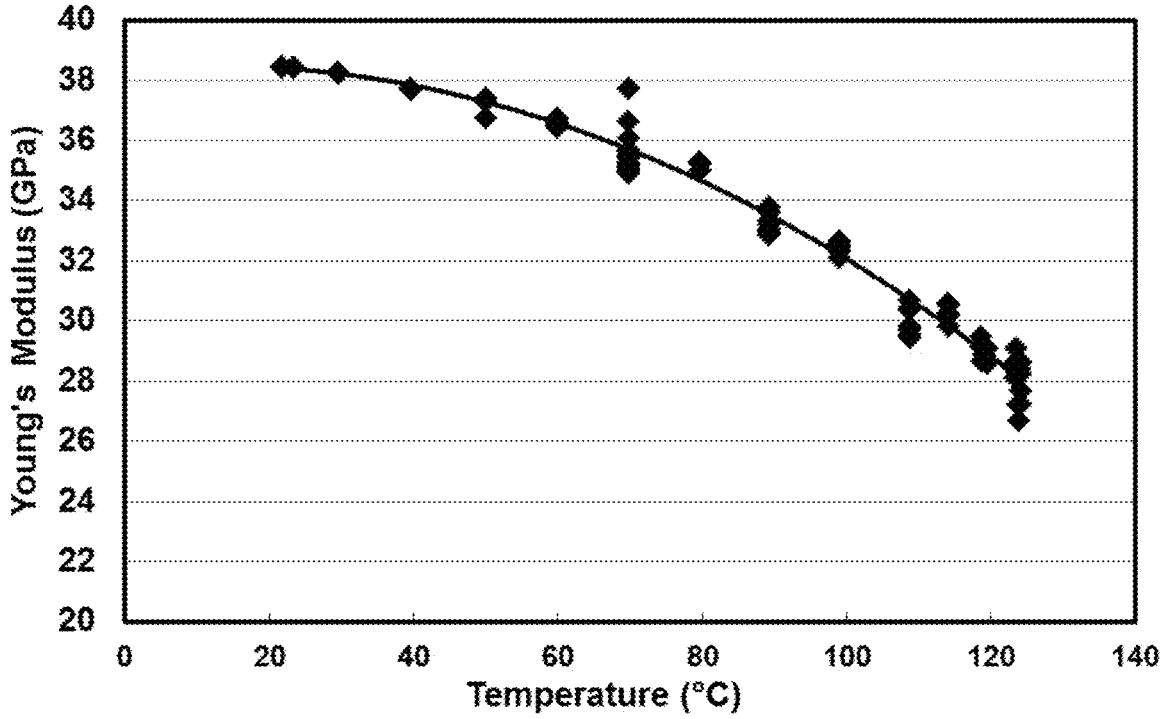
Figure 24A:
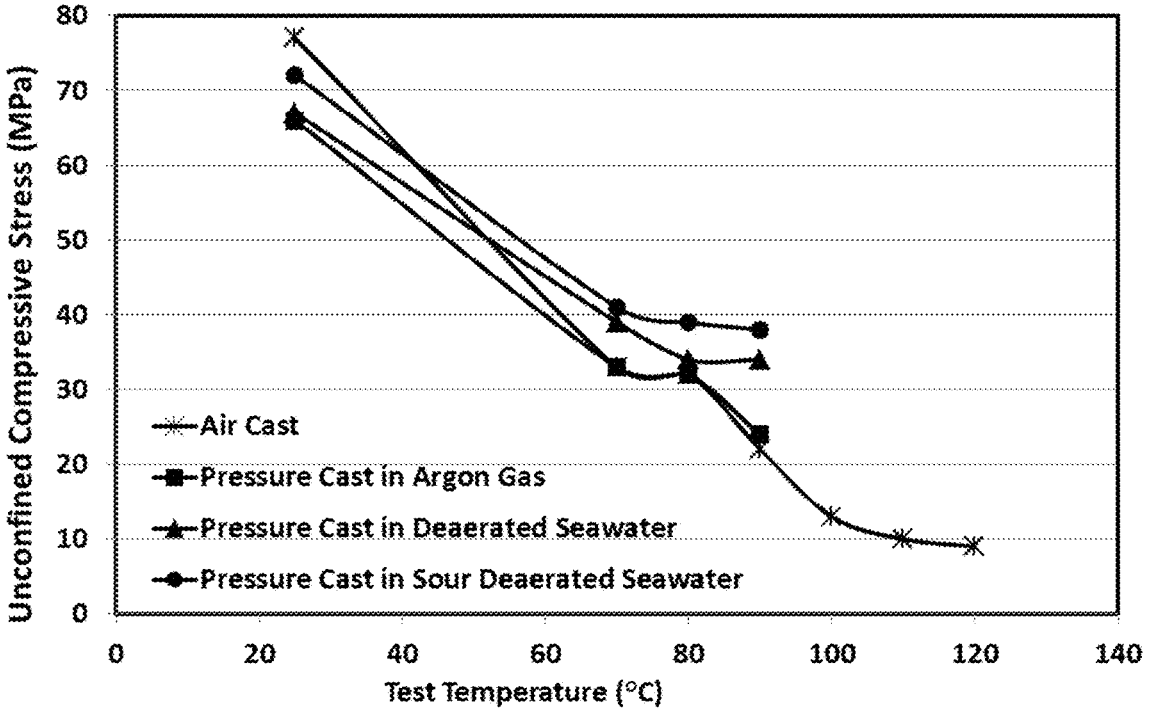
Figure 24B:
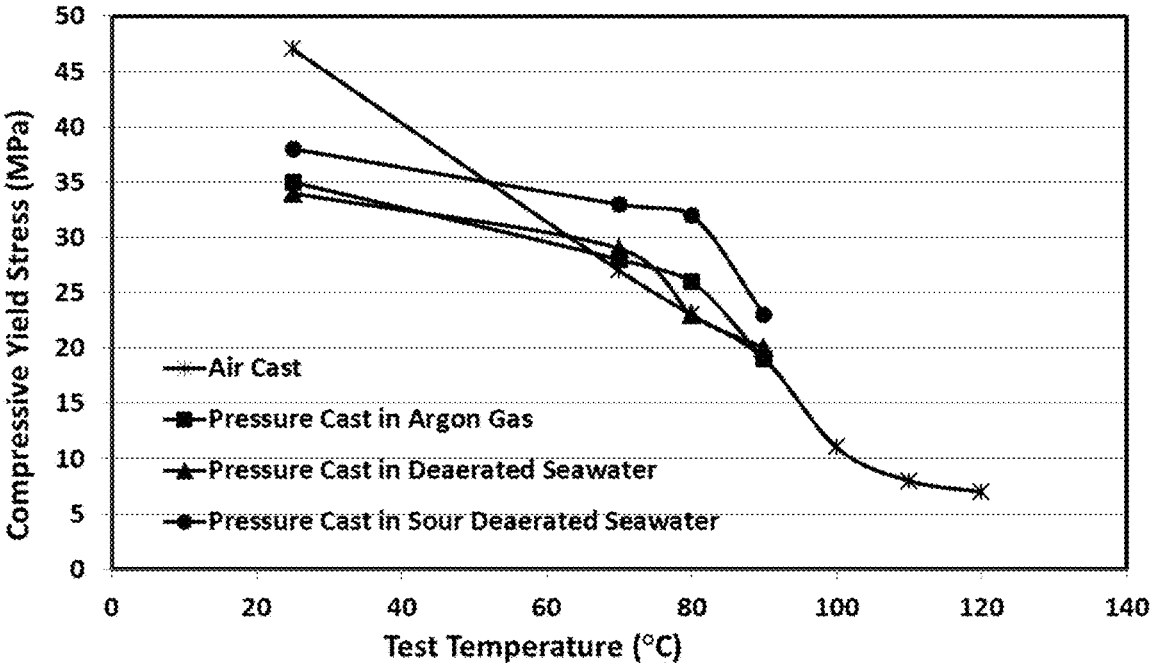
Figure 25:
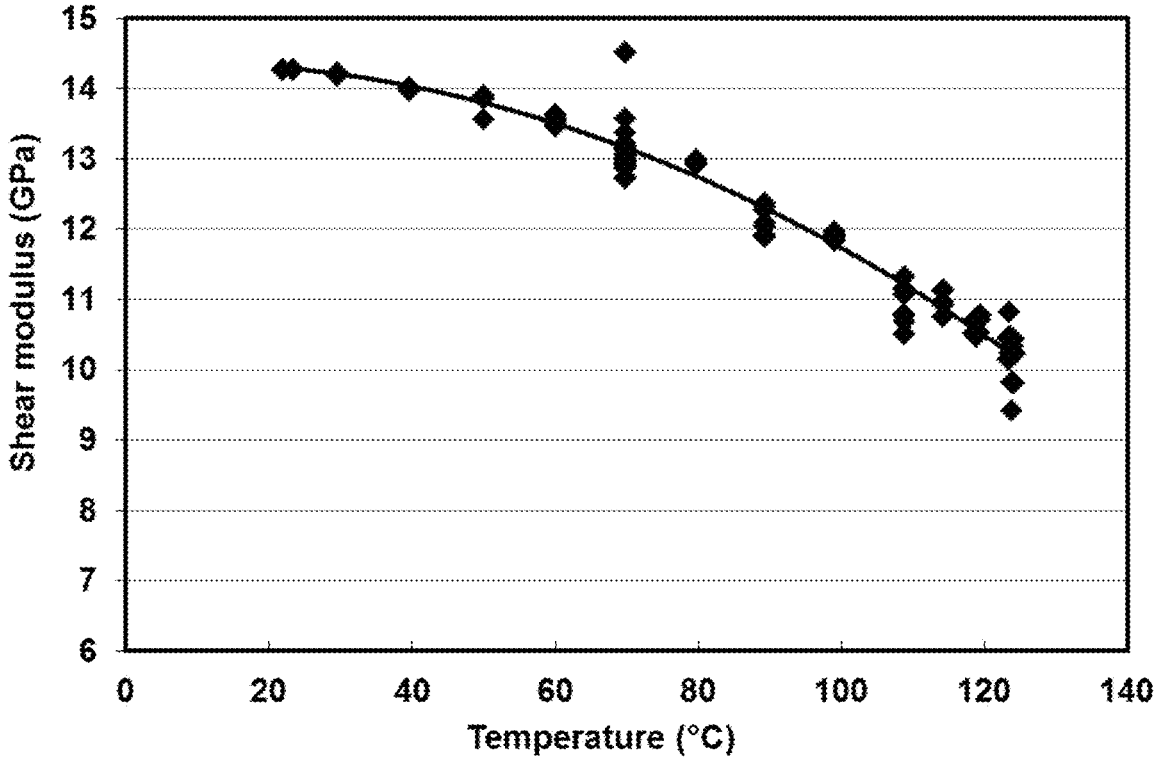
Figure 26A:
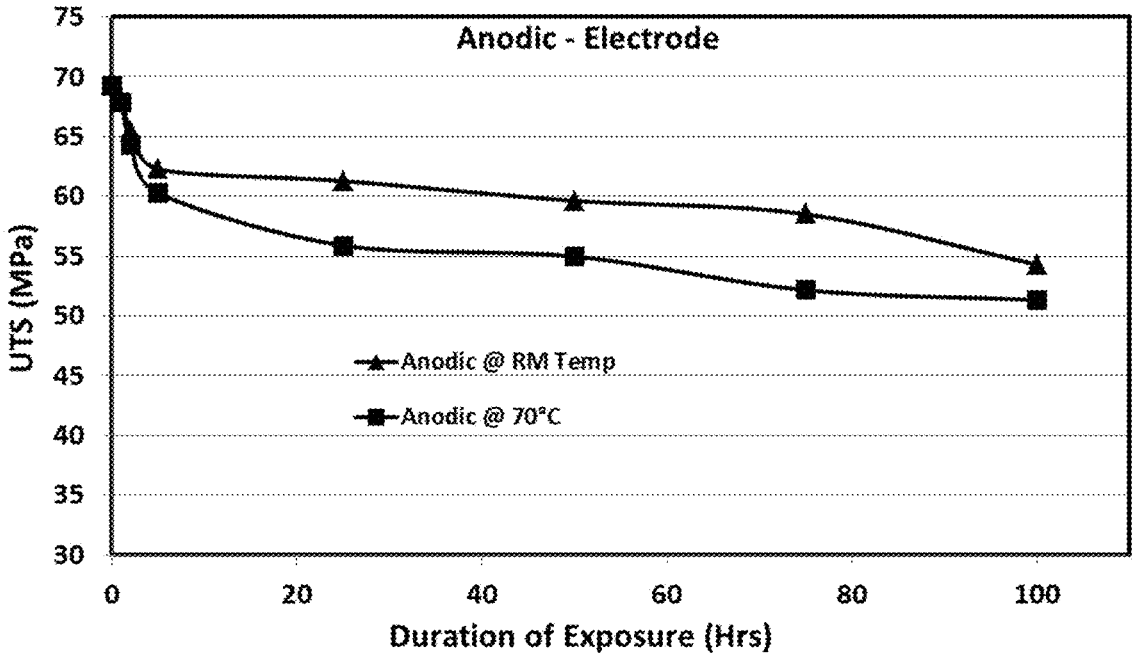
Figure 26B:
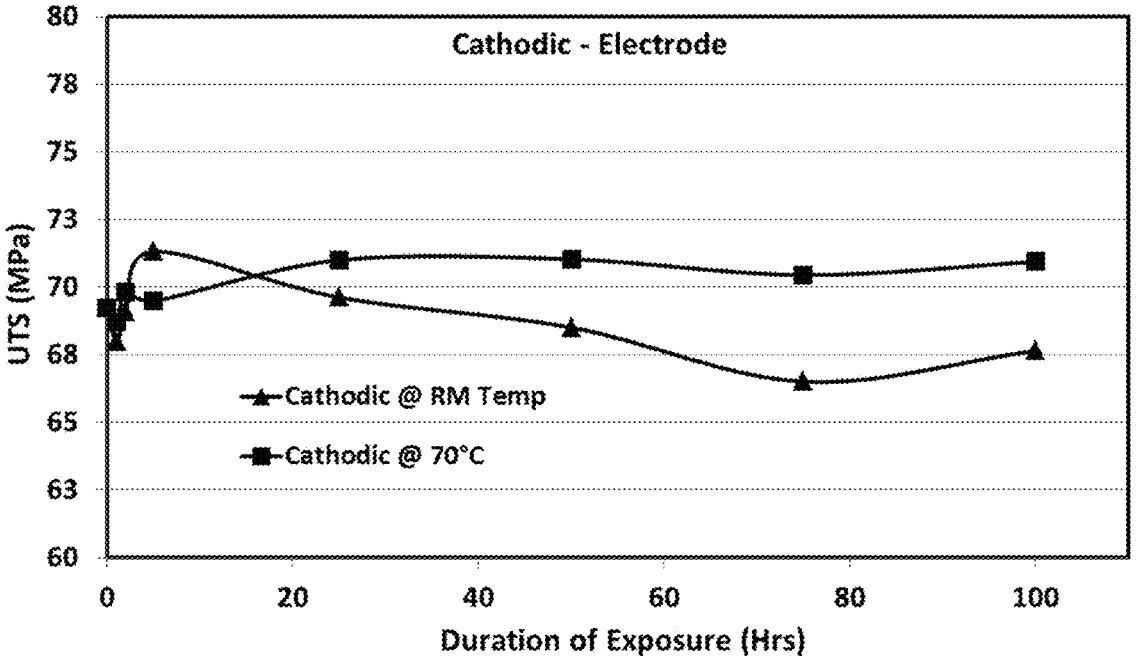
Figure 27:
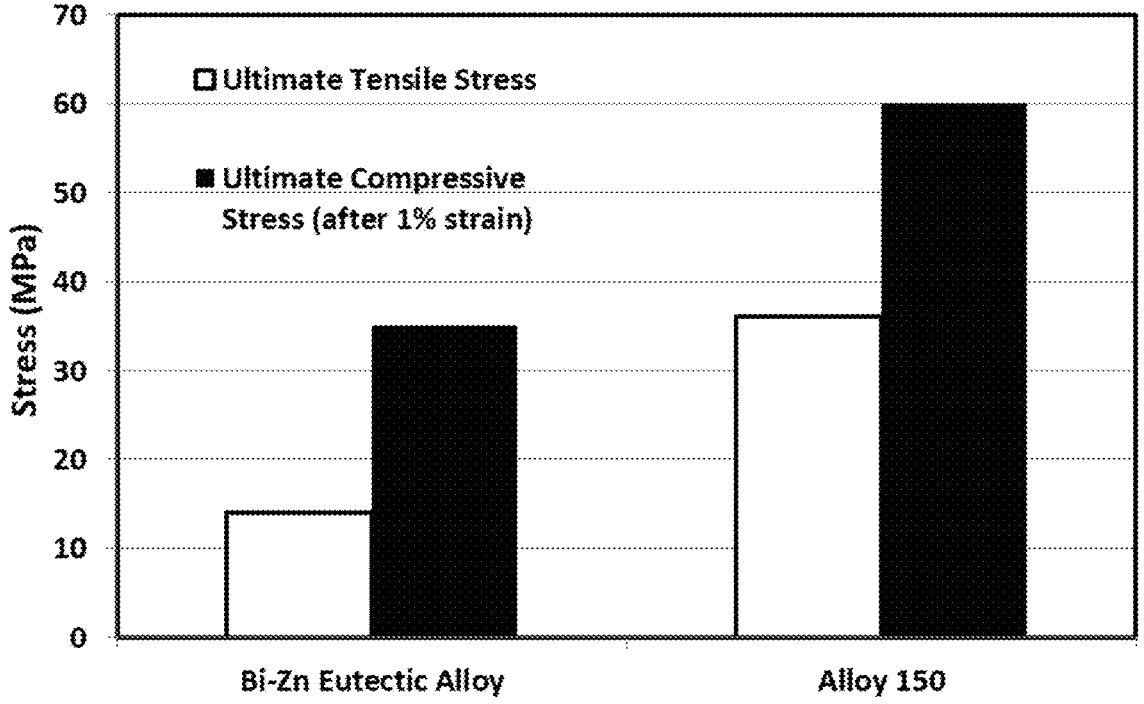
Figure 28:
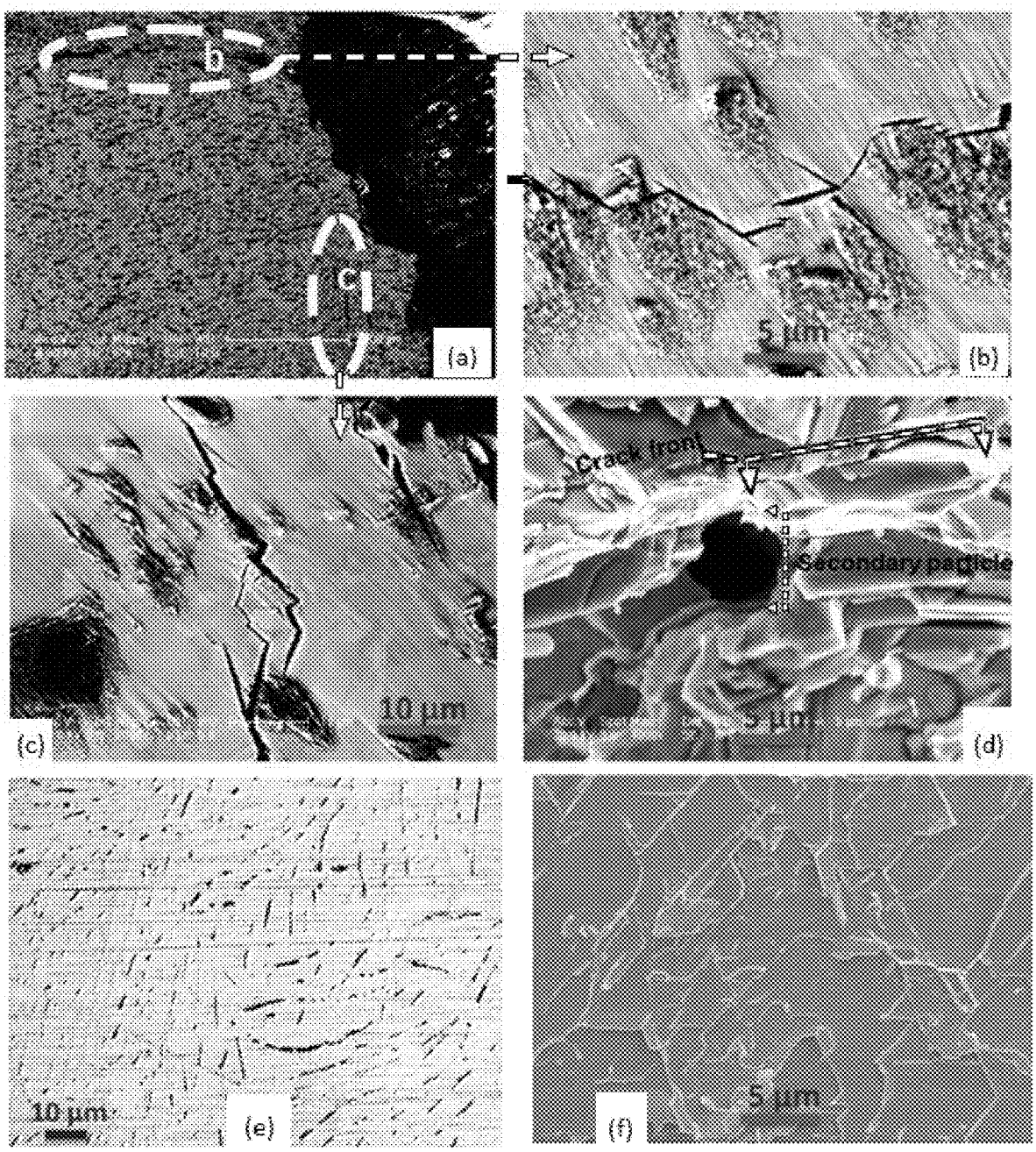
Figure 33A:
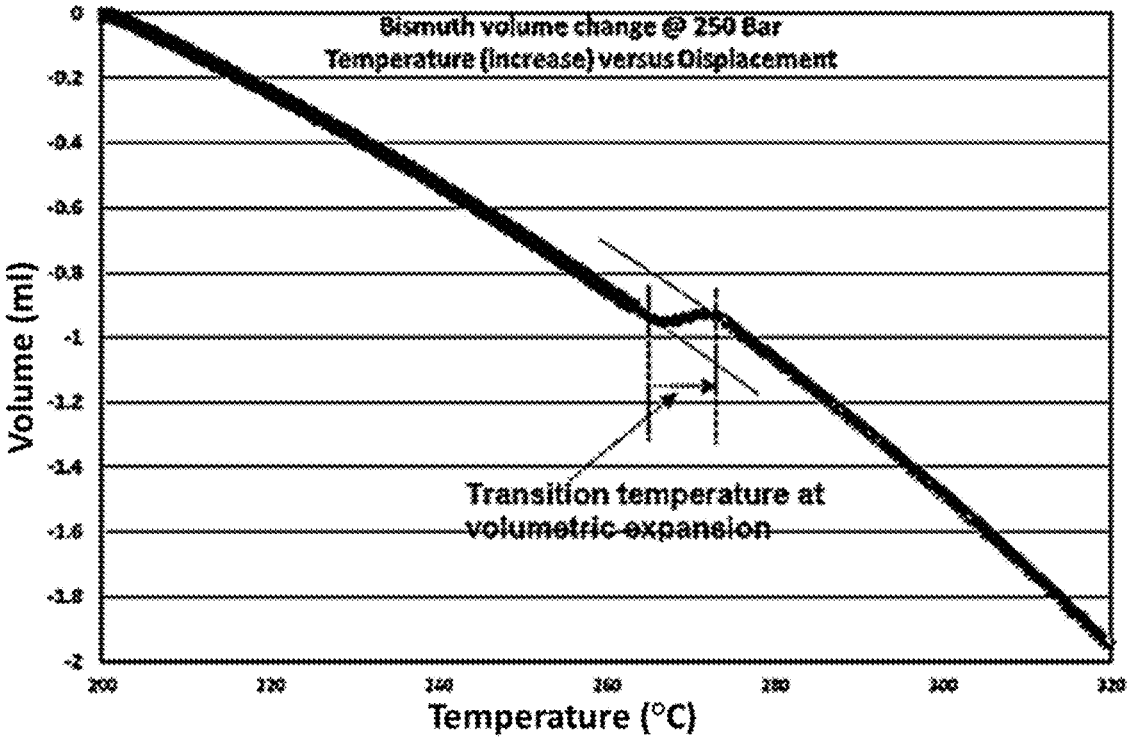
Figure 34:
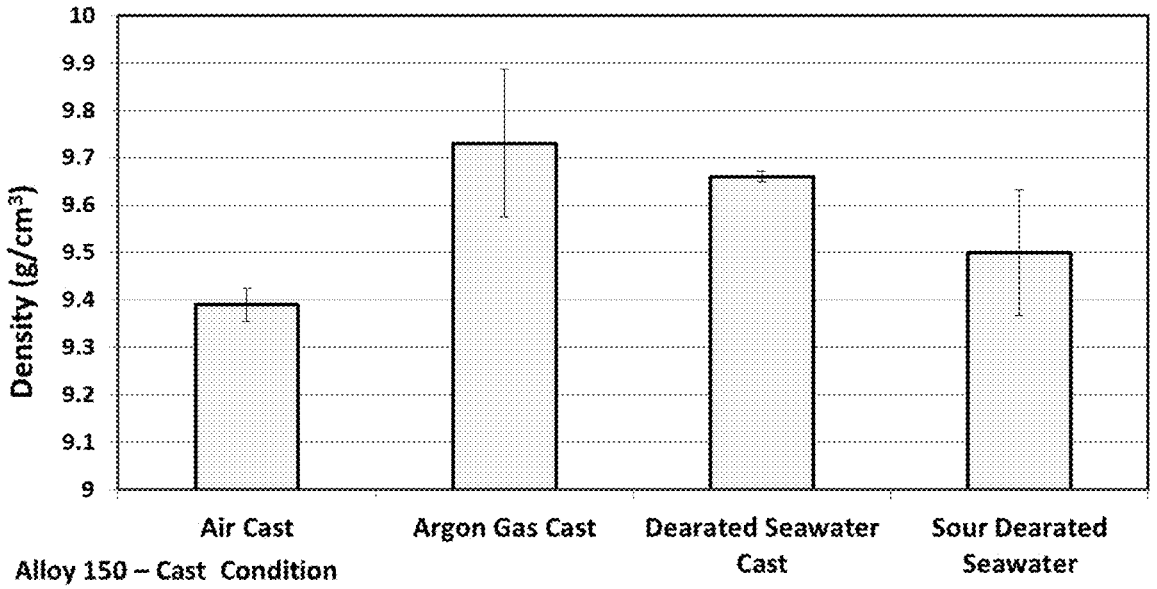
Figure 35:
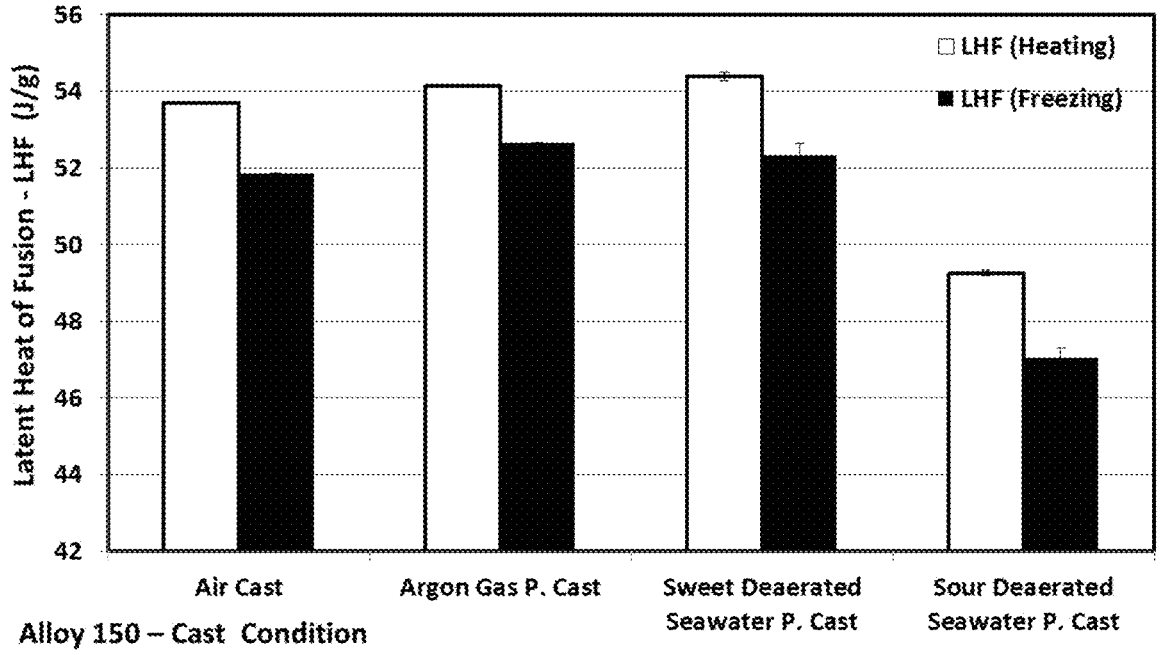
Figure 36:
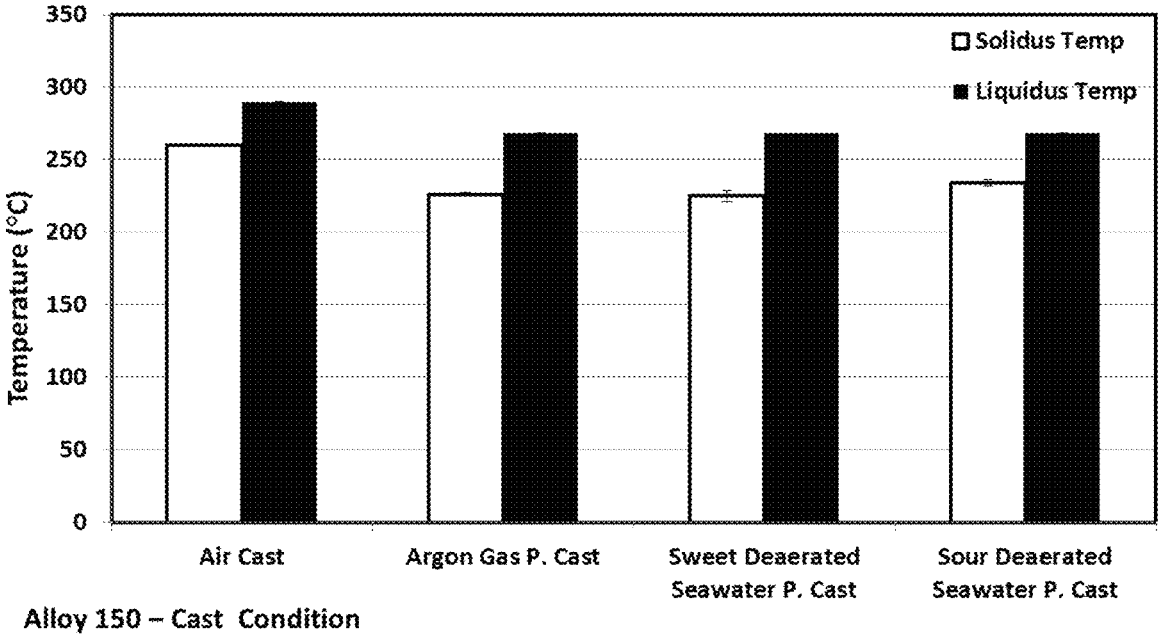
Figure 37:
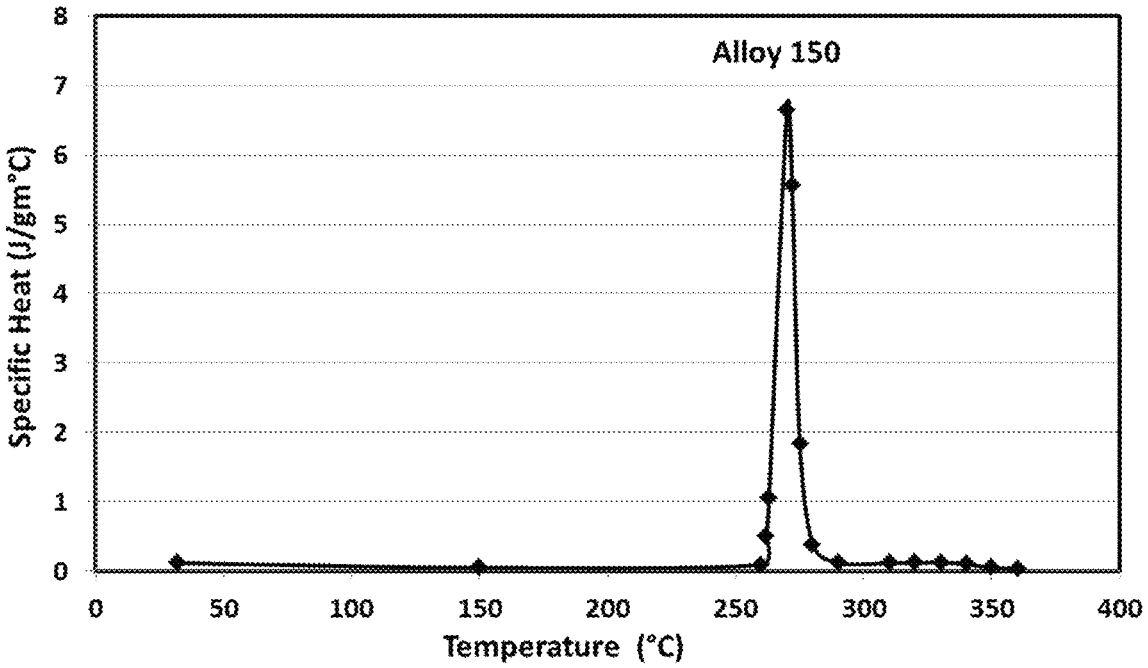
Figure 38:
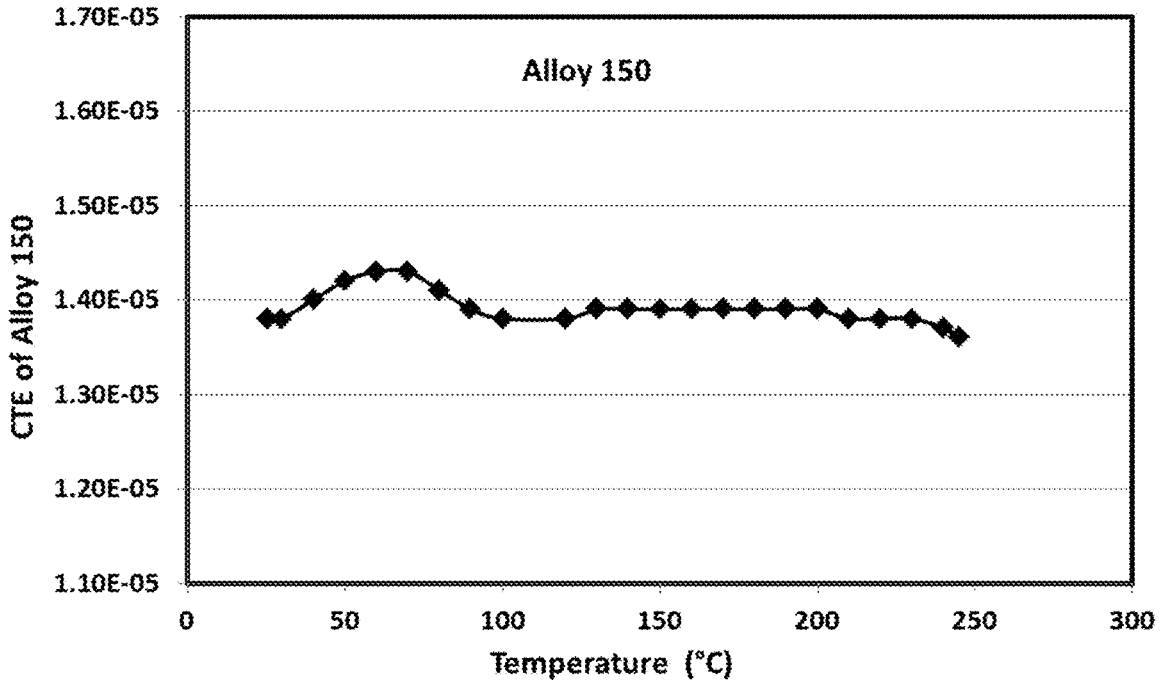
Figure 39:
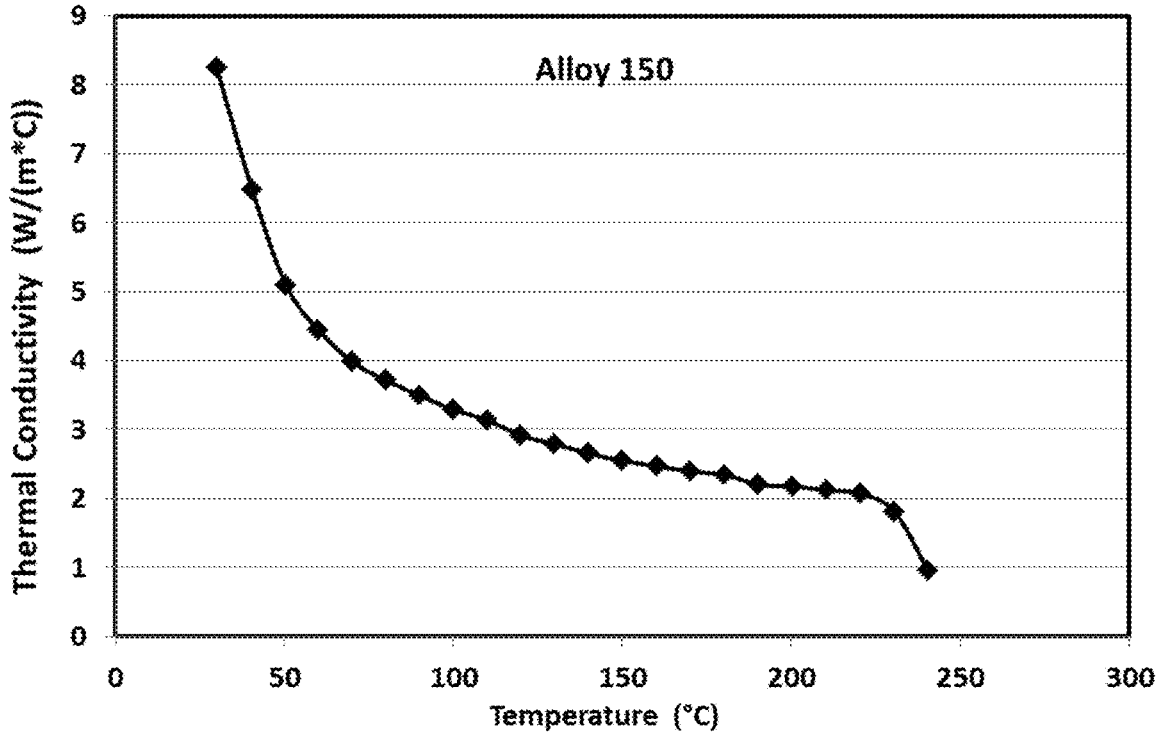
Figure 40:
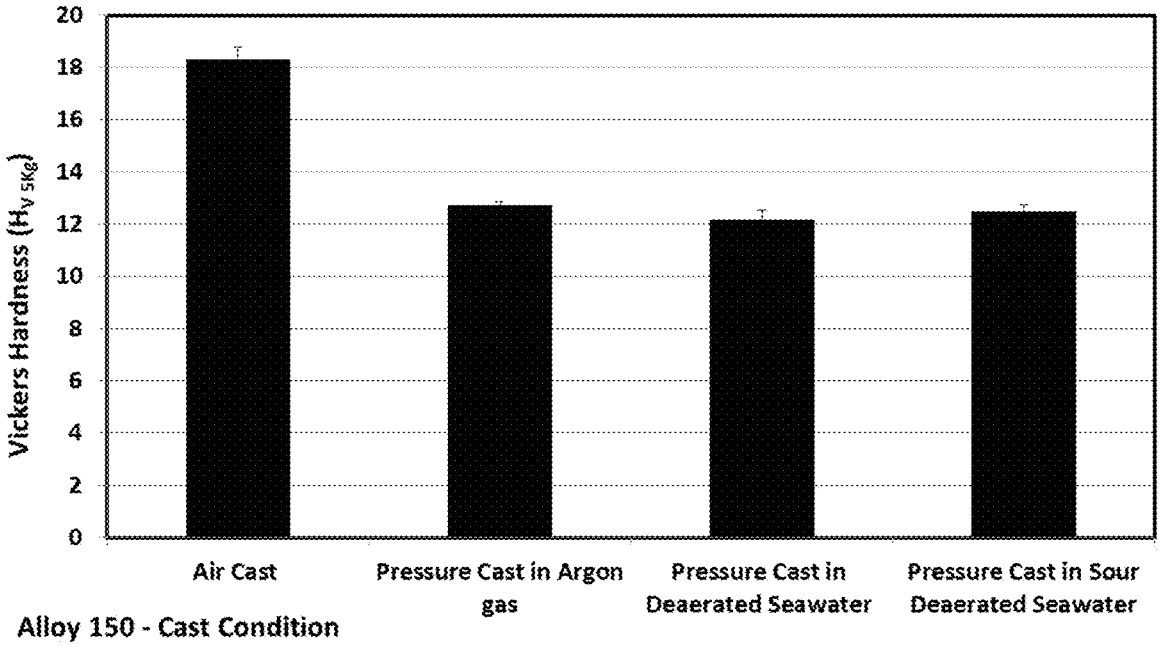
Figure 41:
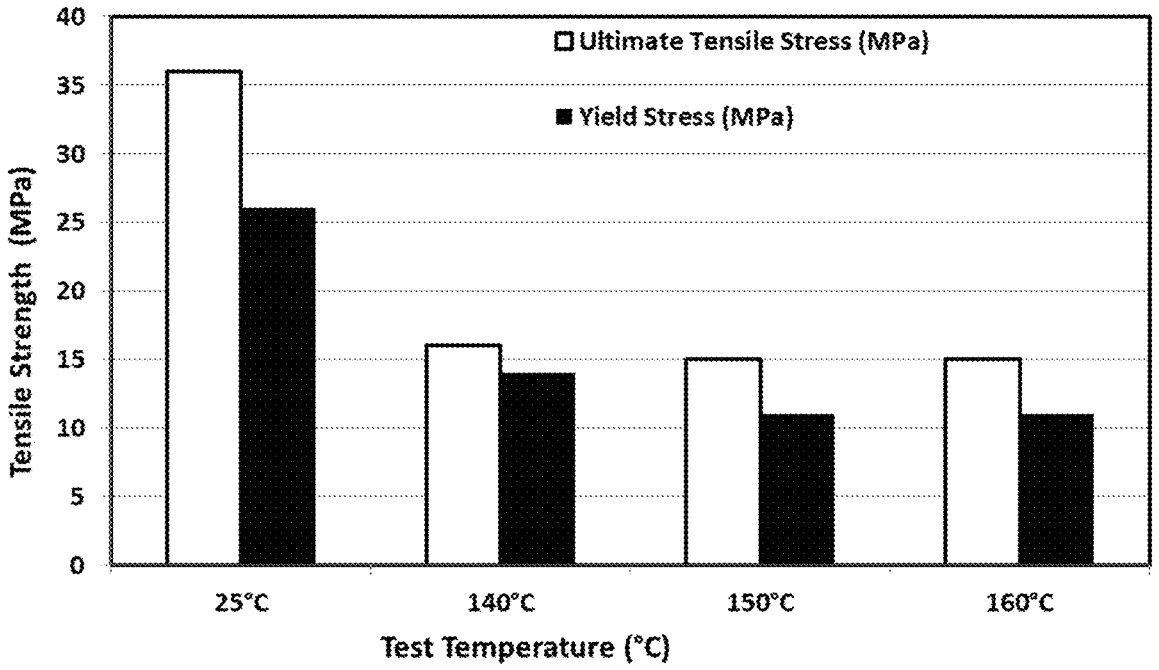
Figure 42:
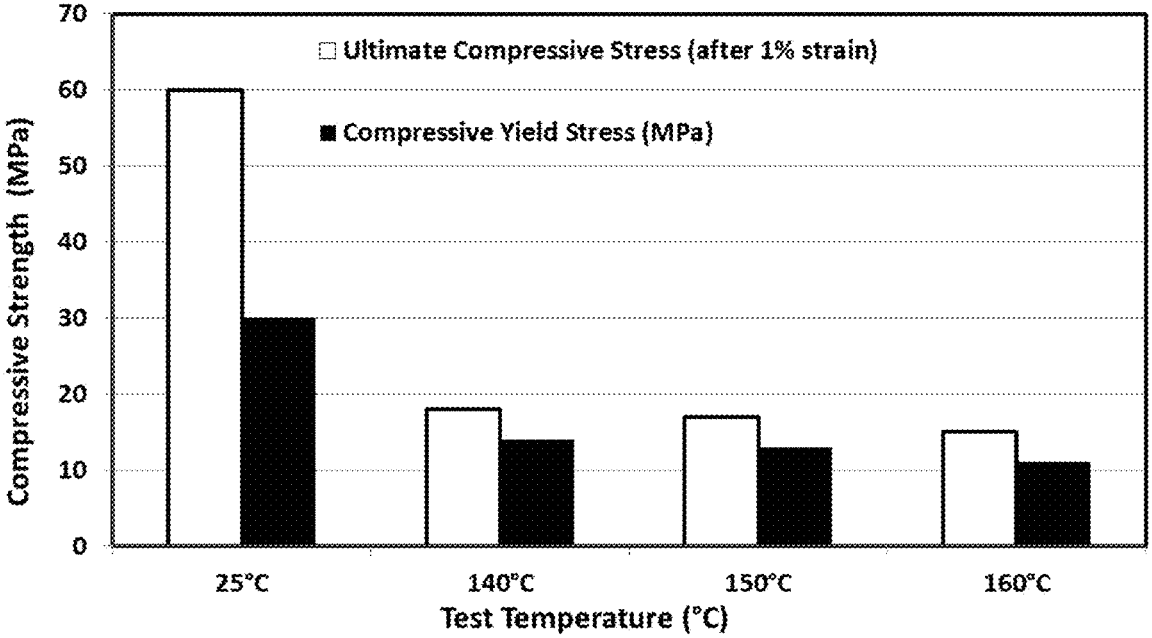
Figure 43:
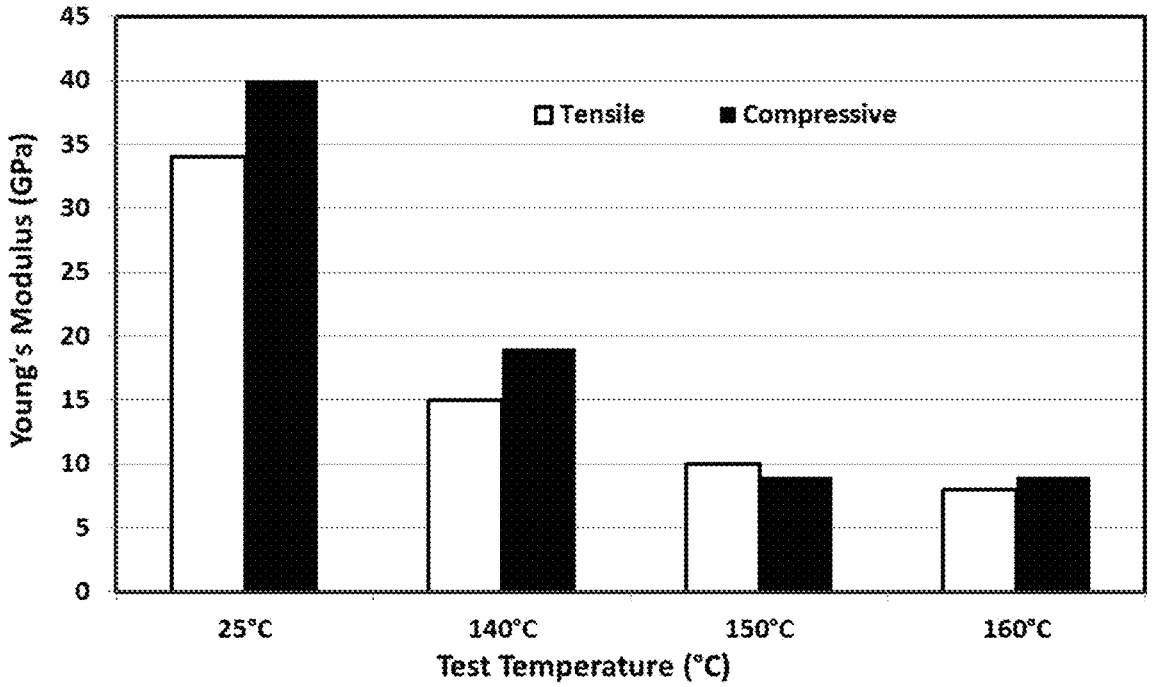
Figure 44:
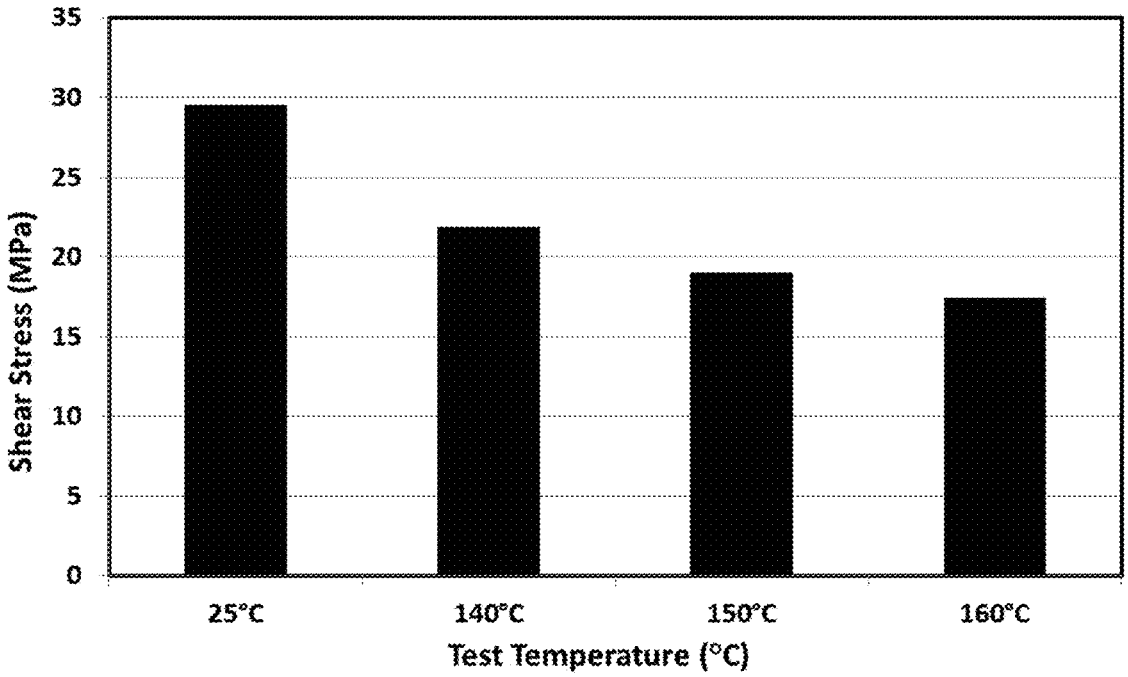

FIGS. 12*a* and 12*b* are differential scanning calorimetry plots sowing the enthalpy change and corresponding transition temperatures in both air cast and pressure cast test samples of the alloy of the first aspect of the present invention as the alloy (a) melts and (b) cools from 250° C.;

FIGS. 13*a* and 13*b* are micrographs in back-scattered electron mode showing (a) the typical microstructure of the bismuth-tin eutectic of the prior art and (b) the alloy of the first aspect of the present invention;

FIGS. 14*a* and 14*b* are micrographs in back-scattered electron mode showing (a) low and (b) high magnification images of the alloy of the first aspect of the present invention;

FIGS. 15*a*, 15*b*, 15*c*, and 15*d* are micrographs in back-scattered electron mode showing the structure of samples of the alloy of the first aspect of the present invention cast (a) in air, (b) under pressure of 5000 psi (about 34.5 MPa), (c) under pressure of 5000 psi (about 34.5 MPa) and sour deaerated seawater, and (d) under pressure of 5000 psi (about 34.5 MPa) and deaerated seawater;

FIG. 16 is an x-ray diffraction pattern obtained from an air cast sample of the alloy of the first aspect of the present invention;

FIG. 17 is a graph showing the specific heat capacity of the alloy of the first aspect of the present invention cast under four different environments;

FIG. 18 is a graph showing the coefficient of thermal linear expansion as a function of temperature of samples of the alloy of the first aspect of the present invention cast under four different environments;

FIG. 19 is a graph of the thermal conductivity as a function of temperature for samples of the alloy of the first aspect of the present invention cast under four different environments;

FIG. 20 is a graph comparing the Vickers Hardness values of samples of the alloy of the first aspect of the present invention cast under three different environments;

FIG. 21 is a graph showing the ultimate tensile strength (UTS) and yield stress (YS) measured at room temperature of samples of the alloy of the first aspect of the present invention cast under four different conditions;

FIGS. 22*a* and 22*b* are graphs showing (a) the ultimate tensile strength and (b) the yield stress as a function of temperature for samples of the alloy of the first aspect of the present invention cast under four different conditions;

FIG. 23 is a graph showing the tensile Young's modulus as a function of temperature of an air cast sample of the alloy of the first aspect of the present invention;

FIGS. 24*a* and 24*b* are graphs showing (a) the unconfined compressive strength and (b) the compressive yield stress as a function of temperature for samples of the alloy of the first aspect of the present invention cast under four different environments;

FIG. 25 is a graph showing the shear modulus as a function of temperature of an air cast sample of the alloy of the first aspect of the present invention;

FIGS. 26*a* and 26*b* are graphs showing the impact of corrosion obtained from an accelerated ageing/corrosion test on the ultimate tensile strength of samples of the alloy of the first aspect of the present invention at room temperature and at 70° C.;

FIG. 27 shows the typical ultimate tensile and compressive strengths for the Bi—Zn eutectic alloy of the prior art and of the alloy of the fourth aspect of the present invention;

FIGS. 28*a* to *f* are images of a sample of the alloy of the fourth aspect of the present invention which have been tested to failure;

FIG. 29 is a micrograph showing the typical structure of the alloy of the fourth aspect of the present invention;

FIG. 30*a* to *e* shows the typical energy dispersive x-ray analysis (EDXA) of the alloy of the fourth aspect of the present invention;

FIGS. 31*a* to *d* show micrographs in BSE (back scattered electron) mode of the effect of casting under pressure and in simulated environments;

FIGS. 32*a* to *d* show the cooling curves and the time taken to cool down from 310° C. to 100° C. of samples of the alloy of the fourth aspect of the present invention cast under four different conditions;

FIGS. 33*a* and *b* show the volumetric expansion of the alloy of the fourth aspect of the present invention at a pressure of 250 bar (gauge);

FIG. 34 shows a comparison of the room temperature densities of solid alloy of the fourth aspect of the present invention cast under different conditions;

FIG. 35 shows the latent heat of fusion (melting/freezing) of the alloy of the fourth aspect of the present invention cast in different environments;

FIG. 36 shows the solidus and liquidus temperatures of samples of the alloy of the fourth aspect of the present invention when cast under different conditions;

FIG. 37 shows the specific heat capacity of a sample of the alloy of the fourth aspect of the present invention as a function of temperature;

FIG. 38 shows the coefficient of thermal linear expansion (CTE) as a function of temperature for the alloy of the fourth aspect of the present invention cast in air;

FIG. 39 shows the thermal conductivity of the alloy of the fourth aspect of the present invention cast under in air;

FIG. 40 shows the difference in the hardness of the alloy of the fourth aspect of the present invention cast under different conditions;

FIG. 41 shows the ultimate tensile strength and the yield stress measured at different temperatures for the alloy of the fourth aspect of the present invention cast and cooled in air;

FIG. 42 shows the ultimate compressive strength and the compressive yield stress as a function of temperature for the alloy of the fourth aspect of the present invention cast and cooled in air;

FIG. 43 shows the tensile and compressive Young's modulus of air cast alloy of the fourth aspect of the present invention as a function of temperature; and FIG. 44 shows the shear stress of air cast and cooled alloy of the fourth aspect of the present invention.

EXAMPLE

Test samples were prepared according to the elemental specification shown below in Table 1.

| Element | Range (weight %) |
|---|---|
| Tin | 30-35 |
| Antimony | 1.8-2.8 |
| Bismuth | Balance |

A number of tests to determine the physical characteristics of the alloys according to the first aspect of the present invention were undertaken and the results of these tests are shown in the figures and explained below.

Figure 1:
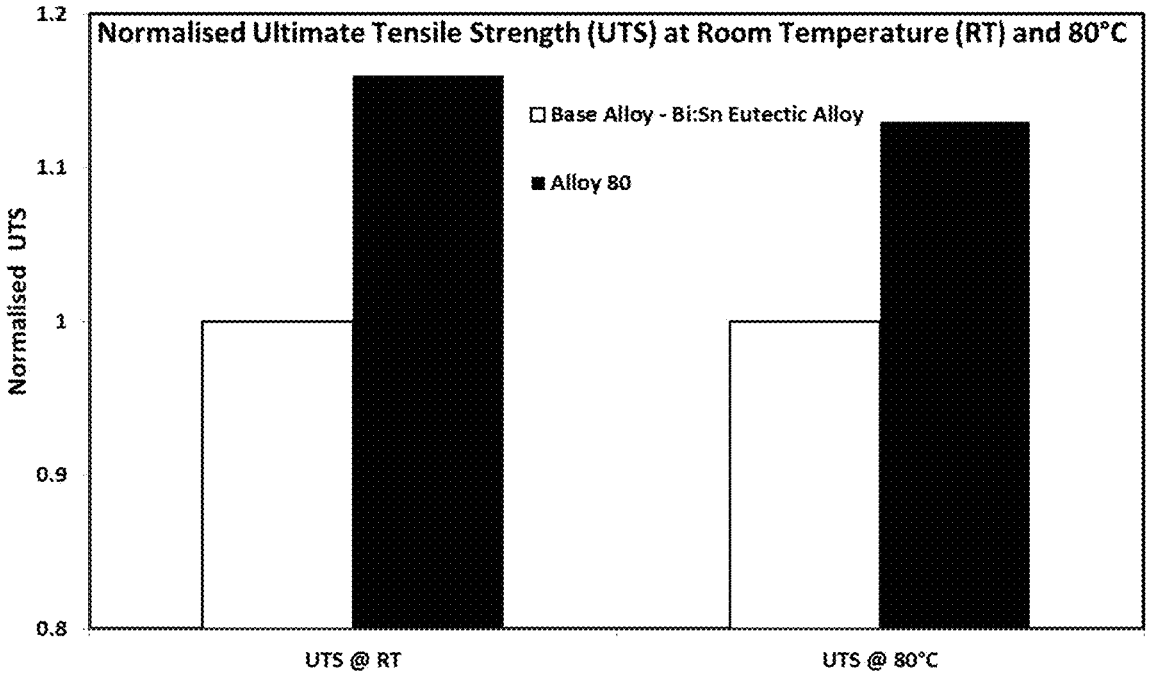
FIG. 1 is a graph comparing the normalised ultimate tensile strengths of the bismuth-tin alloy of the prior art and the alloy of the first aspect of the present invention at room temperature and at 80° C.

FIG. 1 shows a comparison of the normalised ultimate tensile stress of the conventional bismuth-tin alloy presently used to form plugs in wells and the alloy of the first aspect of the present invention at room temperature and at 80° C.

As can be seen from this figure, the ultimate tensile stress of the alloy of the first aspect of the present invention comprising bismuth, tin, and antimony is higher than the ultimate tensile stress of the conventional bismuth-tin alloy. This is advantageous for when the alloy of the first aspect of the present invention is used to form a plug to seal a well due to the forces acting upon the plug.

Figure 2:
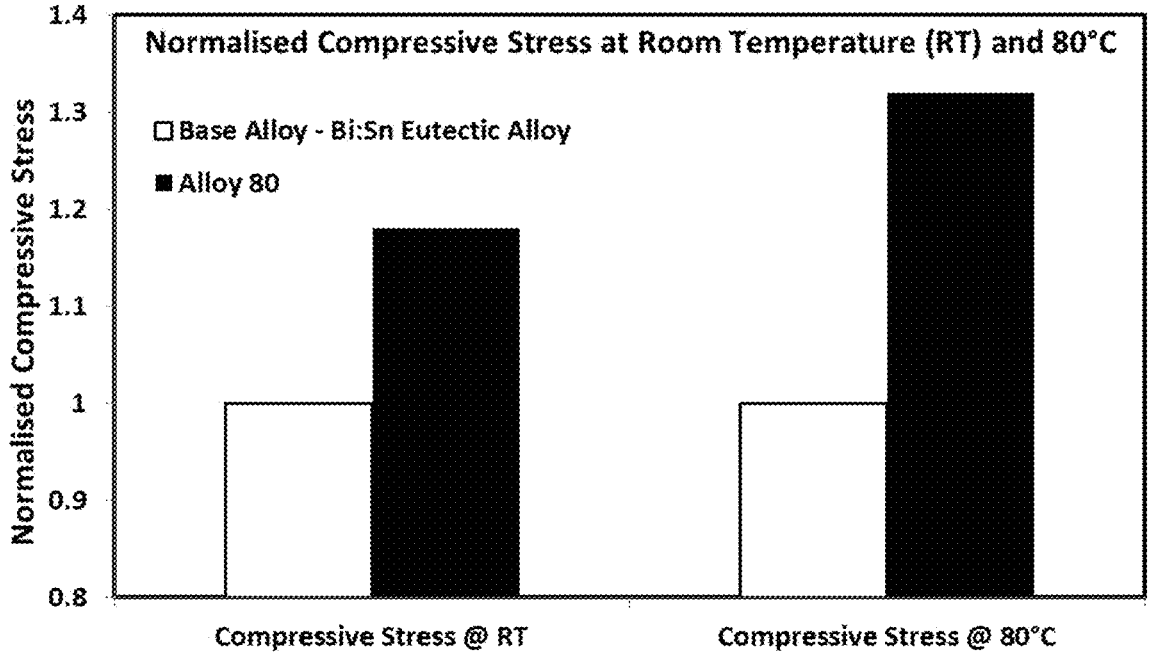
FIG. 2 is a graph comparing the normalised compressive strengths of the bismuth-tin alloy of the prior art and the alloy of the first aspect of the present invention at room temperature and at 80° C.

FIG. 2 shows a comparison of the normalised compressive strength at room temperature and at 80° C. of the conventional bismuth-tin alloy and the alloy of the first aspect of the present invention. In operation, the plug is put under compressive loading as it is exerting an outward force against the walls of the well. It is therefore desirable to have increased compressive strength.

Mechanical testing of the alloy of the first aspect of the present invention and the conventional bismuth-tin alloy, of which both FIG. 1 (i.e. normalised ultimate tensile strength)

and FIG. 2 (i.e. normalised compressive strength) summarise the test results which were all conducted on an Instron 5566 universal tensile/compressive testing machine at a constant cross-head speed of 1 mm/min. Both the tensile and compressive mechanical testing were conducted in accordance with the relevant ASTM standards for room temperature, namely ASTM E8/E8M—tensile and ASTM E9-09—compression, and elevated temperature (80° C.), namely ASTM E21—tensile and ASTM E209-00(2010)—compression. By assuming that the tensile and compression results obtained from a known bismuth-tin eutectic alloy as the baseline, the ratio of the results of the baseline and the alloy of the first aspect of the present invention provides a comparative indication of their relative performance at room temperature and at an elevated temperature of 80° C. It is clear from FIGS. 1 and 2 that the alloy of the first aspect of the present invention outperforms the bismuth-tin eutectic alloy of the prior art.

Figure 3:
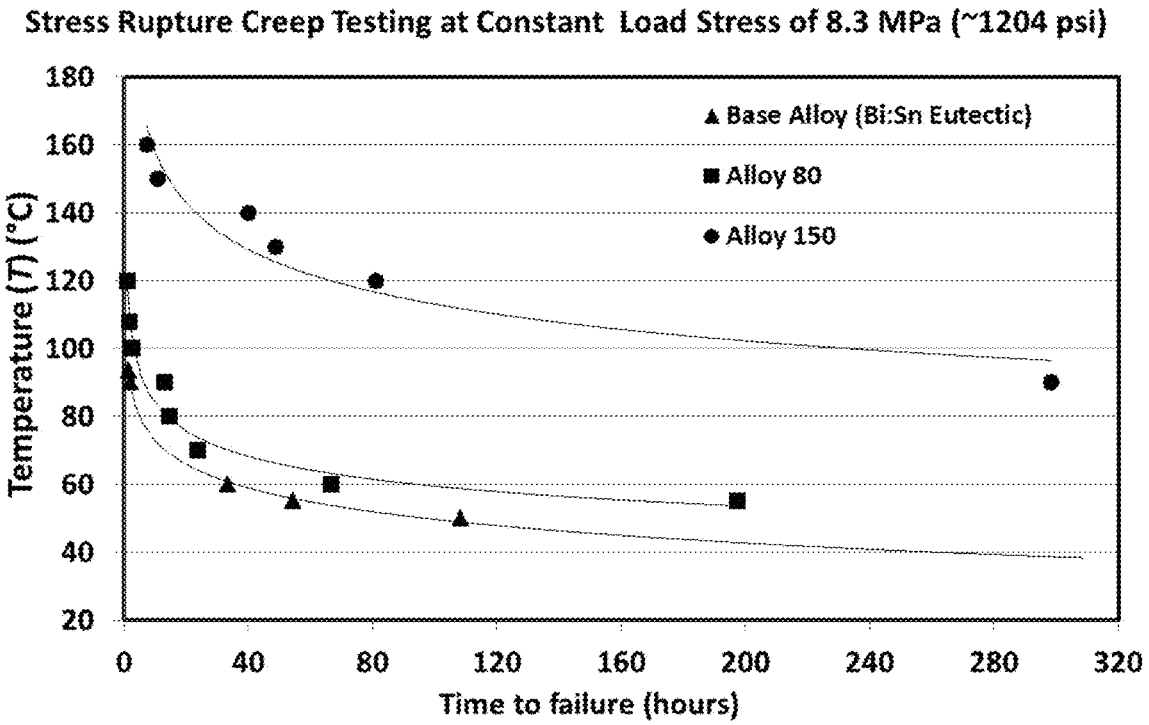
FIG. 3 is a graph comparing the temperature versus time of rupture for samples of the bismuth-tin alloy of the prior art, the alloy of the first aspect of the present invention, and the alloy of the fourth aspect of the present invention when held at a constant load stress value of 8.3 MPa (around 1204 psig)

FIG. 3 shows a comparison of the temperature versus time of rupture when samples of the alloy of the prior art, the alloy of the first aspect of the present invention and of the fourth aspect of the present invention were held at a constant load stress value of 8.3 MPa.

From this figure, it can be seen that there is significant improvement in creep resistance above the conventional bismuth-tin alloy for the alloy of the first aspect of the present invention as well as the alloy comprising bismuth and silver of the fourth aspect of the present invention.

In order to accurately assess the physical characteristics of the alloy of the first aspect of the present invention, as-cast tensile specimens of the alloys of the first aspect of the present invention were tested at a constant temperature of 80° C. and pressure of 8.3 MPa. In view of the fact that the alloy of the first aspect of the present invention would be deployed to operate at and withstand down-hole differential pressure of 5000 psi (about 34.5 MPa), test specimens of the alloy of the first aspect of the present invention were machined from samples of the alloy which were pressure cast in a stainless steel autoclave filled with simulated fluid and gaseous environments, namely:

- Deaerated seawater adjusted to pH 10-11 to represent a low corrosivity test environment;
- Deaerated seawater made biologically sour to a "NACE solution" composition (approximately 600 mg/L dissolved in $H_2S$ (pH range 4.5-6.5) reference: NACE MR0175/section B.3.5.4 (Type 3a and 3b environments)); and
- Pure argon gas.

The pure argon gas environment was used to determine the effect of casting under pressure on the properties of the alloy of the first aspect of the present invention.

Figure 4:
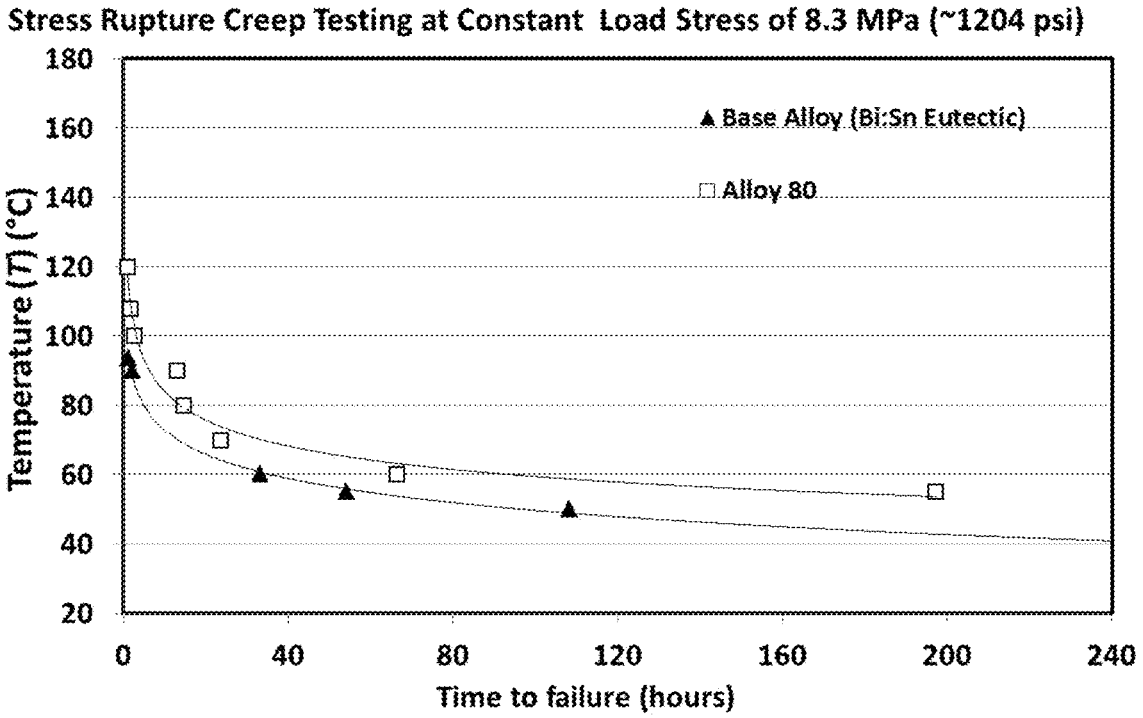
FIG. 4 is a graph of the curves obtained from a stress rupture creep test conducted at a constant stress value of 8.3 MPa for the bismuth-tin alloy of the prior art and the alloy of the first aspect of the present invention.

FIG. 4 shows typical curves obtained from a stress rupture creep test which was conducted at a constant stress value of 8.3 MPa for a bismuth-tin eutectic alloy of the prior art and the alloy of the first aspect of the present invention. This figure demonstrates the increased creep resistance of the alloy of the first aspect of the present invention when compared with the alloys of the prior art.

Figure 5:
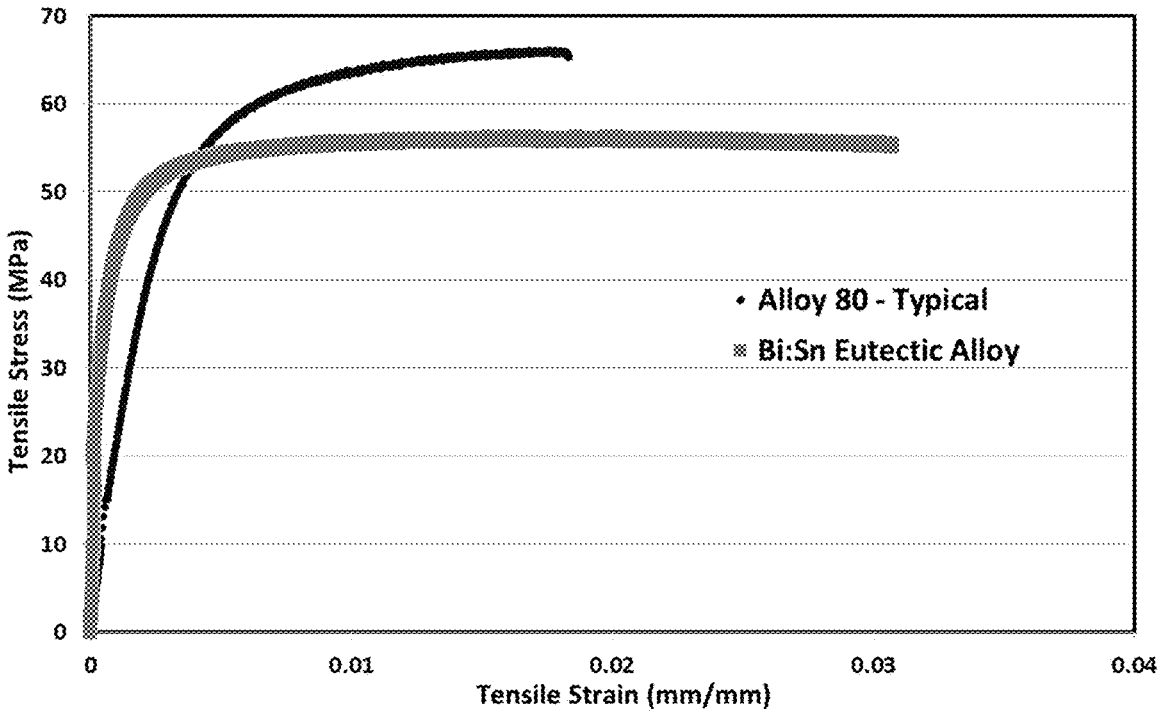
FIG. 5 is a graph of the stress vs strain curves generated from a tensile test conducted at a constant cross-head speed of 1 mm/min for the bismuth-tin alloy of the prior art and the alloy of the first aspect of the present invention.

FIG. 5 shows the stress vs. strain curves generated from a tensile test conducted at a constant cross-head speed of 1 mm/min for the bismuth-tin eutectic alloy of the prior art and the alloy of the first aspect of the present invention. The ultimate tensile stress and yield stress of the alloy of the first aspect of the present invention are improved over those of the bismuth-tin alloy of the prior art.

Figure 6:
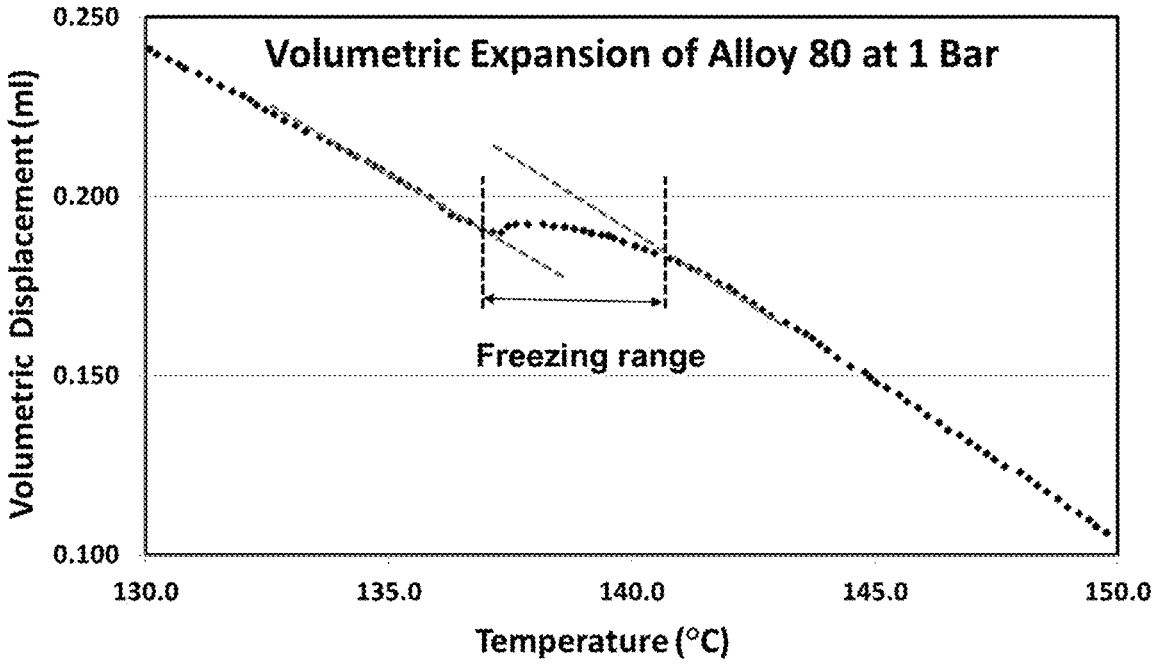
FIG. 6 is a graph showing the volume displaced originating from a change in density at normal atmospheric pressure as the alloy of the first aspect of the present invention cools down upon freezing.

FIG. 6 shows the volumetric expansion of the alloy of the first aspect of the present invention at a pressure of one bar (gauge). In order to determine the volumetric expansion of the alloy of the first aspect of the present invention, 10 grams of a pore and gas free sample of the alloy of the first aspect of the present invention with a known volume was placed in a graduated cylindrical Pyrex glass within which a freely-moving flat ended ceramic piston rests on top of the sample. As the sample expands or shrinks during heating and/or cooling, the displacement of the piston can be measured and this can be used to measure the amount by which the sample has expanded or contracted. The inner diameter of the cylindrical Pyrex glass provides sufficient clearance for the expansion of the metal relative to the ceramic piston up to the melting point of the metal sample.

The starting mass and dimensions of the alloy sample to be tested and of the cylindrical Pyrex glass are measured, and a starting density is calculated. The total piston length and the overall unit length when assembled are also measured. The overall unit is then subjected to a heating/cooling cycle in a mechanical dilatometer under a small axial force. During testing, a heating/cooling rate of 0.5° C./min was used with data being logged every minute. As the unit is heated, the alloy sample expands lengthwise. When the alloy begins to melt, the cylindrical cavity beneath the ceramic piston becomes completely filled leading to a decrease in the length of the unit. With further heating, the alloy expands volumetrically and pushes the piston out again. On cooling, the reverse process occurs.

As such, by measuring the relative displacement of the ceramic piston, and hence the volume of the cavity created but subsequently filled with the alloy, as the unit was heated or cooled relative to the starting volume, the volumetric expansion of the alloy may be determined. The 'zero' volume is the starting unit volume and the 'relative' volume refers to the displace volume after subtracting the starting unit volume.

This figure demonstrates that the alloy of the first aspect of the present invention expands by as much as 0.7% in volume upon freezing. Since the alloy of the first aspect of the present invention is non-eutectic in composition, the expansion does not occur instantaneously at a particular temperature on freezing, but rather over a temperature range as shown in FIG. 6.

Figure 7:
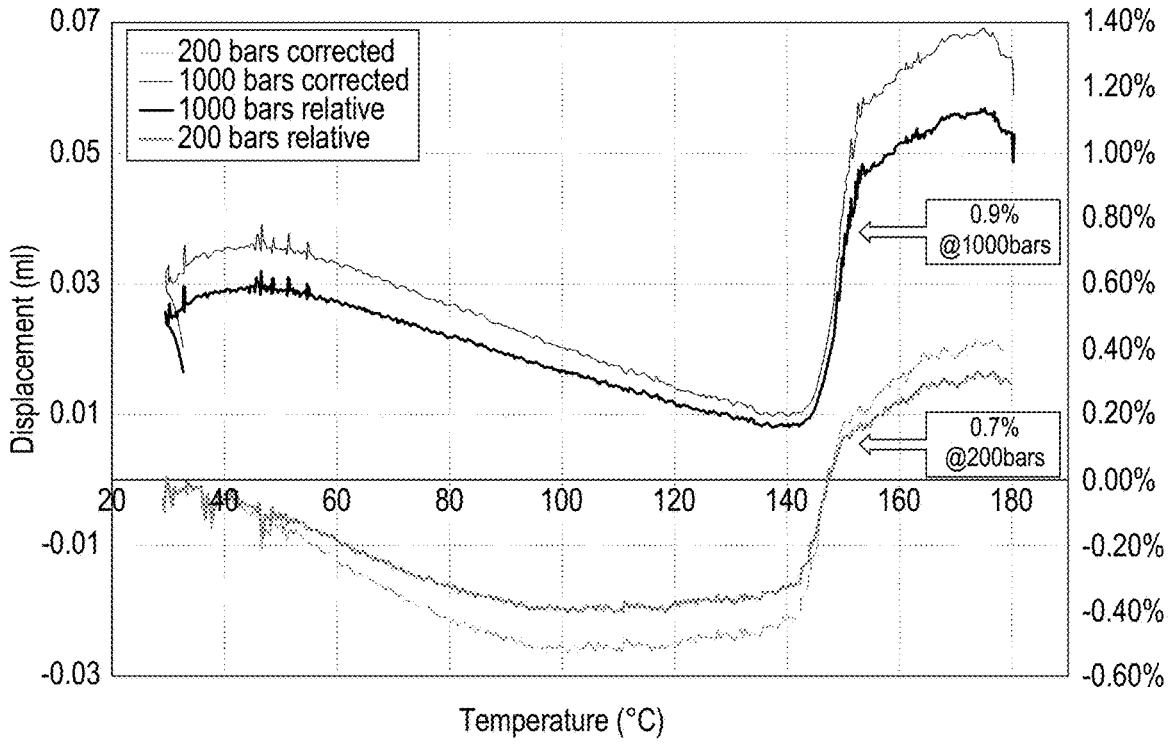
FIG. 7 is a graph showing the effect of casting pressure on volumetric expansion of the alloy of the present invention conducted at 200 and 1000 barg.

FIG. 7 shows the effects of casting pressure on volumetric expansion of the alloy of the first aspect of the present invention when the tests were conducted at 200 and 1000 bars. The expansion was measured as described above, albeit at increased pressures. It can be seen that there is a greater degree of volumetric expansion when the tests were conducted at higher pressures. The upper pair of lines shows the results relating to the 1000 bar tests and the lower pair of lines shows the results relating to the 200 bar tests.

Figure 8:
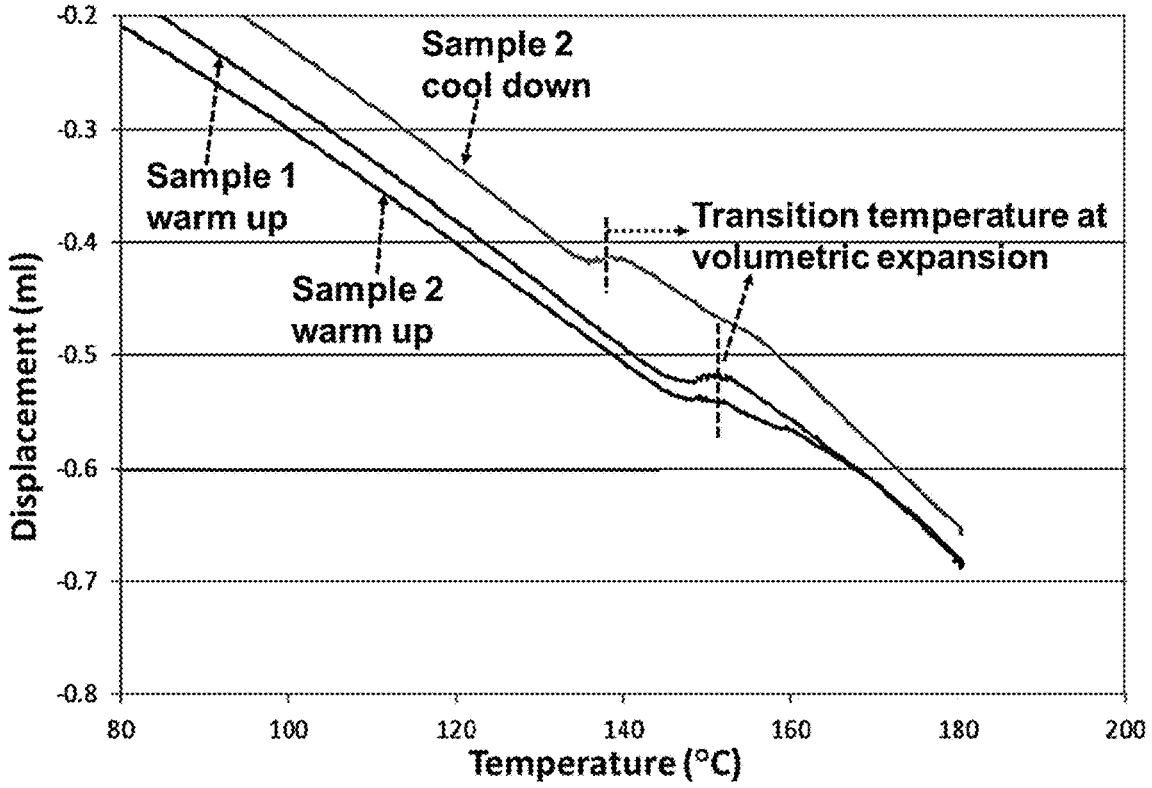
FIG. 8 is a graph showing the effect of a cooling-heating cycle on the temperature at which the respective volumetric expansion/contraction of the alloy of the first aspect of the present invention occurs when tested at 1000 bar.

FIG. 7 shows the results of further tests conducted to establish the impact of casting the alloy of the first aspect of the present invention under pressure on its volumetric expansion. These tests revealed a negligible effect especially within the limit of the differential pressures (345 bars) expected during actual plug deployment. As shown in FIG. 8, it was observed that when the measurement was conducted at 1000 bars, the effect of cooling-heating cycle is such to cause a change in the transition temperature at which the respective volumetric expansion-contraction of the alloy of the first aspect of the present invention occurs.

Figure 9:
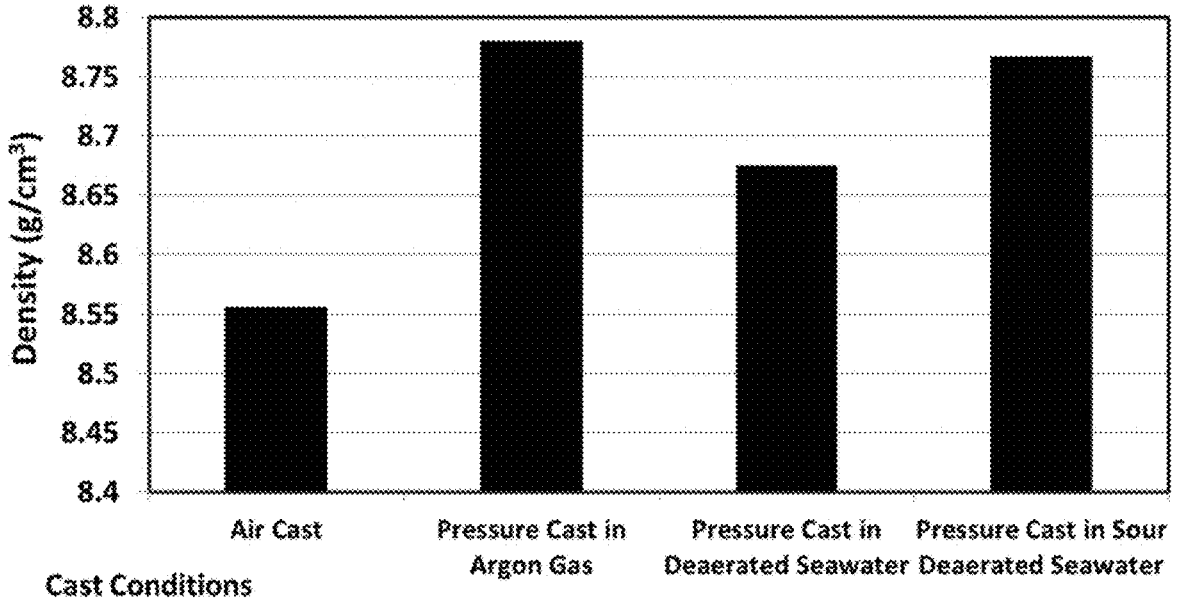
FIG. 9 is a graph comparing the room temperature densities of the alloy according to the first aspect of the present invention cast under different conditions.

FIG. 9 shows a comparison of the room temperature densities of solid alloy of the first aspect of the present invention cast under different conditions using a Quantachrome Poremaster. The Quantachrome Poremaster is specifically designed to measure the true volume of a test sample of known mass by employing the principle of fluid displacement and gas expansion. The apparatus uses helium gas to penetrate any surface flaws of the sample down to around one Angstrom in size so that an accurate volume of the sample can be measured. The true density of the sample can then be calculated. This figure demonstrates that casting under increased pressure leads to an increase in the density of the alloy. Without wishing to be bound by scientific theory, it is believed that the increase in density of the alloy is due to the associated increased compaction and subsequent densification effect.

Figure 10:
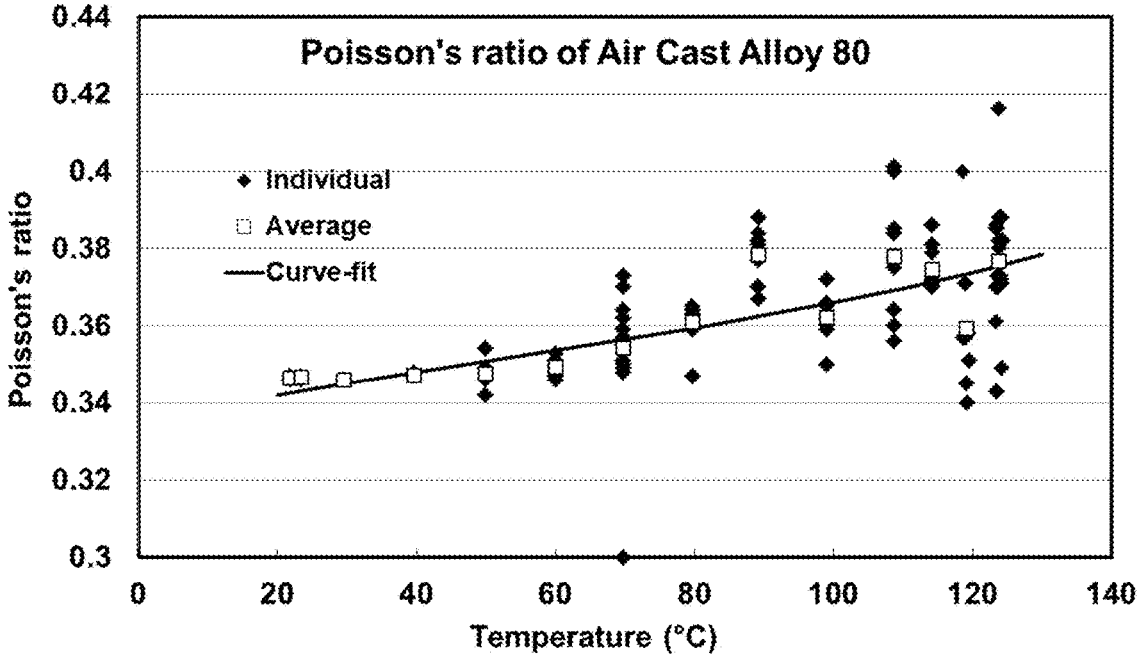
FIG. 10 is a graph showing the Poisson's ratio of the air-cast alloy of the first aspect of the present invention at different temperatures.

FIG. 10 shows the change in the Poisson's ratio of the alloy of the first aspect of the present invention at different temperatures. The tests were conducted in accordance with the ASTM E1876-09 and EN843-2/EN 821-2 standards using the so-called "impact excitation" or "natural frequency" method on a number of rectangular bars measuring 85 mm×10 mm×5 mm and subsequently on disc shaped test pieces measuring 40 m×4 mm. These tests results consider that the test material is homogenous and isotropic. Without wishing to be bound by scientific theory, it is believed that the observed scatter in the test data at high temperatures (100-130° C.) was primarily due to viscoelastic damping of the generated sound waves and the alloy slowly becoming more pliable.

Figure 11:
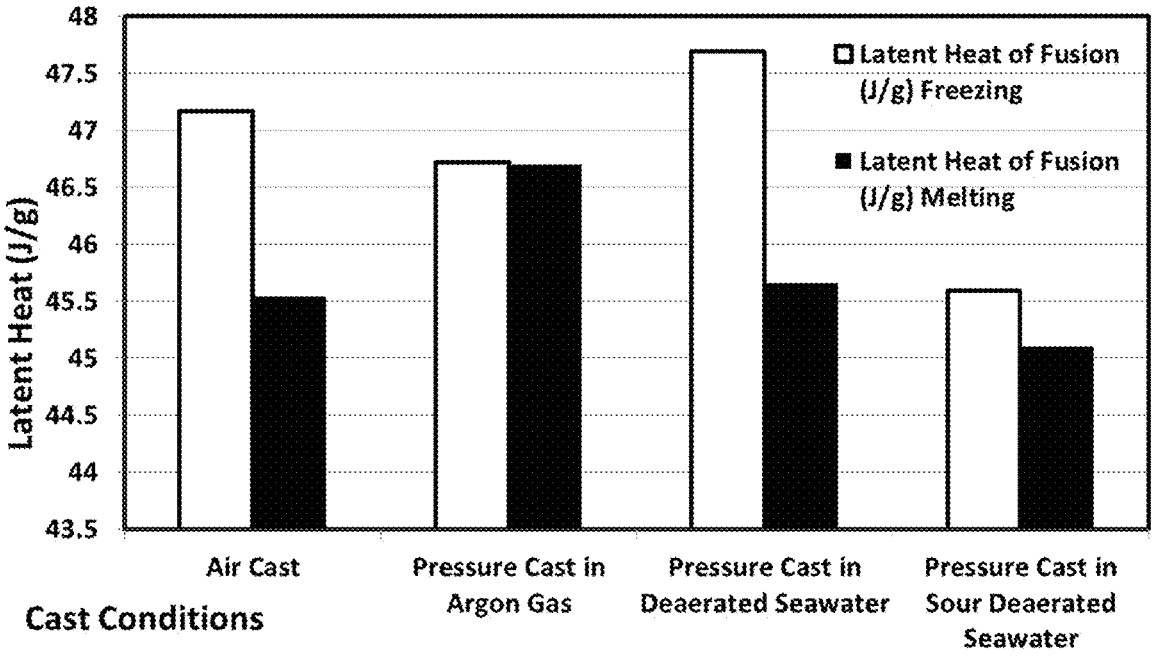
FIG. 11 is a graph showing the latent heat of fusion (melting/freezing) of the alloy of the first aspect of the present invention cast under four different environments.

FIG. 11 shows the latent heat of fusion (melting/freezing) of the alloy of the first aspect of the present invention cast in different environments. The test results were obtained using differential scanning calorimetry (DSC) in accordance with the ASTM B778-00 standard. An equal mass of the alloy of the first aspect of the present invention was tested in all cast conditions. Discounting the results of the samples pressure cast under argon gas, which serves as a control, it is clear from FIG. 11 that the energy requirement to melt an equal amount of the other samples, namely the air cast, the pressure cast in deaerated seawater, and pressure cast in sour deaerated seawater, are essentially the same, about 45 J/g.

FIGS. 12*a* and 12*b* are DSC (differential scanning calorimetry) plots showing the enthalpy change and corresponding transition temperature(s) in both air cast and pressure cast test samples as the alloy of the first aspect of the present invention melts (FIG. 12*a*) and cools down from 250° C. (FIG. 12*b*). In FIG. 13*a*, the temperature at which full alloy melting occurs appeared to be lower in pressure cast samples in comparison with the air cast counterparts. In addition, an air cast sample fully melts after the temperature reaches 182° C. while its pressure cast counterpart fully melts just after 151° C. Without wishing to be bound by scientific theory, it is believed that this difference is purely due to the effect of casting the alloy under pressure. The direct consequence of this observation is the fact that whilst the energy requirement for melting the alloy under differential pressure of 5000 psi (about 34.5 MPa) remains the same as when cast in air, the soak temperature required to cause full melting during actual plug deployment is much lower.

As shown in FIG. 12*b*, without wishing to be bound by scientific theory, the three peaks seen in this figure at approximately 170° C., 157° C., and 138° C. are thought to represent the respective heat evolved as elemental bismuth, tin (with its embedded intermetallic antimony-tin compound) and bismuth-tin eutectic crystallised out from the liquid melts. FIGS. 13*a*, 13*b*, 14*a*, 14*b*, and 15 show the microstructure of alloys of the prior art and the alloy of the first aspect of the present invention.

FIGS. 13*a* and 13*b* are micrographs in back-scattered electron (BSE) mode showing the typical microstructure of the bismuth-tin eutectic alloy of the prior art and the ternary alloy of the first aspect of the present invention. The precipitation of intermetallic particles within the parent matrix of the alloy of the first aspect of the present invention is shown in FIG. 13*b*.

FIGS. 14*a* and 14*b* reveal the typical complex-regular structure of the alloy of the first aspect of the present invention interpreted to be a matrix of pure bismuth (grey/white cuboid phase), tin (dark phase), fibrous/lamellar bismuth-tin eutectic phase and spherical intermetallic antimony-tin compound. The x-ray diffraction pattern shown in FIG. 16 also indicates the presence of pure beta-tin, bismuth and the occurrence of the intermetallic antimony-tin compound thereby corroborating the images shown in FIGS. 14*a* and 14*b*. The alloy of the first aspect of the present invention is non-eutectic in composition hence elemental alloying elements with high melting point such as bismuth and tin as well as antimony-tin intermetallic compounds are expected to first of all crystallise out from the melt as the temperature drops during cooling. At 139° C. the remaining liquid melt, which is now of the bismuth-tin eutectic composition, subsequently solidifies to yield the observed lamellar structure. Under higher magnification, a mean interface secondary eutectic spacing of 2.5 μm was measured in the lamellar regions. The absence of specific peaks representing the bismuth-tin eutectic phase in the x-ray diffraction pattern of FIG. 16 is due to the fact that the bismuth-tin eutectic phase is simply a phase comprising alternating lamellar layers of elemental bismuth and tin which have already been individually captured in the x-ray diffraction pattern. In contrast, the trace in FIG. 12*b* obtained for pressure cast samples only contains two peaks comprising a major peak beginning at approximately 137° C. and a much compressed minor peak beginning at approximately 140° C. This observation also corresponding with the micrograph for a sample pressure cast in argon shown in FIG. 15*b* explains the apparent lack of substructure within the matrix.

FIG. 17 shows the results of an experiment to determine the heat capacity of the alloy of the first aspect of the present invention when cast under the four different conditions outlined previously (air cast, pressure cast under argon gas, pressure cast under deaerated seawater, and pressure cast under sour deaerated seawater). The test was carried out using DSC in accordance with the ASTM E1269-11 standard using 26 mg of the alloy at a heating rate of 5° C./min. As would be expected, a large amount of energy per unit mass is absorbed during melting process of all the tested samples. At around 150° C., the specific heat capacity of the sample cast in sour deaerated sweater was the highest, followed by the sample cast in deaerated seawater, followed by the sample cast in air, with the sample cast in argon gas having the lowest specific heat capacity.

FIG. 18 shows the coefficient of thermal linear expansion as a function of temperature for the alloy of the first aspect of the present invention cast under the four different environments discussed above. The coefficient of thermal liner expansion is one of the most important thermal properties of the alloy of the first aspect of the present invention, as this together with its volumetric expansion and coefficient of friction plays a crucial role in determining the reaction force, and hence its sealing capability, which the alloy can generate against both the casing and mandrel materials once deployed. FIG. 18 shows the test results as determined using a push-rod dilatometer in accordance with the ASTM E228-11 standard.

FIG. 19 shows the thermal conductivity of the alloy of the first aspect of the present invention cast under the four different conditions explained above as a function of temperature. The thermal conductivity was indirectly measured using a laser flash method in accordance with the ASTM E1461-11 standard.

FIGS. 20, 21, 22*a*, 22*b*, 23, 24*a*, 24*b*, 25, 26*a*, and 26*b* each relate to the mechanical properties of the alloy of the first aspect of the present invention.

FIG. 20 shows the difference in the hardness of the alloy of the first aspect of the present invention cast under pressure. The hardness value was obtained in accordance with the ASTM E384-11 standard using a 5 kg load cell and a test dwell time of 10 seconds at room temperature.

FIG. 21 shows the ultimate tensile strength and the yield stress measured at room temperature for the alloy of the first aspect of the present invention which was cast under the four different environments outlined above. The tensile test conducted to determine the tensile behaviour of the alloy of the first aspect of the present invention were carried out at room and elevated temperatures in accordance with the ASTM E8/E8M and ASTM E21-09 standards respectively. Regardless of the test temperature, all tests were conducted at a constant strain rate of $10^4$ $s^{-1}$.

FIGS. 22*a* and 22*b* show the ultimate tensile strength and the yield stress as a function of temperature for the alloy of the first aspect of the present invention cast under the four different environments detailed above. As can be seen from FIGS. 21, 22*a*, and 22*b*, the tensile strength of the air cast version of the alloy of the first aspect of the present invention seems to outperform its pressure cast counterpart by as much as 5 to 32%. Without wishing to be bound by scientific theory, this may be related to the refined nature of the microstructure of the air cast version due to rapid cooling upon casting in comparison with its pressure cast counterpart. Slow cooling will adversely promote grain growth and grain coalescence with a reduction in mechanical properties. Furthermore, since pressure casting brings about increased densification of the alloy, this may affect the ductility of the samples especially as these samples were cast in the sweet and sour environments. In addition, since the pressure cast samples were machined without a further heat treatment, this leaves residual stresses on their surfaces resulting in a reduction in tensile strength.

Nevertheless, it can be seen from FIGS. 22*a* and 22*b* that the rate of reduction in tensile strength with increased temperatures, especially between 70 and 90° C., is highest in the air cast version of the alloy compared with its counterparts cast under pressure in deaerated seawater.

FIG. 23 shows the tensile Young's modulus of air cast alloy of the first aspect of the present invention as a function of temperature. The tensile elastic Young's modulus of air cast alloy, which is a measure of its stiffness within its elastic limit, was indirectly determined in accordance with the ASTM E1876-09 and EN 843-2/EN 821-2 standards, using the so-called "impact excitation" or "natural frequency" methods. Due to sample size limitation, the tensile elastic modulus of the alloy pressure cast in different gaseous and fluid environments was determined using the recommended ASTM E8/E8M (room temperature) and ASTM E21-09 (elevated temperature) standards. The results of these tests are shown in Table 2 below. The slight increase measure in Young's modulus value at room temperature compared with the air cast counterpart may be due to the embrittlement associated with different fluid environments these sample types were pressure cast in.

TABLE 2

| Test Temperature | Tensile Elastic Modulus (GPa) of Alloy 80 Pressure Cast in: Argon Gas | Deaerated Seawater | Sour Deaerated Seawater |
|---|---|---|---|
| RM Temp. (25° C.) | 50.68 | 46.13 | 40.97 |
| 70° C. | 25.05 | 34.66 | 39.83 |
| 80° C. | 19.26 | 38.64 | 29.5 |
| 90° C. | 17.06 | 25.38 | 28.29 |

FIGS. 24*a* and 24*b* show the unconfined compressive strength and the compressive yield stress as a function of temperature for the alloy of the first aspect of the present invention cast under the four different environments detailed above.

Based on extensive Finite Element Analysis (FEA) modelling, it is apparent that the plug in an abandoned well will not be exposed to the uniaxial tensile forces as determined for the alloy of the first aspect of the present invention above. Rather the plug will be confined by the casing of the well and will be under lateral compressive stress transferred through the casing from the surrounding reservoir fluids. It will initially experience a uniaxial compressive force imposed by the gravity head of abandonment brine that will be greater than the reservoir fluid pressure. Over time, the uniaxial compressive force will decay as the pressure difference between the head of the abandonment brine and reservoir fluids decays such that the plug will begin to experience tri-axial compressive forces approximating hydrostatic conditions.

The unconfined compressive strength of the alloy of the first aspect of the present invention in different environments was conducted using the ASTM standards E9 (room temperature) and E29 (elevated temperature). However, the compression test was only conducted up to 120° C. for the air cast version of the alloy of the first aspect of the present invention. In contrast to the tensile test results shown in FIGS. 21, 22*a*, and 22*b*, the compression test results indicate that compressive strength of all of the pressure cast samples outperform the air cast sample, especially within the temperature range of 70 to 90° C. Without wishing to be bound by scientific theory, this is believed to be due to the induced densification which is caused by pressure casting the alloy at 5000 psi (about 34.5 MPa). It is therefore believed that similar increased compressive strength will be observed when the alloy is melted and cast down-hole at an operating differential pressure of around 5000 psi (about 34.5 MPa).

FIG. 25 shows the shear modulus of air cast alloy of the first aspect of the present invention as a function of temperature. The determination of shear strength of the alloy cast under different conditions as a function of different test temperatures was conducted in accordance with a test method adapted from the recommended ASTM B769-11 standard. ASTM B69-11 is the recognised standard test method for shear testing of aluminium alloys. There is currently no specified ASTM standard for testing of bismuth alloys. However, as the pure shear test principle is largely the same regardless of material type, this standard was adopted to determine the ultimate shear strength of the alloy of the first aspect of the present invention. It is recognised that loading conditions developed by this standard, and others, do not strictly satisfy the definition of pure shear, pure shear conditions rarely exist in structures. The present test was conducted in a double-shear rig mode in order to improve the accuracy of the results.

Table 3 below details the shear strengths as a function of temperature for Alloy-80 cast in the four different environments detailed above (in air, under pressure of 5000 psi (about 34.5 MPa), under pressure of 5000 psi (about 34.5 MPa) and sour deaerated seawater, and under pressure of 5000 psi (about 34.5 MPa) and deaerated seawater).

TABLE 3

| | Shear Strength (MPa) of Alloy 80 Cast in; | | | |
|---|---|---|---|---|
| Test Temperature | Air | Pressurised Argon Gas | Pressurised Deserated Seawater | Pressurised Sour Deaerated Seawater |
| RM Temp. (25° C.) | 57 | 44 | 44 | 44 |
| 70° C. | 39 | 32 | 35 | 36 |
| 80° C. | 34 | 31 | 31 | 33 |
| 90° C. | 26 | 29 | 28 | 26 |

The limitations of the ASTM B769-11 standard in determining the shear modulus of the alloy of the first aspect of the present invention meant that an alternative test method was used. In particular, the ASTM B769-11 standard is, in principle, limited to only the determination of the ultimate shear strength of the test material. In order to address this issue, alternative test methods, namely ASTM E1876-09 and EN 843-2/EN 821-2 standards, had to be used for the determination of the shear modulus of the alloy of the first aspect of the present invention. Therefore, further measurements were conducted in accordance with the ASTM E1876-09 and EN 843-2/EN 821-2 standards, using the so-called "impact excitation" or "natural frequency" methods.

Finally, as mentioned previously, beside creep, it is also necessary to consider corrosion control. It is believed that the ternary alloy of the first aspect of the present invention has improved corrosion behaviour over the alloys of the prior art. FIGS. 26*a* and 26*b* show the impact of corrosion as obtained from an accelerated ageing/corrosion test and as a function of temperature on the ultimate tensile strength of air cast alloy of the first aspect of the present invention at the anodic and cathodic electrode respectively. In order to determine the impact of corrosion on the mechanical properties of the alloy, an accelerated aging/corrosion test involving the use of the alloy as both the cathode and anode electrodes of an electrochemical cell containing dilute (10% by volume) sulphuric acid held at a potential difference of 0.6V was carried out at room and at elevated temperatures of around 70° C. FIGS. 26*a* and 26*b* show the results for the tests carried out at room temperature and at 70° C. Whilst it can be seen that in the event that the alloy of the first aspect of the present invention adopts an anodic polarity may result in higher degradation in strength over time compared to if it were to adopt a cathodic polarity, the rate of corrosion may reduce over time due to passivation and decreasing corrosion current.

FIGS. 27 to 44 relate to an alloy according to the fourth aspect of the present invention.

FIG. 27 shows the typical ultimate tensile and compressive strengths for the Bi—Zn eutectic alloy of the prior art and of the alloy of the fourth aspect of the present invention. The tensile test was conducted at a constant cross-head speed of 1 mm/min. It can be seen that the ultimate tensile strength of the alloy of the fourth aspect of the present invention is approximately four times that of the Bi—Zn alloy of the prior art and that the ultimate compressive strength is approximately 71% higher for the alloy of the fourth aspect of the present invention.

FIGS. 28*a* to 28*f* show various images of a sample of the alloy of the fourth aspect of the present invention which has been tested to failure. FIG. 28*a* is a low magnification image of the longitudinal section of the failed sample, and FIGS. 28*b* and 28*c* are higher magnification images in BSE mode of the crack front within the same fractured sample shown in FIG. 28*a* and these indicate how the secondary particles present in the matrix of the sample retard the progress of the crack. FIG. 28*d* shows a fractographic image in SE mode of a failed sample of the alloy of the fourth aspect of the present invention showing how a progressing crack front is stopped by the presence of a secondary particle. FIG. 28*e* shows a micrograph of a known Bi—Zn eutectic alloy where the alloy comprises a matrix of bismuth and very fine needle-likes plates of zinc precipitated throughout. The fractographic image of FIG. 28*f* of a sample of a failed Bi—Zn sample shows the absence of secondary particles which would have impeded the progress of an advancing crack path in the case of the alloy of the fourth aspect of the present invention.

The tests conducted on the alloy of the fourth aspect of the present invention were conducted on as-cast specimens which had not been given any further heat treatment. However, since the alloy of the fourth aspect of the present invention is intended to be used to form a plug to seal a well, tests were also conducted on samples which were cast under pressure and under similar conditions to those found in wells, in particular oil wells. Such test samples were machined from samples of the alloy according to the fourth aspect of the present invention under pressure in a stainless steel autoclave filled with simulated fluid and gaseous environments.

The simulated environments were deaerated sweater adjusted to pH 10-11 to represent a low-corrosivity environment; deaerated seawater made biologically sour to a "NACE Solution" composition which was around 600 mg/l dissolved in $H_2S$ at a pH range of 4.5-6.5 reference: NACE MR0175/section B.3.5.4 (Type 3a and 3b environments); and pure argon gas. The pure argon gas environment was used to determine the effect of casting the alloy of the fourth aspect of the present invention under pressure.

FIG. 29 is a micrograph showing the typical structure of the alloy of the fourth aspect of the present invention, which is interpreted to be a mixture of bismuth-rich, silver-rich, and bismuth-silver eutectic phases. The structure comprises banded lamellar platelets in which the minor phase, namely Ag, appears as thin aligned but broken plates in transverse section. FIG. 30*a* to *e* shows the typical energy dispersive x-ray analysis (EDXA) of the alloy of the fourth aspect of the present invention and shows the presence of elemental bismuth and silver.

Figure 31A:
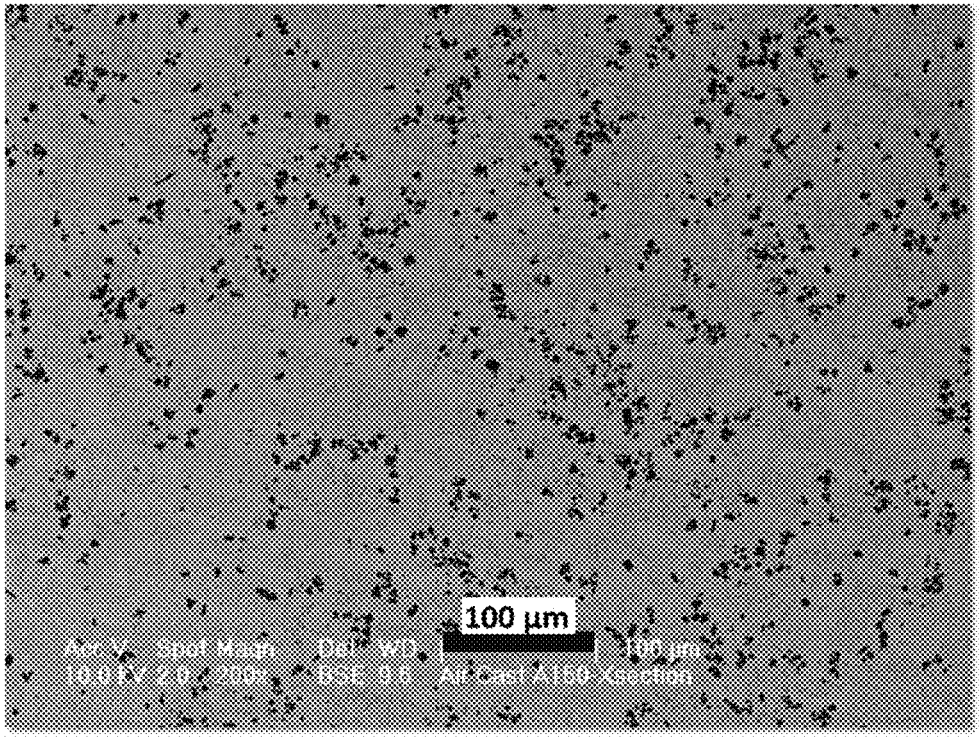
Figure 31B:
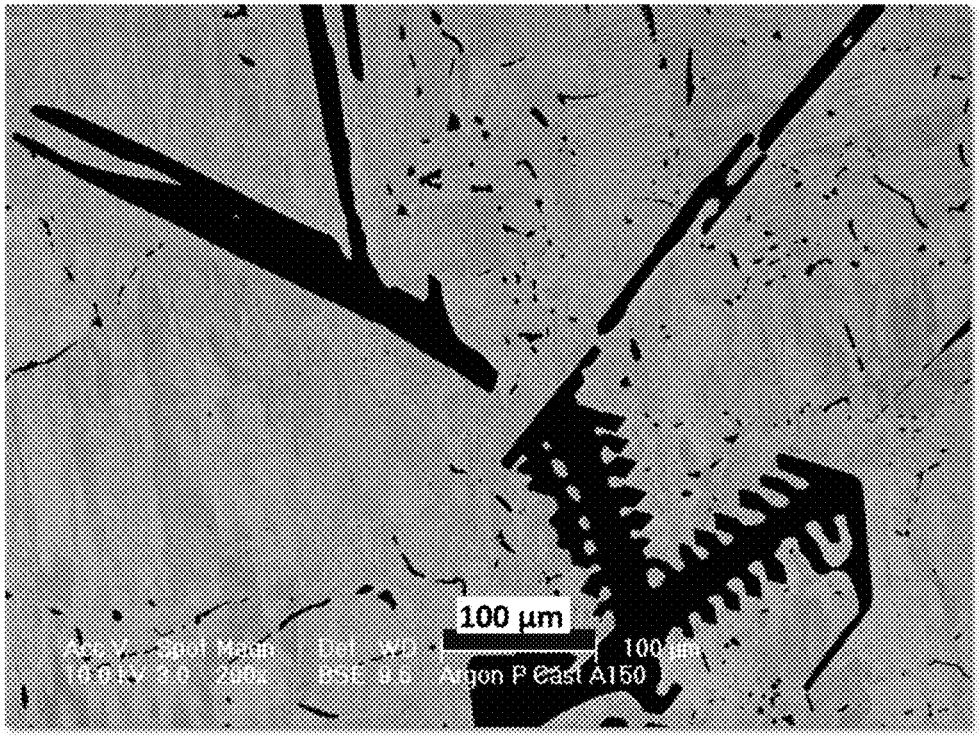
Figure 31C:
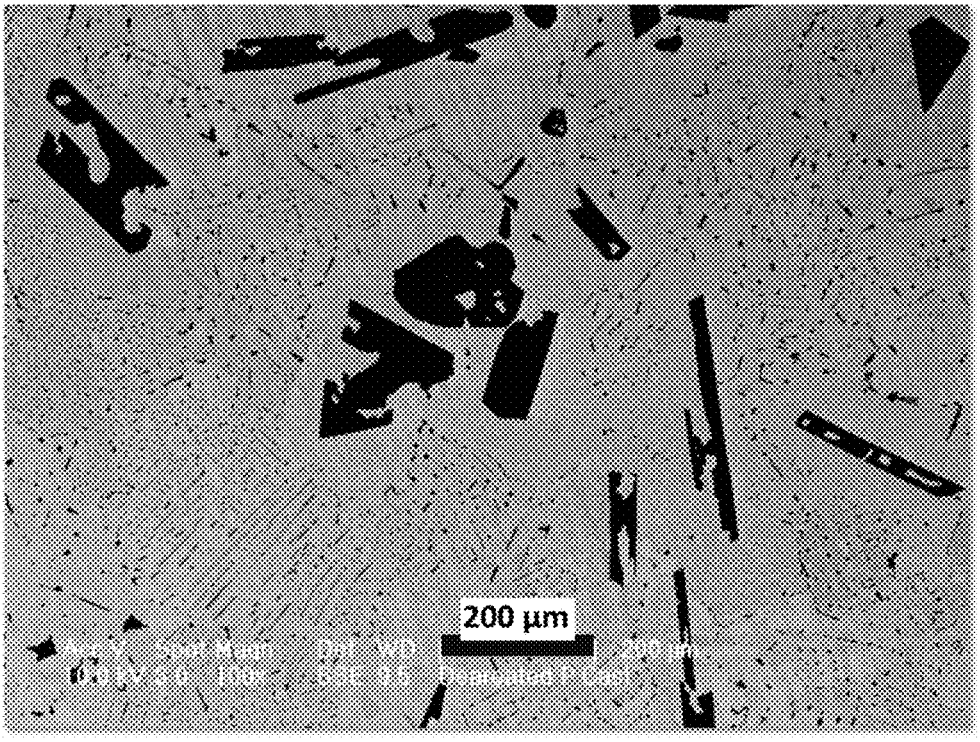
Figure 31D:
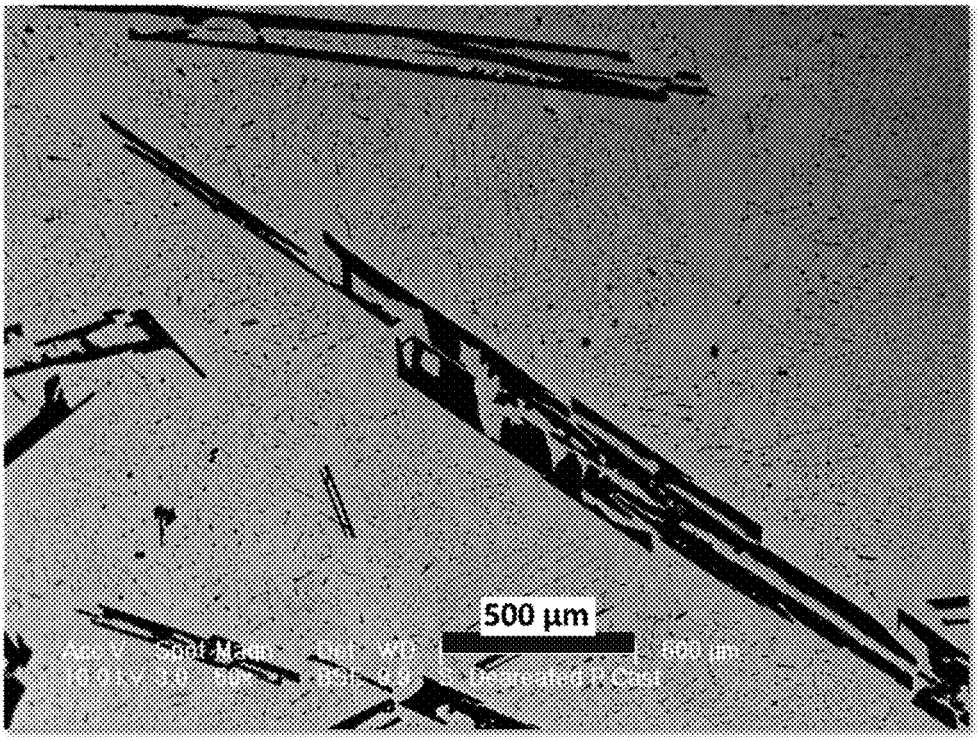
Figure 32A:
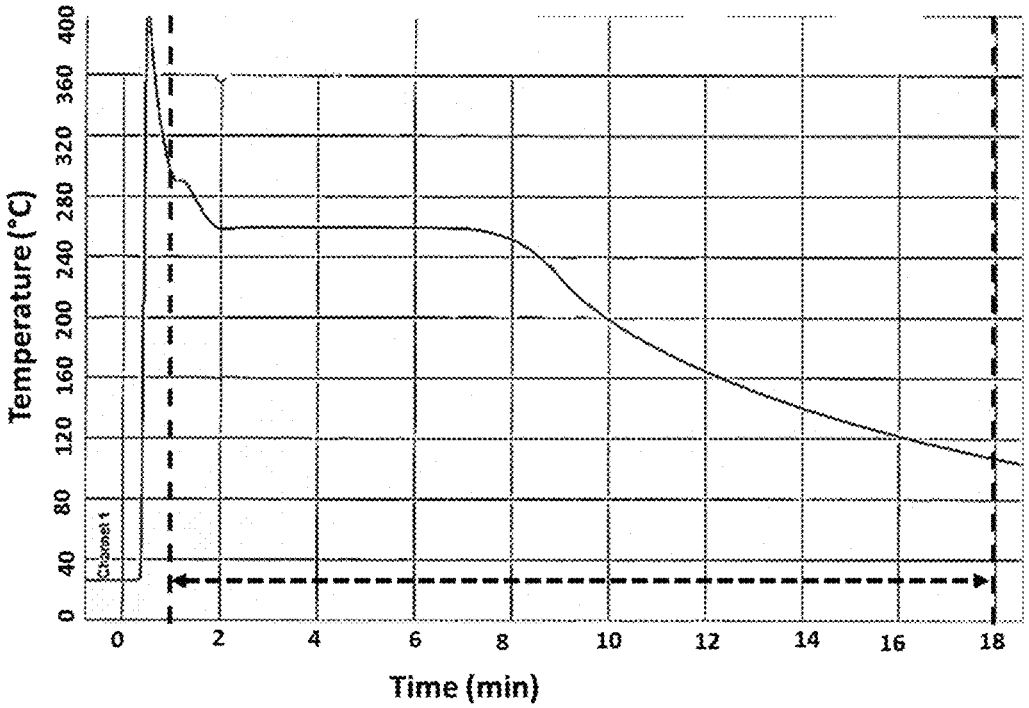
Figure 32B:
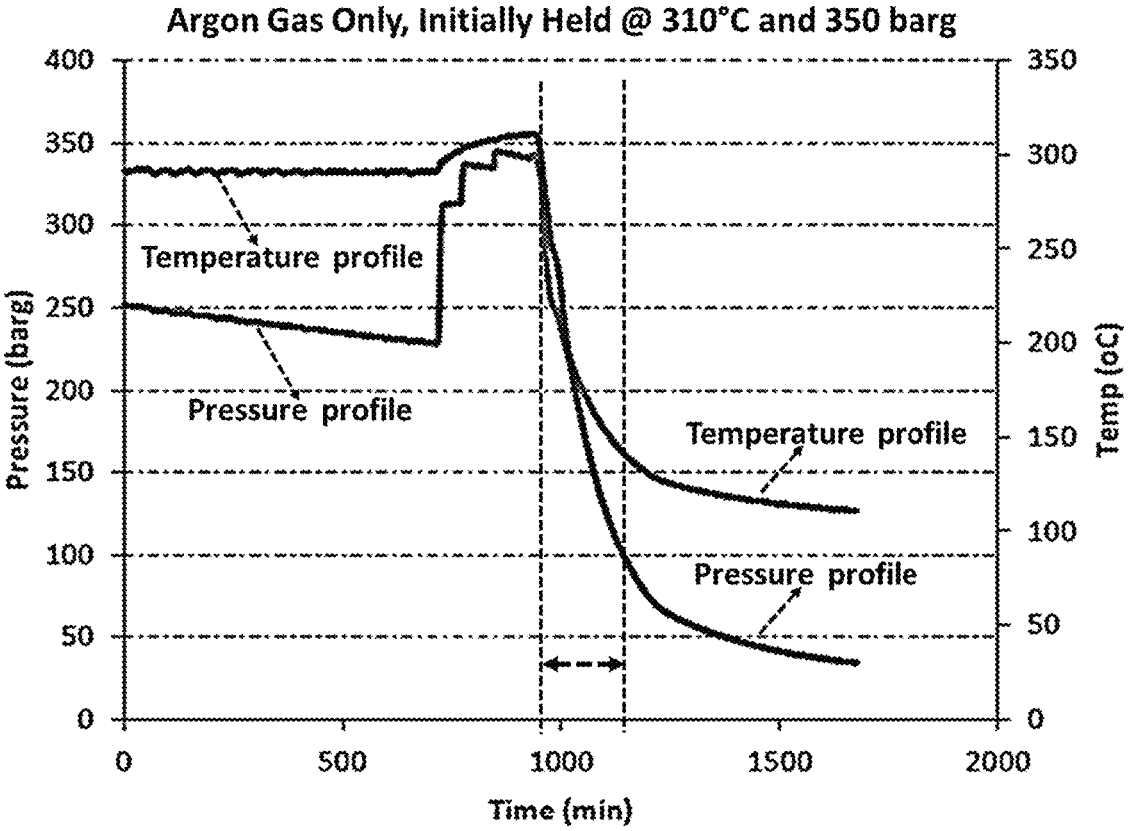
Figure 32C:
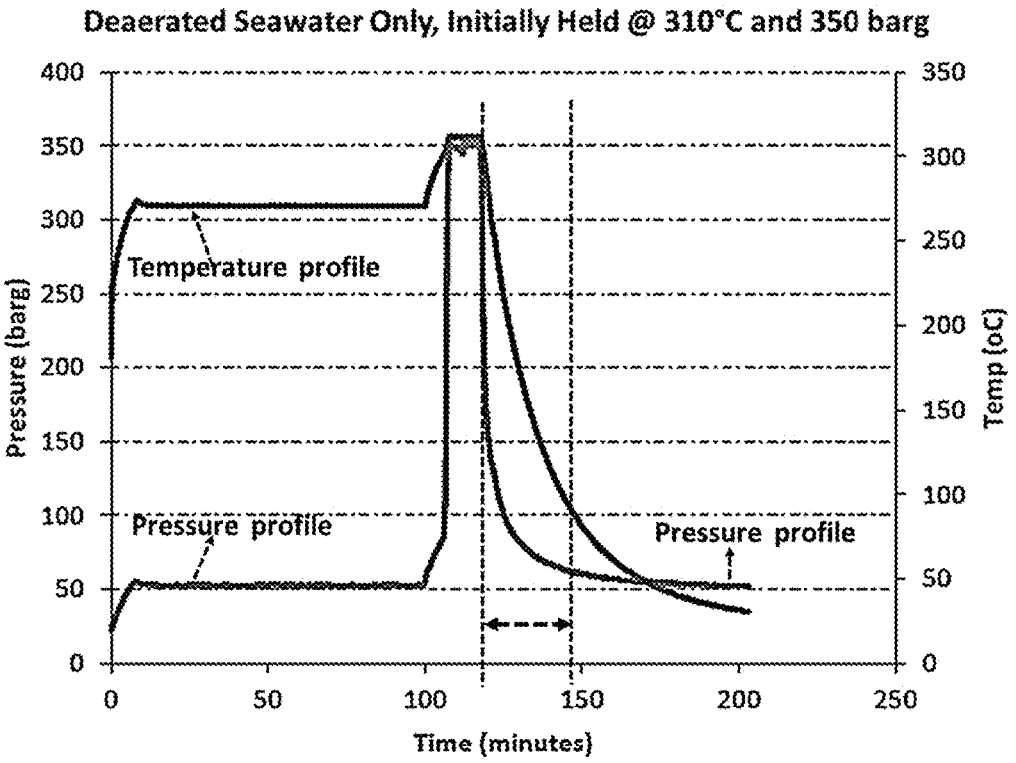
Figure 32D:
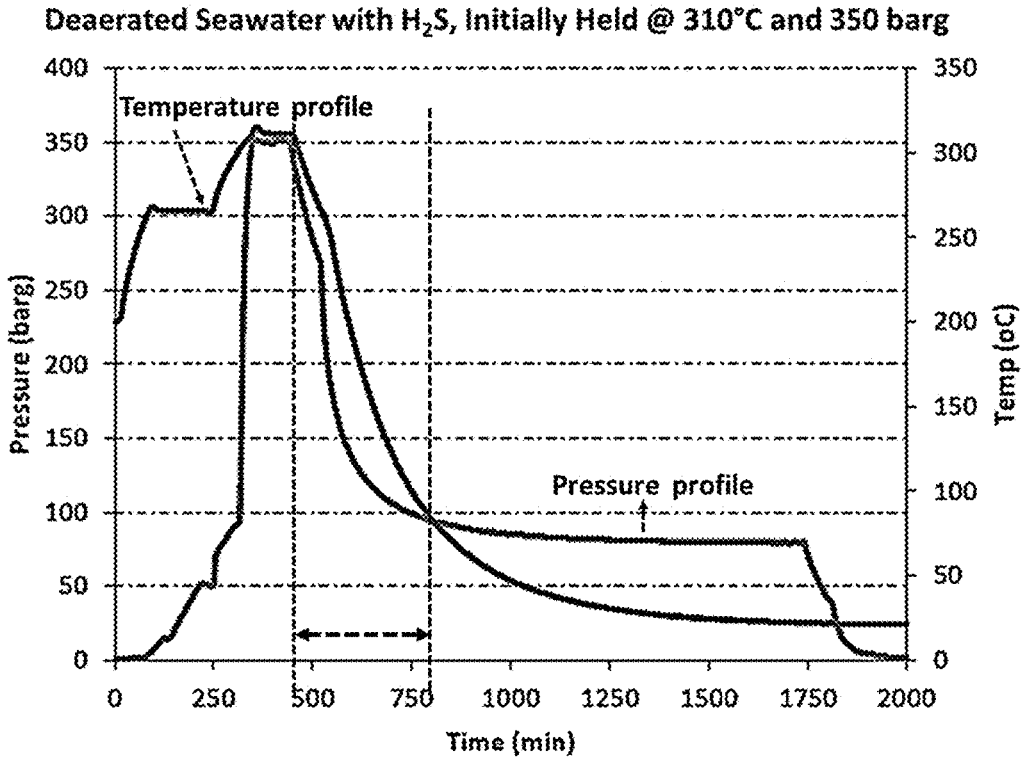

FIGS. 31*a* to *d* shows micrographs in BSE (back scattered electron) mode of the effect of casting under pressure and in the simulated environments described above. FIG. 31*a* shows the micrograph of the sample cast in air, FIG. 31*b* shows the sample which was cast under a pressure of 5000 psi (about 34.5 MPa), FIG. 31*c* shows the sample cast under 5000 psi (about 34.5 MPa) and in sour deaerated seawater, and FIG. 31*d* shows the sample cast under 5000 psi (about 34.5 MPa) under deaerated seawater. FIGS. 31*b* to *d* all show large silver-rich dendrites within the bismuth-rich phase matrix. The sizes of the silver-rich dendrites are about 15 to 20 times larger in the pressure cast samples than the air cast sample. The shape of the silver-rich dendrites is irregular and highly angled which suggests that the interface between the silver-rich dendrites and surrounding bismuth-rich phase is heavily strained with stressed regions.

FIGS. 32*a* to *d* show the cooling curves and the time taken to cool down from 310° C. to 100° C. These figures show that, for an equal mass of around 6 kg, the time taken to cool the air cast sample is around 15 to 20 times faster than the pressure cast samples. This difference may account for why the silver-rich dendrites in the pressure cast samples are 15 to 20 times larger than those in the air cast sample. The air cast sample took around 15 minutes to cool from 310° C. to 100° C., whereas the sample cast under argon at 5000 psi (about 34.5 MPa) took around 219 minutes, the sample cast under deaerated seawater at 5000 psi (about 34.5 MPa) took around 270 minutes, and the sample cast under sour deaerated seawater took around 313 minutes. The starting material for the pressure cast samples of the alloy of the fourth aspect of the present invention were made from existing air cast samples. As such, the starting size of the silver rich dendrites were similar to those in the air cast sample and since the temperature was only 310° C., the pre-existing silver dendrites did not melt. Rather the silver-rich dendrites act as nucleation sites from which more silver enriched dendrites form. As the cooling rate drops due to the thermal mass of the deaerated seawater, the diffusion rates of silver atoms across the dendrite interface increases leading to higher growth rates and coalesces the silver enriched phase found in the pressure cast samples. In contrast, the higher cooling rate associated with the air cast sample promotes a higher nucleation rate with smaller dendrites.

FIGS. 33*a* and *b* show the volumetric expansion of the alloy of the fourth aspect of the present invention at a pressure of 250 bar (gauge). In order to determine the volumetric expansion of the alloy of the first aspect of the present invention, 10 grams of a pore and gas free sample of the alloy of the fourth aspect of the present invention with a known volume was placed in a graduated cylindrical Pyrex glass within which a freely-moving flat ended ceramic piston rests on top of the sample. As the sample expands or shrinks during heating and/or cooling, the displacement of the piston can be measured and this can be used to measure the amount by which the sample has expanded or contracted. The inner diameter of the cylindrical Pyrex glass provides sufficient clearance for the expansion of the metal relative to the ceramic piston up to the melting point of the metal sample.

The starting mass and dimensions of the alloy sample to be tested and of the cylindrical Pyrex glass are measured, and a starting density is calculated. The total piston length and the overall unit length when assembled are also measured. The overall unit is then subjected to a heating/cooling cycle in a mechanical dilatometer under a small axial force. During testing, a heating/cooling rate of 0.5° C./min was used with date being logged every minute. As the unit is heated, the alloy sample expands lengthwise. When the alloy begins to melt, the cylindrical cavity beneath the ceramic piston becomes completely filled leading to a decrease in the length of the unit. With further heating, the alloy expands volumetrically and pushes the piston out again. On cooling, the reverse process occurs.

As such, by measuring the relative displacement of the ceramic piston, and hence the volume of the cavity created but subsequently filled with the alloy, as the unit was heated or cooled relative to the starting volume, the volumetric expansion of the alloy may be determined. The 'zero' volume is the starting unit volume and the 'relative' volume refers to the displace volume after subtracting the starting unit volume.

Figure 33B:
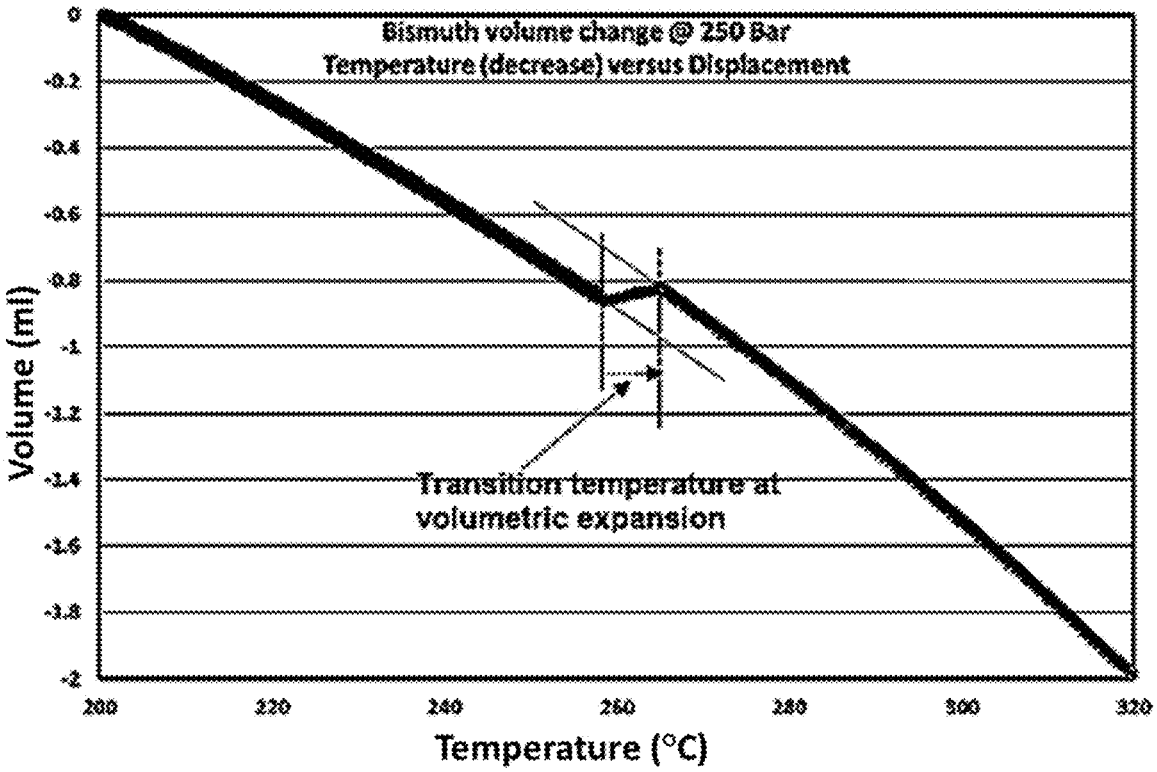

FIG. 33*a* shows the volumetric change of the alloy of the fourth aspect of the present invention when it is being heated, and FIG. 33*b* shows the volumetric change when the alloy is being cooled. These figures demonstrate that the alloy of the fourth aspect of the present invention expands by as much as 2.82% in volume upon freezing. Since the alloy of the fourth aspect of the present invention is hyper-eutectic in composition, the expansion does not occur instantaneously at a particular temperature on freezing, but rather over a temperature range as shown in FIGS. 33*a* and *b*.

FIG. 34 shows a comparison of the room temperature densities of solid alloy of the fourth aspect of the present invention cast under different conditions using a Quantachrome Poremaster. The Quantachrome Poremaster is specifically designed to measure the true volume of a test sample of known mass by employing the principle of fluid displacement and gas expansion. The apparatus uses helium gas to penetrate any surface flaws of the sample down to around one Angstrom in size so that an accurate volume of the sample can be measured. The true density of the sample can then be calculated. This figure demonstrates that casting under increased pressure leads to an increase in the density of the alloy. Without wishing to be bound by scientific theory, it is believed that the increase in density of the alloy is due to the associated increased compaction and subsequent densification effect.

FIG. 35 shows the latent heat of fusion (melting/freezing) of the alloy of the fourth aspect of the present invention cast in different environments. The test results were obtained using differential scanning calorimetry (DSC) in accordance with the ASTM B778-00 standard. An equal mass of the alloy of the fourth aspect of the present invention was tested in all cast conditions. Discounting the results of the samples pressure cast under argon gas, which serves as a control, it is clear from FIG. 35 that the energy requirement to melt an equal amount of the other samples, namely the air cast, the pressure cast in deaerated seawater, and pressure cast in sour deaerated seawater, are essentially the same, about 51-53 J/g.

FIG. 36 shows the temperatures at which full alloy melting occurs (the liquidus temperature) is lower in pressure cast samples in comparison to the air cast sample. The air cast sample melts fully after the temperature reaches 290° C., whereas the pressure cast samples fully melt at 268° C. As such, the temperature required to melt the alloy of the fourth aspect of the present invention under pressure is lower than when cast in air.

FIG. 37 shows the specific heat capacity of a sample of 26 mg of the alloy of the fourth aspect of the present invention as determined using DSC in accordance with ASM E1269-11 at a heating rate of 5° C./min. This shows that the specific heat capacity rose during the melting process of the samples.

FIG. 38 shows the coefficient of thermal linear expansion as a function of temperature for the alloy of the fourth aspect of the present invention cast in air. The coefficient of thermal liner expansion is one of the most important thermal properties of the alloy of the fourth aspect of the present invention, as this together with its volumetric expansion and coefficient of friction plays a crucial role in determining the reaction force, and hence its sealing capability, which the alloy can generate against both the casing and mandrel materials once deployed. FIG. 38 shows the test results as determined using a push-rod dilatometer in accordance with the ASTM E228-11 standard.

FIG. 39 shows the thermal conductivity of the alloy of the fourth aspect of the present invention cast in air. The thermal conductivity was indirectly measured using a laser flash method in accordance with the ASTM E1461-11 standard.

FIG. 40 shows the difference in the hardness of the alloy of the fourth aspect of the present invention cast under different conditions. The hardness value was obtained in accordance with the ASTM E384-11 standard using a 5 kg load cell and a test dwell time of 10 seconds at room temperature. The hardness of the air cast sample was found to be 18 $H_v$, which is about 6 $H_v$, higher than the samples cast under pressure. This is believed to be due to the finer grain size and smaller sliver-rich dendrites of the air cast sample.

FIG. 41 shows the ultimate tensile strength and the yield stress measured at different temperatures for the alloy of the fourth aspect of the present invention cast and cooled in air. The tensile test conducted to determine the tensile behaviour of the alloy of the fourth aspect of the present invention were carried out at room and elevated temperatures in accordance with the ASTM E8/E8M and ASTM E21-09 standards respectively. Regardless of the test temperature, all tests were conducted at a constant strain rate of $10^4$ $s^{-1}$.

FIG. 42 shows the ultimate tensile strength and the yield stress as a function of temperature for the alloy of the fourth aspect of the present invention cast and cooled in air. The unconfined compressive strength at different temperatures was measured using the recommended ASTM standards E9 (room temperature) and E29 (raised temperatures).

FIG. 43 shows the tensile and compressive Young's modulus of air cast alloy of the fourth aspect of the present invention as a function of temperature. The tensile elastic Young's modulus of air cast alloy, which is a measure of its stiffness within its elastic limit, was determined in accordance with E8/E8M (room temperature) and ASTM E21-09 (elevated temperature) and ASTM E9 (room temperature) and ASTM E29 (elevated temperature) for compressive Young's modulus. The Young's modulus values decrease with increasing test temperature due to the loss in stiffness regardless of the test mode. Within the range of experimental error, the tensile and compressive elastic Young's modulus values are essentially the same at each temperature regardless of test mode.

FIG. 44 shows the shear stress of air cast and cooled alloy of the fourth aspect of the present invention. The determination of shear strength of the alloy cast under different conditions as a function of different test temperatures was conducted in accordance with a test method adapted from the recommended ASTM B769-11 standard. ASTM B69-11 is the recognised standard test method for shear testing of aluminium alloys. There is currently no specified ASTM standard for testing of bismuth alloys. However, as the pure shear test principle is largely the same regardless of material type, this standard was adopted to determine the ultimate shear strength of the alloy of the fourth aspect of the present invention. It is recognised that loading conditions developed by this standard, and others, do not strictly satisfy the definition of pure shear, pure shear conditions rarely exist in structures. The present test was conducted in a double-shear rig mode in order to improve the accuracy of the results.

The alloys of the first and fourth aspects of the present invention are suitable for use as well sealing materials and are able to operate under the conditions found within wells. They are able to operate under these conditions for the minimum lifespan of 3000 years and offer improved performance characteristics over known alloys.

The invention claimed is:

1. A method of forming a plug in a well comprising:

providing an alloy composition of bismuth, tin, and antimony consisting essentially of 31 to 33% by weight of the tin, 2.1 to 2.4% by weight of the antimony, and a balance of the bismuth;

filling a length of the well with the alloy composition in a molten state; and then allowing the alloy composition in the molten state to solidify;

wherein the alloy composition does not creep at a temperature range from 60° C. to 100° C.

2. The method according to claim 1 wherein the bismuth is present at 65% by weight in the alloy composition.

3. The method according to claim 1 wherein the tin is present at 32% by weight in the alloy composition.

4. The method according to claim 1 wherein the antimony is present at 2.28% by weight in the alloy composition.

5. The method according to claim 1 further comprising sealing the well with the plug.

6. The method according to claim 1 wherein the well is an oil well.

* * * * *